US007394727B2

(12) United States Patent
Ushikoshi

(10) Patent No.: US 7,394,727 B2
(45) Date of Patent: Jul. 1, 2008

(54) CLOCK

(75) Inventor: Kenichi Ushikoshi, Shiojiri (JP)
(73) Assignee: Seiko Epson Corporation (JP)

( * ) Notice: Subject to any disclaimer, the term of this patent is extended or adjusted under 35 U.S.C. 154(b) by 278 days.
(21) Appl. No.: 10/572,903
(22) PCT Filed: Jun. 10, 2004
(86) PCT No.: PCT/JP2004/008510
§ 371 (c)(1),
(2), (4) Date: Mar. 21, 2006
(87) PCT Pub. No.: WO2005/031474
PCT Pub. Date: Apr. 7, 2005
(65) Prior Publication Data
US 2007/0081425 A1 Apr. 12, 2007
(30) Foreign Application Priority Data

| | | |
|---|---|---|
| Sep. 25, 2003 | (JP) | 2003-333541 |
| Sep. 25, 2003 | (JP) | 2003-333542 |
| Sep. 30, 2003 | (JP) | 2003-340315 |

(51) Int. Cl.

| | |
|---|---|
| ***G04B 19/00*** | (2006.01) |
| ***G04B 19/04*** | (2006.01) |
| ***G04B 19/02*** | (2006.01) |
| ***G04F 1/04*** | (2006.01) |

(52) U.S. Cl. ..... 368/76; 368/80; 368/93; 368/220; 368/223
(58) Field of Classification Search ..... 368/62, 368/65, 76, 80, 220, 223, 228
See application file for complete search history.

(56) References Cited

U.S. PATENT DOCUMENTS

| | | | | |
|---|---|---|---|---|
| 3,963,885 | A * | 6/1976 | Brien | 200/52 R |
| 4,024,701 | A * | 5/1977 | Corson | 368/94 |
| 4,077,198 | A * | 3/1978 | Mayenschein | 368/76 |
| 4,109,455 | A * | 8/1978 | Zacharin | 368/327 |
| 4,370,064 | A * | 1/1983 | Hicks et al. | 368/93 |
| 4,685,344 | A | 8/1987 | Horn et al. | |

FOREIGN PATENT DOCUMENTS

| | | |
|---|---|---|
| JP | 48-11068 | 4/1973 |
| JP | 48-11068 B | 4/1973 |
| JP | 5-142361 A | 6/1993 |

OTHER PUBLICATIONS

H. Yamauchi, "Mechanism", 5th Edition, "Gearings", Chapter 11, pp. 66-75; "Variable Motions and Variable Powers", Chapter 24, pp. 154-169; "Pumping and Raising Water", Chapter 66, pp. 492-501 (1961); and English translation.
K. Yamada, et al., "Restoration: Water Armillary Sphere-Chinese Astronomy Observation Clock in Eleventh Century", pp. 35-36 (1997); and English translation.
International Search Report for PCT/JP2004/008510, dated Sep. 15, 2004; ISA/JPO.

* cited by examiner

*Primary Examiner*—Vit W Miska
(74) *Attorney, Agent, or Firm*—Harness, Dickey & Pierce, P.L.C.

(57) ABSTRACT

A clock 1000 of the invention includes a dead-weight body, dead-weight body lifting means 100 for lifting the dead-weight body supplied to a lower position to an upper position, a rotation wheel 210 having, at its periphery, plural reception parts 212 which can hold the dead-weight body, and an escapement mechanism which actuates the rotation wheel intermittently. The dead-weight lifting means includes a drive body 110 provided with a spiral drive surface having a horizontal or inclined axis, and a rotation drive source which rotation-drives the drive body around the axis. The dead-weight lifting means is constructed such that the dead-weight body is driven on the drive surface by rotation of the drive body thereby to be translated from the lower position to the upper position. The dead-weight body lifted by the dead-weight lifting means to the upper position is supplied to the upper reception part, whereby the rotation wheel rotates by the predetermined angle. Thereafter, the dead-weight body exhausted from the reception part is returned to the lower position. Hereby, it is possible to provide a novel clock structure suitable for a moving mechanism clock, in which the operation can be performed with smaller drive force than the conventional drive force, consumption energy is small, and appreciation of the mechanism operation is superior.

16 Claims, 31 Drawing Sheets

(a)

(b)

(c)

CLOCK

TECHNICAL FIELD

The present invention relates to a clock, and particularly to the clock constitution preferable for a moving mechanism clock.

BACKGROUND ART

Generally, various moving mechanism clocks which operate using weight of an object such as water or a ball have been known. For example, a Water-powered Armillary and Celestial Tower constructed in Sun dynasty of China was restored also in Japan, and is exhibited at Gishodo of Lake Suwa, Clockwork Science Museum in Shimosuwa, Suwa-gun, Nagano. In this Water-powered Armillary and Celestial Tower, plural buckets are respectively attached to a peripheral portion of a water wheel (wheel) turnably, and water is poured in one of these buckets, whereby the water wheel turns by weight of water. At this time, as a clocking mechanism of the clock, an escapement mechanism is used, which is formed in combination of plural levers in order to intermittently drive the water wheel (refer to, for example, the following Non-Patent Reference 1).

Further, at a Geneva Clock and Watch Museum located at Geneva, Switzerland, a moving mechanism clock is exhibited. That moving mechanism clock is so constructed that a metal ball is lifted upward by a chain conveyer, this metal ball is put in recess portions provided at the periphery of a rotation wheel one by one, and the rotation wheel is driven by weight of this metal ball. In this moving mechanism clock, gravity of the metal ball is used in place of the constant drive power like a power spring. Further, this moving mechanism clock does not have a particularly novel escapement mechanism but is constructed similarly to the general clocks. [Non Patent Reference 1] "Restoration of Water-Powered Armillary and Celestial Tower, Chinese Astronomical Observation Clock Tower in the 11th century" by Keiji Yamada and Hideo Tsuchiya, published by Shinyosha, 15, Mar., 1997

DISCLOSURE OF THE INVENTION

Problems that the Invention is to Solve

However, in the Water-powered Armillary and Celestial Tower, the buckets are constructed so that they can individually turn around the wheel, and the amount of water is measured by the turn operation of the bucket every once. Therefore, there are problems that the structure becomes complicated, and the caught amount of each lever in the escapement mechanism is small. Further, in order to operate the wheel continuously, it is necessary to supply a large amount of water to a water storage tank arranged above. Further, the Water-powered Armillary and Celestial Tower itself is decorated at its external surface, and the internal mechanism is difficult to grasp. Therefore, though the Water-powered Armillary and Celestial Tower is high in design and appreciation, there is also a problem that its Tower is difficult to represent beauty in a mechanical operation mode and lively motion. Further, in this Water-powered Armillary and Celestial Tower, not only a large amount of water is required but also this water must be exactly supplied. Therefore, size-reduction is difficult, it is difficult to reduce a manufacturing cost, and it is difficult to heighten accuracy of time display.

On the other hand, in the moving mechanism clock which is exhibited at the Geneva Clock and Watch Museum and uses the metal ball, the metal ball is lifted to the upper portion of the rotation wheel by the chain conveyer, and this metal ball is supplied in the recess part of the rotation wheel. Therefore, large drive torque is necessary to lift the metal ball, a larger drive source than a drive source of the usual clock is necessary, and much drive energy is necessary. Further, a lifting mechanism of the metal ball, which is simply composed of the chain conveyer, is very mechanically ordinary, so that there is also a problem that this moving mechanism clock is poor in novelty. Further, in this moving mechanism clock, the plural metal balls are always arranged in the recess parts of the rotation wheel, so that the drive torque based on the weight of the metal ball is always applied onto the rotation wheel. Therefore, since the escapement mechanism, while applying the brakes onto the rotation wheel against the drive torque, must operate the rotation wheel intermittently, drive efficiency is bad, so that there is also a problem that energy-saving is difficult.

Therefore, in order to solve the above problems, an object of the invention is to provide novel clock structure which is superior in appreciation of a mechanism operation and appropriate for a Moving mechanism clock. Further, another object of the invention is to provide a clock which can perform time display of high accuracy while keeping a manufacturing cost low. Further, another object of the invention is to provide a clock which can operate with smaller drive force than the conventional drive force and is small in consumption energy.

Means for Solving the Problems

A clock of the invention is characterized by including a clock circuit which forms a clock signal corresponding to time, a clock drive part which has a rotation output mechanism for outputting rotational motion synchronized with the clock signal, a first motion converting mechanism which converts the rotational motion outputted from the clock drive part into a mode of motion other than the rotational motion, and a time display part which displays time correspondingly to the motion mode of the first motion converting mechanism.

According to the aspect of this invention, the first motion converting mechanism converts the rotational motion of the clock drive part into a motion mode other than the rotational motion, and the time display part displays time correspondingly to this motion mode. Hereby, accuracy of time display can be secured by using the clock drive part, a moving mechanism clock which is superior in appreciation can be constructed by the movement of the first motion converting mechanism or the motion mode obtained by the first motion converting mechanism, and further a manufacturing cost can be reduced by use of the clock drive part which is used in general clocks.

Further, a more particular clock of the invention is characterized by including a clock circuit which forms a clock signal corresponding to time, a clock drive part which has a rotation output mechanism for outputting rotational motion synchronized with the clock signal, a first motion converting mechanism which converts the predetermined rotational motion outputted from the clock drive part into a motion mode other than the rotational motion, a second motion converting mechanism which converts the motion mode of the first motion converting mechanism into the predetermined rotational motion or rotational motion different from this rotational motion, and a time display part which displays time correspondingly to the rotational motion outputted by the second motion converting mechanism.

According to the aspect of this invention, the first motion converting mechanism converts the rotational motion of the clock drive part into a motion mode other than the rotational motion, and the second motion converting mechanism converts that motion mode into rotational motion, whereby the time display part displays time correspondingly to this rotational motion. Hereby, accuracy of time display can be secured by using the clock drive part, a moving mechanism clock which is superior in appreciation because of the movement of the first motion converting part or the second motion converting part can be constructed, and further a manufacturing cost can be reduced by use of the clock drive part which is used in general clocks.

In the aspect of the invention, it is preferable that the first motion converting mechanism is composed of a dead-weight lifting mechanism which lifts a dead-weight body from a lower position to an upper position periodically on the basis of the rotational motion outputted from the clock drive part, and the second motion converting mechanism is composed of a rotation wheel which is rotation-driven upon reception of the dead-weight body supplied from the dead-weight lifting mechanism. Hereby, the dead-weight body is lifted by the dead-weight lifting mechanism, the rotation wheel receives this lifted dead-weight body thereby to be rotation-driven due to weight of the dead-weight body, and the time display part displays time according to the rotation of this rotation wheel. Therefore, a moving mechanism clock having high appreciation can be constructed by the motion of the dead-weight body in the dead-weight lifting mechanism and the rotation of the rotation wheel by the dead-weight body.

In the aspect of the invention, it is preferable that the rotational motion outputted from the second motion converting mechanism is intermittent rotational motion. Accordingly, by the operation of the mechanism which causes the intermittent rotational motion, a nostalgic operation such as an operation by the conventional pendulum clock or water clock can be realized. Therefore, appreciation in a moving mechanism clock can be further heightened.

In the aspect of the invention, it is preferable that: the rotation wheel has plural reception parts which receive the dead-weight body at its periphery; and the dead-weight lifting mechanism supplies the dead-weight body to the upper reception part thereby to return the dead-weight body exhausted from the reception part to the lower position after the rotation wheel has rotated at the predetermined angle. Hereby, in synchronization with the supplying operation and the exhausting operation of the dead-weight body, the rotation wheel is rotation-driven, and the dead-weight body circulates between the dead-weight lifting mechanism and the rotation wheel. Therefore, high appreciation can be obtained.

In the aspect of the invention, it is preferable that the clock drive part is, viewed from a front side of the time display part, arranged behind any one of the first motion converting mechanism, the second motion converting mechanism, or the clock display part. Accordingly, by arranging the clock drive part behind any one of the first motion converting mechanism, the second motion converting mechanism, or the clock display part, viewed from the front side of the time display part, the existence of the clock drive part is difficult to be confirmed visually. Therefore, the appreciation can be further improved.

A clock according to another aspect of the invention comprises a dead-weight body, dead-weight lifting means which lifts the dead-weight body supplied to a lower position to an upper position, a rotation wheel having at its periphery plural reception parts capable of holding the dead-weight, and an escapement mechanism which actuates the rotation wheel intermittently. This clock is characterized in that the dead-weight body lifted by the dead-weight lifting means to the upper position is supplied to the upper reception part thereby to return the dead-weight body exhausted from the reception part to the lower position after the rotation wheel has rotated at the predetermined angle.

According to the aspect of the invention, the dead-weight body is supplied to the reception part of the rotation wheel, whereby the rotation wheel is rotated at the predetermined angle, and thereafter, the dead-weight body is exhausted from that reception part. Therefore, the rotation wheel can be surely driven by the dead-weight body, and high appreciation can be represented by the operation mode of the dead-weight body. In this case, it is more preferable on emphasis of the motion of the dead-weight body that the dead-weight body is housed in only one reception part of the rotation wheel at a time.

In the aspect of the invention, it is preferable that: the dead-weight lifting means includes a dead-weight lifting mechanism which has a drive body provided with a spiral drive surface having a horizontal or inclined axis, and a rotation drive source which rotation-drives the drive body around the axis; and the dead-weight body is driven on the drive surface by rotation of the drive body and moves translationally from the lower position to the upper position.

In the aspect of the invention, by rotation-driving the drive body provided with the spiral drive surface having the horizontal or inclined axis around the axis of the drive surface by the rotation drive source, the drive surface moves in the radius direction of the drive body due to its spiral shape. Therefore, the dead-weight body supplied to the lower position can be moved translationally to the upper position by the drive surface. Here, the spiral drive surface means what has a surface shape extending along a spiral drawn on a plane (plane spiral) and does not include what has a helical surface shape.

Hereby, the dead-weight body is lifted upward while the drive body having the spiral drive surface is rotating, and the dead-weight body is supplied from the upper position to the upper reception part of the rotation wheel. Therefore, weight balance is lost by the dead-weight body and the rotation wheel rotates. The dead-weight body supplied to the reception part moves downward as the rotation wheel is rotating, and the dead-weight body is exhausted from this lower reception part, and returned to the lower position of the drive body. By repeating this operation, the rotation wheel is operated intermittently by the escapement mechanism, and clocking is performed by the intermittent operation of this rotation wheel.

According to this aspect of the invention, in the dead-body lifting mechanism, the drive body having the spiral drive surface is rotated thereby to lift the dead-weight body to the upper position, whereby the dead-weight can be lifted without requiring the large drive torque unlike the conventional chain conveyer. Further, by rotation of the spiral drive surface, a novel appearance that did not exit conventionally can be obtained, which can give high appreciation as the moving mechanism clock.

In the aspect of the invention, it is preferable that the dead-weight lifting means includes guide means for guiding the dead-weight body upward. The guide means guides the dead-weight body in the direction of the translation motion, whereby the dead-weight body can be moved stably in the guide direction. Particularly, in case that the axis of the drive body is not set in the horizontal direction, or in case that the dead-weight body moves in a contact state with the drive surface on the outer side of the drive body though the axis of the drive body is set in the horizontal direction, the guide means is necessary to stabilize the dead-weight body on the drive surface.

In the aspect of the invention, it is preferable that the dead-weight body moves upward while rolling on the drive surface. Since the dead-weight body moves while the drive body is rotation-driven around the axis, in case that the dead-weight body does not roll on the drive surface, slide resistance between the dead-weight body and the drive surface always increases a drive load on the drive body. Like the aspect of the invention, by rolling of the dead-weight body on the drive surface, friction resistance between the dead-weight body and the drive surface can be reduced, and the drive torque of the drive body can be reduced more.

In the aspect of the invention, it is preferable that the dead-weight body is a columnar body, a cylindrical body, or a spherical body. Accordingly, for example, in case that the dead-weight body is a columnar body or a cylindrical body, it is arranged on the drive surface in a posture having an axis parallel to the axial direction of the drive surface; and in case that the dead-weight body is a spherical body, it is arranged on the drive surface in an arbitrary posture. Hereby, since the dead-weight body can be lifted upward while being rolled, friction resistance (slide resistance or rolling resistance) between the dead-weight body and the drive surface can be reduced, so that the drive load on the drive body can be reduced more.

In the aspect of the invention, it is preferable that the axis of the drive body is arranged horizontally. By arranging the axis of the drive body horizontally, the dead-weight body can be moved so as to be lifted upward in the vertical direction. In this case, by the guide means, the dead-weight body can be moved in a state where it is held on a vertical surface passing an axial center of the drive body. Further, by the guide means, the dead-weight body can be also moved in a state where it is held in a top position of the drive surface or a lowest position thereof. At this time, the dead-weight body is held in a position on the drive surface where a horizontal surface is taken as a tangent surface. Therefore, stress produced between the dead-weight body and the guide means is reduced, and guide resistance by the guide means can be reduced most, so that the drive load can be further reduced.

In the aspect of the invention, it is preferable that the drive body has a pair of spiral strip materials which are arranged in a row in the axial direction and constitute the drive surfaces by surfaces of the spiral strip material pairs, holding frames, and a guide member. The holding frames are arranged on both sides in the axial direction of the spiral strip material pair, and hold the dead-weight body. The guide member is arranged between the pair of the spiral strip materials, and has a guide edge extending in a radius direction of the spiral strip material. Hereby, a guide plate is arranged between a pair of spiral strip materials, and the dead-weight body can be guided by its guide edge part. By such the construction, without complicating the individual component shape, the drive body can be readily constructed with simple component structure. In this case, it is preferable that: the dead-weight body is a columnar body, a cylindrical body, or a spherical body; and the radius of the dead-weight body is larger than the width of the spiral strip material, and equal to or less than the distance in the axial direction occupied by a pair of spiral strip materials arranged with sandwiching the guide member therebetween.

Here, it is desirable that the holding frame is provided with an entrance from which the dead-weight body is introduced in the lower position and an exit from which the dead-weight body is exhausted in the upper position. Hereby, the dead-weight body can be introduced on the drive surface through the entrance in the lower position, and can be exhausted through the exit in the upper position to be supplied to the rotation wheel.

In the aspect of the invention, it is preferable that the drive body has further a pair of plane-viewed spiral plate-shaped materials which are arranged in a row in the axial direction and constitute the drive surface by its end edge, a holding frame, and a guide member. The holding frames are arranged on both sides in the axial direction of the plate-shaped material pair and hold the dead-weight body. The guide member is arranged between the plate-shaped material pair and has a guide edge part extending in a radius direction of the plate-shaped material. Hereby, the dead-weight body driven on the drive surface provided for the end edge of the plate-shaped material pair is held by the holding frames arranged on the both sides in the axial direction, and guided by the guide edge part of the guide member arranged between the plate-shaped material pair. By such the construction, without complicating the individual component shape, the drive body can be readily constructed with simple component structure. Further, the drive surface is constructed at the end edge of the plate-shaped material, whereby the spiral shape can be formed freely and readily by the plane shape of the plate-shaped material, and shape accuracy of the drive surface can be heightened. Further, since the drive surface is constituted at the end edge of the plate-shaped material, rigidity on deformation of the drive surface can be increased. Therefore, support structure for keeping the spiral shape is not required, or the support structure can be simplified. Further, change with time in the shape of the drive body can be reduced, so that durability can be increased.

In the aspect of the invention, it is preferable that the reception part has a container shape provided with an opening part which is opened continuously from the reverse side in the rotational direction to the peripheral side. Hereby, through the opening part which is opened continuously from the reverse side in the rotational direction to the peripheral side, the dead-weight body is supplied into the reception part. When the rotation wheel rotates in some degree in this state, the reception part is inclined downward, so that the dead-weight body is exhausted from the peripheral side of the opening part of the reception part. In this case, since the opening range of the opening part is formed continuously from the reverse side in the rotational direction to the peripheral side, putting in-out of the dead-weight body for the reception part is facilitated and performed smoothly. Further, a supply angle of the dead-weight body to the rotation wheel and freedom on an angular range in which the dead-weight body keeps being held in the reception part increase. Therefore, drive efficiency of the rotation wheel can be heightened, and the number of teeth of the rotation wheel can be increased.

In the aspect of the invention, it is preferable that an inclined surface which is inclined upward toward an opening edge on the peripheral side of the opening part is formed on the periphery side of a bottom surface of the reception part. Hereby, in supply and exhaust of the dead-weight body for the reception part, the dead-weight body can be smoothly put in and out through the inclined surface. Further, it can be reduced that the dead-weight body once introduced in supply of the dead-weight body bounds out of the reception part due to repulsion power, or the dead-weight body is exhausted from the reception part at an excessive speed in exhaust of the dead-weight body.

In the aspect of the invention, it is preferable that a protruding part is provided for a periphery edge of the bottom surface of the reception part. Hereby, it is suppressed by the protruding part that the dead-weight body once introduced in supply of the dead-weight body bounds out, or the dead-weight body is exhausted from the reception part at the excessive speed in exhaust of the dead-weight body.

In the aspect of the invention, it is preferable that the escapement mechanism comprises plural fitting parts provided for the rotation wheel in the rotational direction; a first lever which is constructed fittably to the fitting part throughout a range of the predetermined angle of the rotation wheel, and supported so as to turn accordingly to the forward rotation of the rotation wheel in a fitting state to the fitting part; a second lever which is supported turnably between a fitting posture capable of fitting to the fitting part and an unfitting posture incapable of fitting to the fitting part, and fits to the fitting part in the fitting posture thereby to enable stop of the forward rotation of the rotation wheel; and a third lever which can switch the fitting posture and the unfitting posture of the second lever in cooperation with the first lever. Further, it is preferable that the escapement mechanism is constructed as follows: in a basic stop position of the rotation wheel, the second lever is in the fitting posture, and the rotation wheel can rotate forward till the fitting part fits to the second lever; when the rotation wheel starts rotating forward from the basic stop position, before the fitting part fits to the second lever, the first lever turns by the fitting part, the third lever turns in cooperation with the first lever, and the second lever is temporarily put in the unfitting posture by the third lever; thereafter, when the rotation wheel further rotates forward, the first lever turns more, whereby the fitting part gets beyond the second lever, and thereafter the third lever restores the second lever to the fitting posture; and thereafter, the first lever separates from the fitting part and returns to the original posture. Hereby, the escapement mechanism can be constructed readily and compactly. Further, it is easy to secure the caught amount of each lever to some degree.

ADVANTAGE OF THE INVENTION

According to the aspects of the invention, a novel clock structure which is superior in appreciation of a mechanism operation and appropriate for a moving mechanism clock can be realized. Further, a clock which can display time with high accuracy while keeping a manufacturing cost low can be constructed.

BRIEF DESCRIPTION OF THE DRAWINGS

FIGS. 22A to 22C are explanatory views respectively showing a dead-weight supplying position of the rotation wheel and a dead-weight exhausting position thereof;

DESCRIPTION OF REFERENCE NUMERALS AND SIGNS

1000 . . . clock, 100 . . . dead-weight lifting mechanism, 110 . . . drive body, 111A, 111B . . . spiral strip material, 112 . . . guide member, 113A, 113B . . . holding frame, 15, 115 . . . dead-weight body, 132 . . . entrance guide, 133 . . . exit guide, 200 . . . clocking mechanism, 210 . . . rotation wheel, 212 . . . bucket (reception part), 212*a* . . . opening part, 213 . . . first lever, 214 . . . second lever, 215 . . . link, 216 . . . third lever, 217 . . . movable hook, 218 . . . reverse-preventing lever, 220 . . . wheel train, 230 . . . character board, 231, 232 . . . pointer, 300 . . . decoration member

BEST MODE FOR CARRYING OUT THE INVENTION

Figure 1:
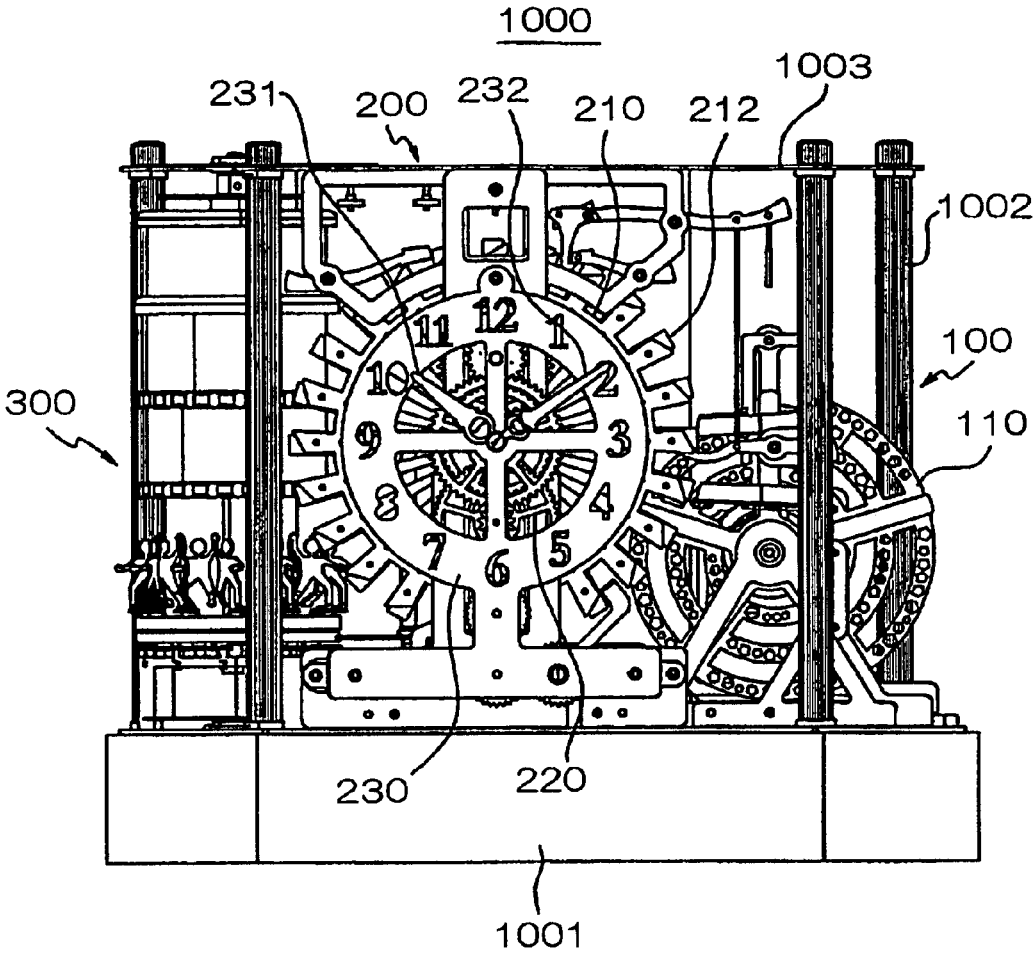
FIG. 1 is a front view of a clock.
Figure 2:
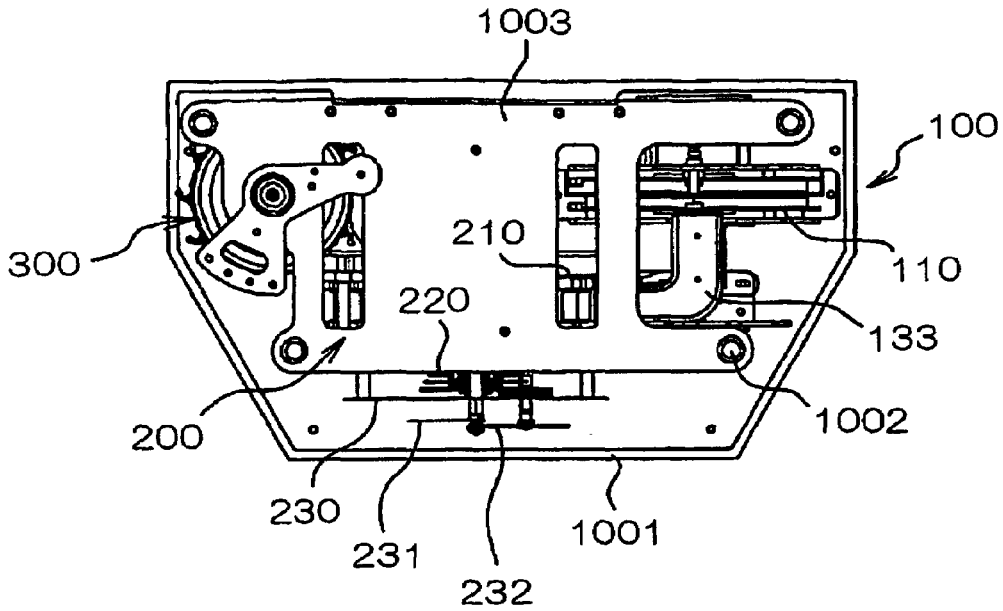
FIG. 2 is a plan view of the clock.
Figure 3:
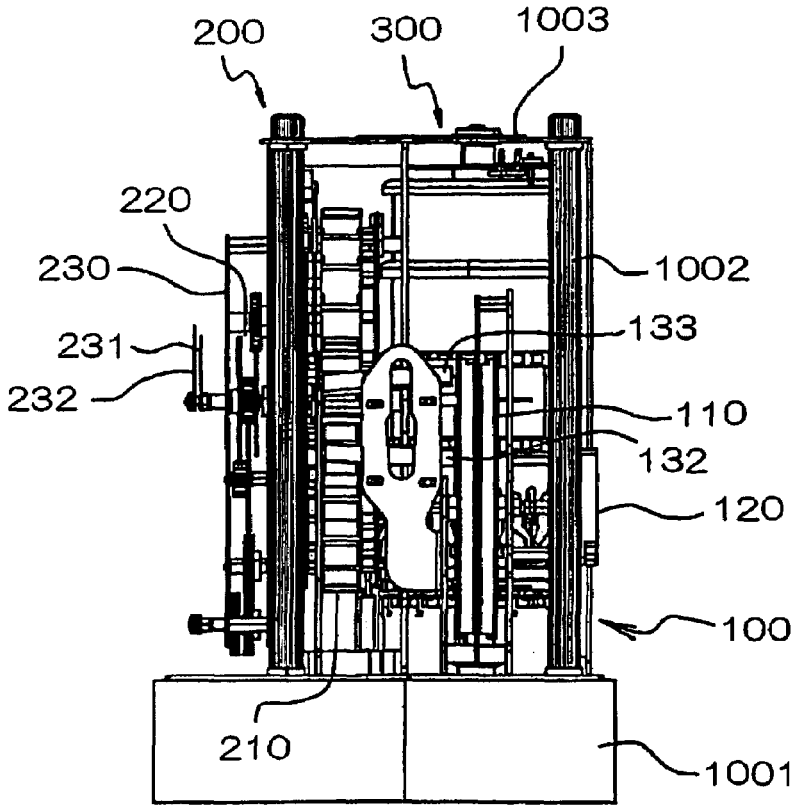
FIG. 3 is a right side view of the clock.

Next, with reference to attached drawings, embodiments of the invention will be described in detail. FIG. 1 is a front view of a clock according to an embodiment of the invention, FIG. 2 is a plan view of the same, and FIG. 3 is a right side view of the same. In this clock 1000, each mechanism is arranged on a base 1001. Namely, the clock 1000 comprises a dead-weight lifting mechanism 100 for lifting a dead-weight body, and a clocking mechanism 200 operated by the dead-weight body lifted by this dead-weight lifting mechanism 100. Further, a movable decoration member 300 which operates with the clocking mechanism 200 is arranged.

[Dead-Weight Lifting Mechanism]

Referring first to FIGS. 7 to 11, the principle of the dead-weight lifting mechanism 100 constituting a first motion converting mechanism of the clock 1000 will be described. In the dead-weight lifting mechanism of the invention, a drive body 10 shown in FIG. 7 includes a spiral drive part 11, and an inner surface and an outer surface of this drive part function as drive surfaces 11*a* and 11*b*. The drive surface 11*a* is the inner surface of the drive part 11, and the drive surface 11*b* is the outer surface of the drive part 11. An axial center 10P of the drive body 10 is a center point (center axis) of the spiral. As the spiral (plane spiral), there are various spirals, for example, a spiral of Archimedes, a hyperbolic spiral, and a logarithmic spiral (isometric spiral).

The spiral of Archimedes is represented, in a plane polar coordinates system in which r is a distance in a straight line from a center point and θ is an angle, by $r=a\theta=(P/2\pi)\cdot\theta$ Herein, $a=v/\omega$ (a is constant, v is velocity in going away from a center at a constant speed, and ω is angular velocity), and $P=2\pi a$ is a pitch distance. In this case, a pitch of the spiral is equal, so that the spiral of Archimedes is most preferable as the spiral shape of the invention.

The hyperbolic spiral is represented, in the same plane polar coordinates system, by $r=a/\theta$. Herein, a is constant. In this case, as θ becomes larger, r becomes smaller, and a center point becomes an asymptotic point. In this spiral shape, the pitch of the spiral becomes sharply narrower toward the center.

The logarithmic spiral is represented by $r=a\exp[K\cdot\theta]$. Herein, a and K are constant. This spiral shape is a curve in which an angle formed by a radius vector and a tangent is constant. Therefore, in movement from the center point in a radius direction, a tangent direction is always equal. Inclination in the tangent direction is $\phi=\cot^{-1}K$. In this spiral, the pitch becomes wider toward the outside little by little.

Figure 7:
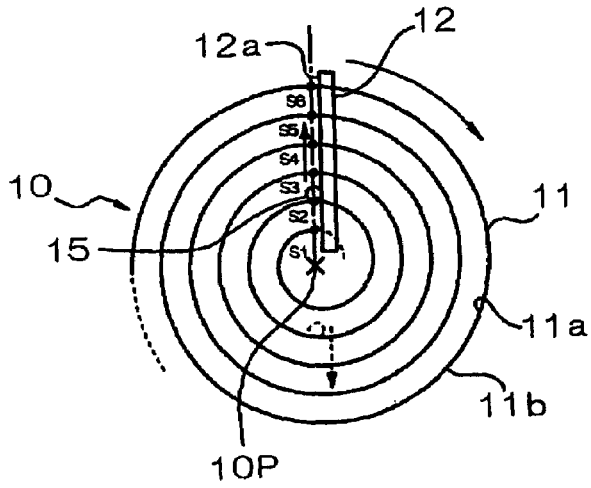
FIG. 7 is a principle diagram of the dead-weight lifting mechanism.

Next, as shown in FIG. 7, using the drive body 10, a dead-weight body 15 is driven. In order to drive the dead-weight body 15, the drive body 10 is rotated around its axial center lop, and the dead-weight body 15 is moved in the radius direction by the drive surface 11*a* or 11*b* of the drive body 10. Herein, the dead-weight body 15 is set so as to perform translational motion (movement in a straight line) along the radius of the drive body 10 in FIG. 7 (in a direction in which a straight line passing the axial center 10P extends). However, in the invention, the movement path of the dead-weight body 15 itself may not coincide with the radius of the drive body, and also it may adopt an arbitrary rectilinear path or curved path as long as its moving path is different from the spiral direction of the drive body 10.

As shown in FIG. 7, when the dead-weight body 15 is moved in a straight line in the radius direction of the drive body 10, a guide edge 12*a* of a guide member 12 is arranged along the radius of the drive body 10 and set such that the dead-weight body 15 is guided by the guide edge 12*a* and moves.

For example, when the axial center 10P is set in a horizontal direction and the drive body 10 is rotated, the dead-weight body 15 moves in a straight line up and down (in a vertical direction). Here, in case that the drive body 10 is rotated around its axial center 10P clockwise as shown in FIG. 7, the dead-weight body 15, when it is in a contacting state with the drive surface 11*b* as shown by a solid line in FIG. 7, goes moving upward. Further, as shown by a dotted line in FIG. 7, the dead-weight body 15, when it is in a contacting state with the drive surface 11*a*, goes moving downward. These moving directions become reverse directions in case that the rotational direction of the drive body 10 reverses.

Figure 8:
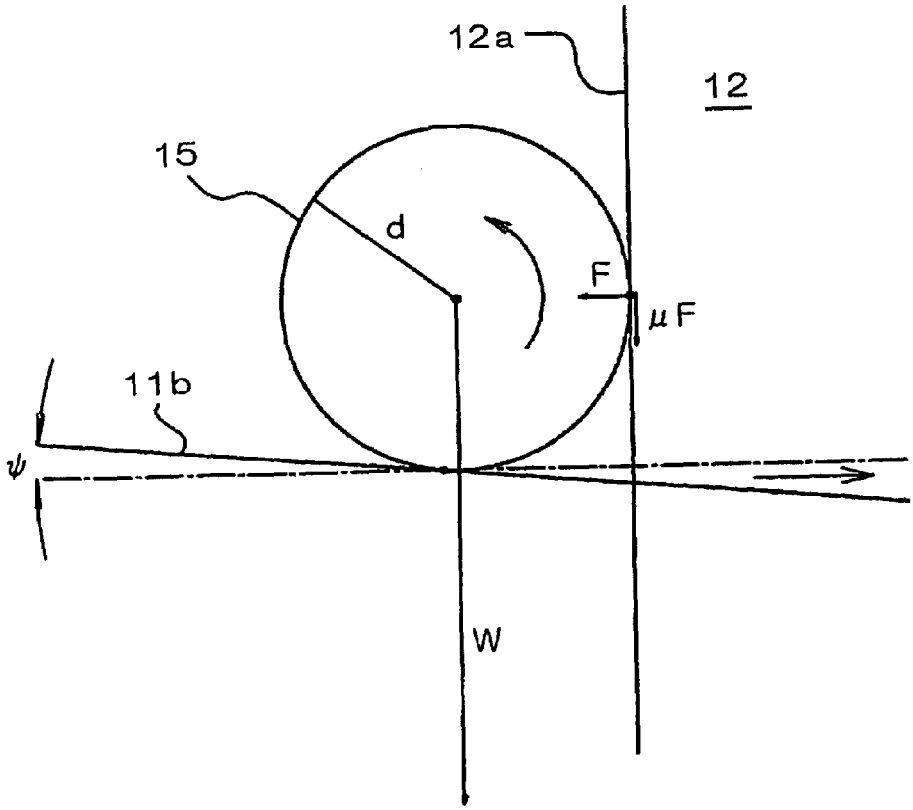
FIG. 8 is an enlarged explanatory view of a dead-weight body drive part of the dead-weight lifting mechanism.

FIG. 8 shows an operation mode of the dead-weight body 15 when the dead-weight body 15 is held on a vertical surface passing the axial center 10P of the drive body 10. Here, it is assumed that the dead-weight body 15 is a columnar body, a cylindrical body, or a spherical body having an axis parallel to the axial center 10P and the dead-weight body 15 is constructed so that it can roll on the drive surface 11*b* with the translational motion. The dead-weight body 15 receives attractive force W according to its weight downward, and also receives force F according to this attractive force W and an inclined angle ϕ of the drive surface 11*b* (more exactly, inclined angle of a tangent surface of the drive surface) from the guide edge 12*a* of the guide member 12. When the dead-weight body 15 rolls on the drive surface 11*b*, friction force μF (μ is coefficient of dynamical friction) between the dead-weight body 15 and the guide member 12 is almost determined by this force F.

Assuming that the spiral shape of the drive body 10 is the spiral of Archimedes, the inclined angle ϕ of the drive surface 11*b* (inclined angle of the tangent surface of the drive surface) on the vertical surface passing the axial center 10P becomes $\phi=2/\pi-\tan^{1-}\theta$. For example, when θ=1.5π, ϕ=11.98°; when θ=2π, ϕ=9.04°; when θ=3.5π, ϕ=5.20°; when θ=4π, ϕ=4.55°; when θ=5.5π, ϕ=3.31°; when θ=6π, ϕ=3.04°; when θ=7.5π, ϕ=2.43°; and when θ=8π, ϕ=2.28° In this case, since the moving path of the dead-weight body 15 coincides with the radius, an angle formed by the drive surface 11*b* and a tangent (tangent surface) in the predetermined radius direction is obtained by the above calculation.

Next, the force F is determined by the inclined angle ϕ and the attractive force W, that is, $F=W\tan\phi$. Here, assuming that the dead-weight body 15 rolls by the rotation of the drive body 10 and slides with respect to the guide edge 12*a* of the guide member 12, friction force produced by this slide is $\mu F=\mu W\tan\phi$. As described above, the larger θ becomes, the smaller the inclined angle φ becomes. In result, the force F becomes also smaller, and the friction force also becomes smaller. Therefore, without suing the region in which θ is small, friction loss reduces. However, in this case, in order to secure a movement stroke of the dead-weight body, the size of the drive body 10 is made large correspondingly.

A drive load on the drive body 10 due to the friction force μF of this dead-weight body 15, that is, friction loss is taken as $M_F$. Here, the distance between the axial center 10P of the drive body and the guide edge 12*a* (or its extension line) is within a range from a radius d of the dead-weight body 15 to its diameter at the largest. Therefore, in case that its distance is, for example, equal to the radius d shown in FIG. 8, the friction loss $M_F$ that is the load on the drive body becomes μFd.

Further, the drive body 10 causes axial loss $M_X$ by its weight $W_O$ and the weight W of the dead-weight body 15. This is represented by the following expression; $M_X=\mu_O(W_O+W)e$, in which e is a radius of an axial support of the drive body 10, and $\mu_O$ is coefficient of dynamical friction of the axial support.

Putting the above results together, in case that $M_F=\mu Fd$ (d is the radius of the dead-weight body) is the frictional loss by rolling, the total loss $M_{TOTAL}$ is represented by $M_{TOTAL}=M_F+M_X=\mu Fd+\mu_O(W_O+W)e=\mu Wd\tan\phi+\mu_O(W_O+W)e$. Here, in case that the following values are used, the total loss comes to about 2 g·cm: μ=0.2, $\mu_O$=0.1, W=5 g, $W_O$=50 g, and tanφ=the average of the above values. Therefore, the dead-weight body 15 can be readily driven even with slight drive torque such as a movement of a clock.

Any of the above results is shown in case that a single dead-weight body 15 is driven. In case that the plural dead-weight bodies 15 are simultaneously driven (for example, in case that the dead-weight bodies 15 are arranged in plural positions of positions S1 to S6 in FIG. 7), the friction loss $M_F$ is obtained by multiplying the total of the loss by the number of the dead-weight bodies 15, and the axial loss $M_X$ is obtained by multiplying W in the expression by the number of the dead-weight bodies 15. Here, with a pitch of the spiral in which the dead-weight body 15 is moved being 15 mm, in order to raise three dead-weight bodies 15 simultaneously or sequentially in the different circumferential positions, a drive body 10 having a radius of 4 pitches, that is, 15 mm×4=6 cm is necessary to introduce and exhaust the dead-weight body 15. Further, the axial loss $M_X$ is obtained by using 3W in place of W, and the friction loss $M_F$ is obtained by trebling the whole. The total loss is, using the above values, obtained by trebling the aforesaid result at the maximum, that is, the total loss is 2 g·cm×3=6 g·cm or less.

In a conventional method, with the dead-weight body held at the periphery of the drive body, the drive body is rotated from a state where the dead-weight body is in a height equal to the axial center of the drive body to a state where the dead-weight body is arranged right over the axial center, whereby the dead-weight body can be lifted. However, in this case, a position on an arc of the peripheral circle which is most distant from the rotational center of the drive body in the horizontal direction is a start point. Therefore, the maximum torque necessary for the drive body is produced when the dead-weight body starts moving on the arc of the peripheral circle. The maximum torque is obtained by the product of weight W of the dead-weight body and distance (radius) R from the axial center of the drive body to the dead-weight body. Therefore, for example, in case that the weight W of the dead-weight body is 5 g, and the radius R is 6 cm, the required drive torque is 30 g·cm. Also in this case, as the number of the dead-weight bodies increases, the maximum torque also increases naturally. Further, also in this case, in order to obtain the total loss, the axial loss is further added to the friction loss similarly to the aforementioned. Therefore, the total loss in this embodiment becomes 6 g·cm, compared with the total loss (30 g·cm) in the conventional dead-weight lifting mechanism, on a numeral value. In result, the total loss in this embodiment becomes one-fifth or less on calculation, and the loss torque comes to a very small value. In an experiment, a smaller value has been obtained.

Figure 9:
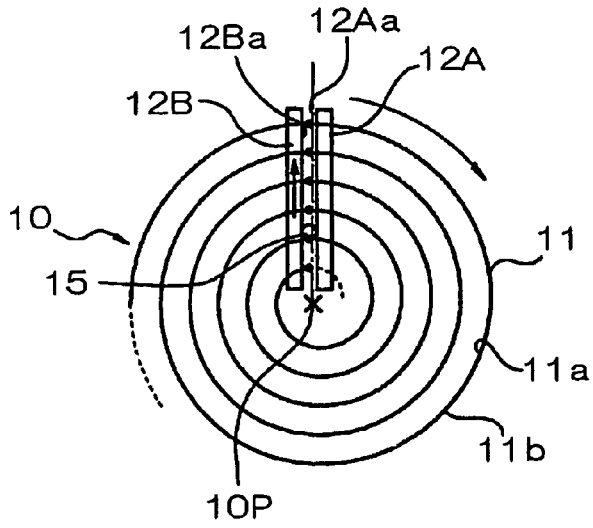
FIG. 9 is a principle diagram showing another state of the dead-weight lifting mechanism.
Figure 10:
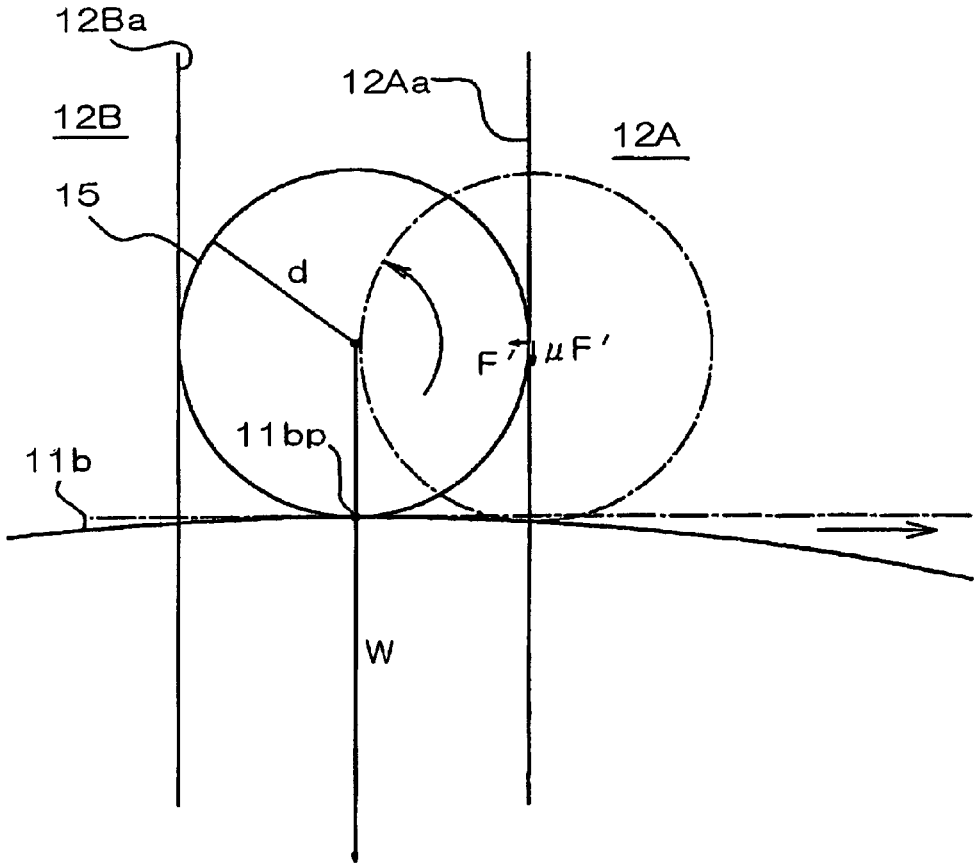
FIG. 10 is an enlarged explanatory view of the drive part of the dead-weight body in the dead-weight lifting mechanism, which is located in a different position.
Figure 11:
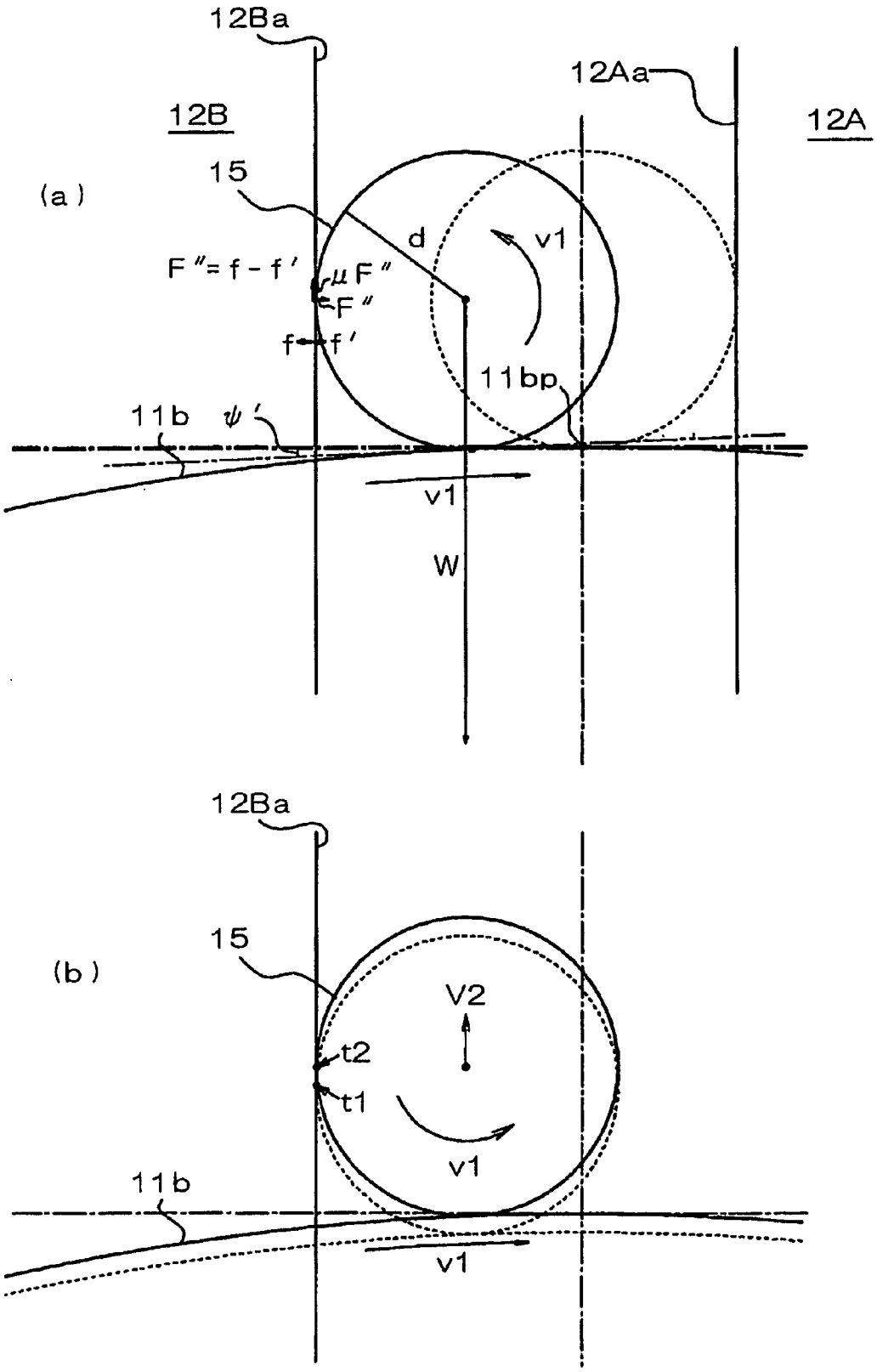
FIGS. 11A and 11B are enlarged explanatory views of drive parts of driven bodies in the dead-weight lifting mechanism, which are located in further different positions.

Next, in FIG. 9, a dead-weight lifting mechanism using a drive body 10 and a dead-weight body 15 which are similar to those in FIG. 7 is shown. However, FIG. 9 shows another example in which a position in which the dead-weight body 15 is held on a drive surface 11*b* is different from that in FIG. 7. In this example, the dead-weight body 15 is not set on a vertical surface passing an axial center 10P but on a top position 11*bp* of the drive surface 11*b* as shown in FIG. 10. Further, since the dead-weight body 15 does not stabilize on the top position 11*bp* of the drive surface 11*b*, guide members 12A and 12*b* are arranged on the both sides thereby to guide the dead-weight body 15 up and down (in the vertical direction) by guide edges 12Aa and 12Ba of the guide members.

In this case, since the dead-weight body 15 is arranged in the nearly top position 11*bp*, its tangent (tangent surface) is almost horizontal. Therefore, stress F' which the dead-weight body 15 receives from the guide edges 12Aa and 12Ba becomes smaller than the above force F (ideally becomes zero). Thus, since there is little friction loss $M_F$, the total loss is also reduced, so that the drive loss is further reduced.

FIGS. 11A and 11B show the states in the vicinity of the dead-weight body 15 in case that the dead-weight body 15 is arranged, shifting from the top position 11*bp* to the side reverse to the rotational direction of the drive body. In this case, compared with the case shown in FIG. 10, the position of the guide edge 12Ba located on the left side of the dead-weight body 15 shifts to the left side together with the position of the dead-weight body 15. The guide edge 12Aa located on the opposite side to the side of this guide edge 12Ba is located in the same position as the position shown in FIG. 10. When the drive surface 11*b* rotates clockwise at velocity of v1 under this state, the dead-weight body 15 also rolls at a peripheral velocity of v1. However, actually, the drive surface 11*b* and the dead-weight body 15 on the drive surface 11*b*, since the drive surface 11*b* is constructed spirally, move upward at velocity of v2. Here, a relation between v1 and v2, in case that the spiral is the above spiral of Archimedes (described referring to FIG. 7), is $v2/v1=1/\theta$ because $a=v2/\omega$ and $v1=r\cdot\omega$. The larger θ becomes, the smaller v2/v1 becomes. Therefore, assuming that θ=1.5π to 8π, v1>>v2.

Here, a rotation state of the dead-weight body 15 will be investigated. By the clockwise rotation of the drive body 10, the dead-weight body 15 itself rolls counterclockwise. At this time, by the rotation of the drive body 10, the dead-weight body 15 receives force f' by which the dead-weight body 15 is moved a little to the right. Therefore, force F" produced between the dead-weight body 15 and the guide edge 12Ba is a value obtained by subtracting the force f' from $f=W\tan\phi'$ corresponding to the force $F=W\tan\phi$ shown in FIG. 8. In result, in case that φ is not greatly different from φ', the force F" becomes always smaller than the force F. Therefore, friction force μF" due to this force F" becomes also smaller than the friction force μF shown in FIG. 8.

At this time, the direction of the friction force μF" produced between the guide edge 12Ba and the dead-weight body 15, since v1>>v2, is the upper direction in the drawing. Here, based on the guide edge 12Ba because the guide member 12B is fixed, comparison between a point of time t1 and the next point of time t2 will be performed as shown in FIG. 11B. Then, at the point of time t1, the dead-weight body 15 contacts the guide edge 12Ba in the lower position. At the point of time t2, the dead-weight body 15 contacts the guide edge 12Ba in the upper position. Namely, sliding velocity between the fixed guide edge 12Ba and the dead-weight body 15 is v1-v2. Therefore, the friction loss produced by rolling of the dead-weight body 15 is reduced, compared with the friction loss for the guide edge 12Aa shown in FIGS. 8 and 10.

To the contrary, in case that the dead-weight body 15 is held in the lowest position of the drive surface 11*a* and driven, also, the friction loss due to the friction between the guide member and the dead-weight body, which is produced by rolling of the dead-weight body, can be similarly reduced. In this case, since the dead-weight body 15 can be held in the lowest position of the drive surface 11*a* by the attractive force, in case that the rotational speed is constant and slow enough, the guide member is not required. However, it is practically desirable that guide means for holding the both side of the dead-weight body 15 is provided similarly to the case described above.

First Embodiment

Figure 4:
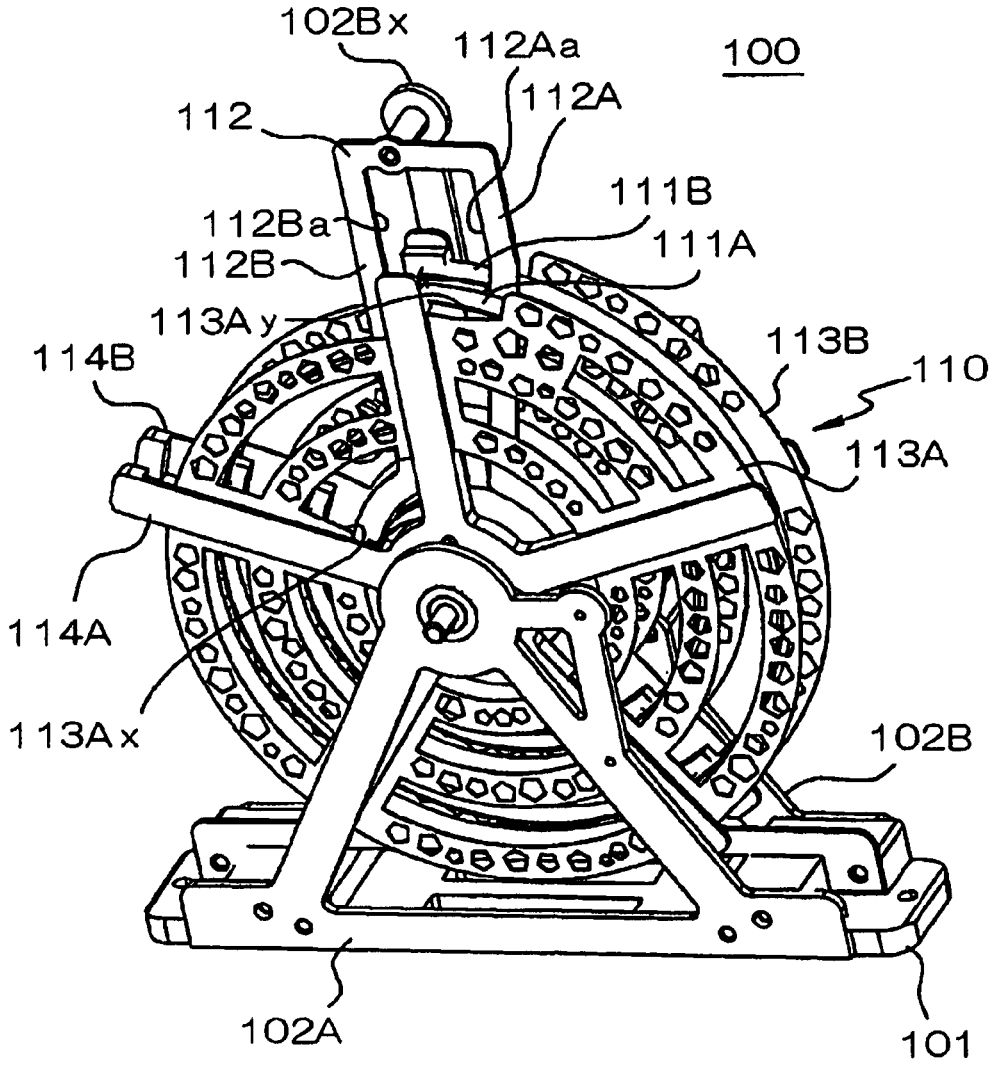
FIG. 4 is a perspective view showing a main portion of a dead-weight lifting mechanism.
Figure 5:
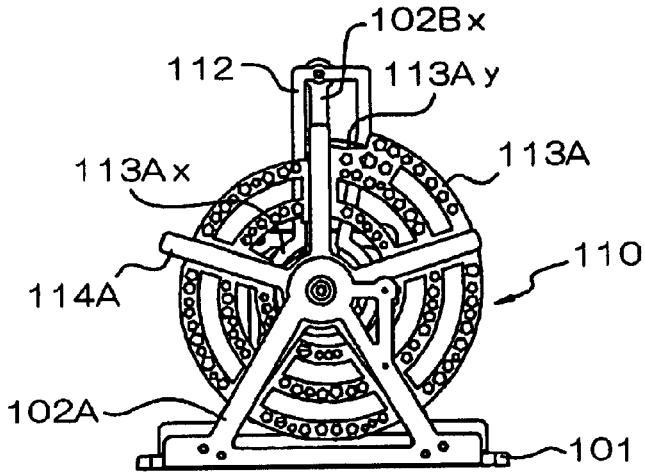
FIGS. 5A, 5B, 5*c* are respectively a front view, a plan view, and a right side view of the main portion of the dead-weight lifting mechanism.
Figure 5:
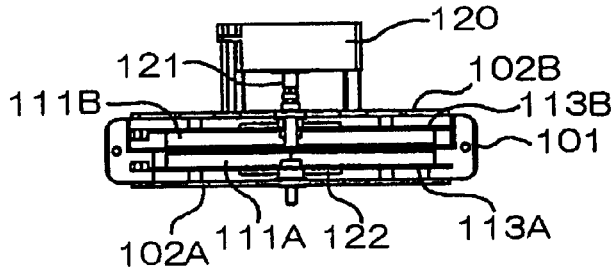
Figure 5:
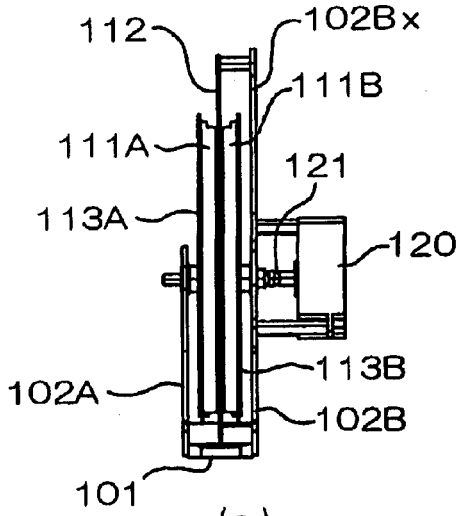
Figure 6:
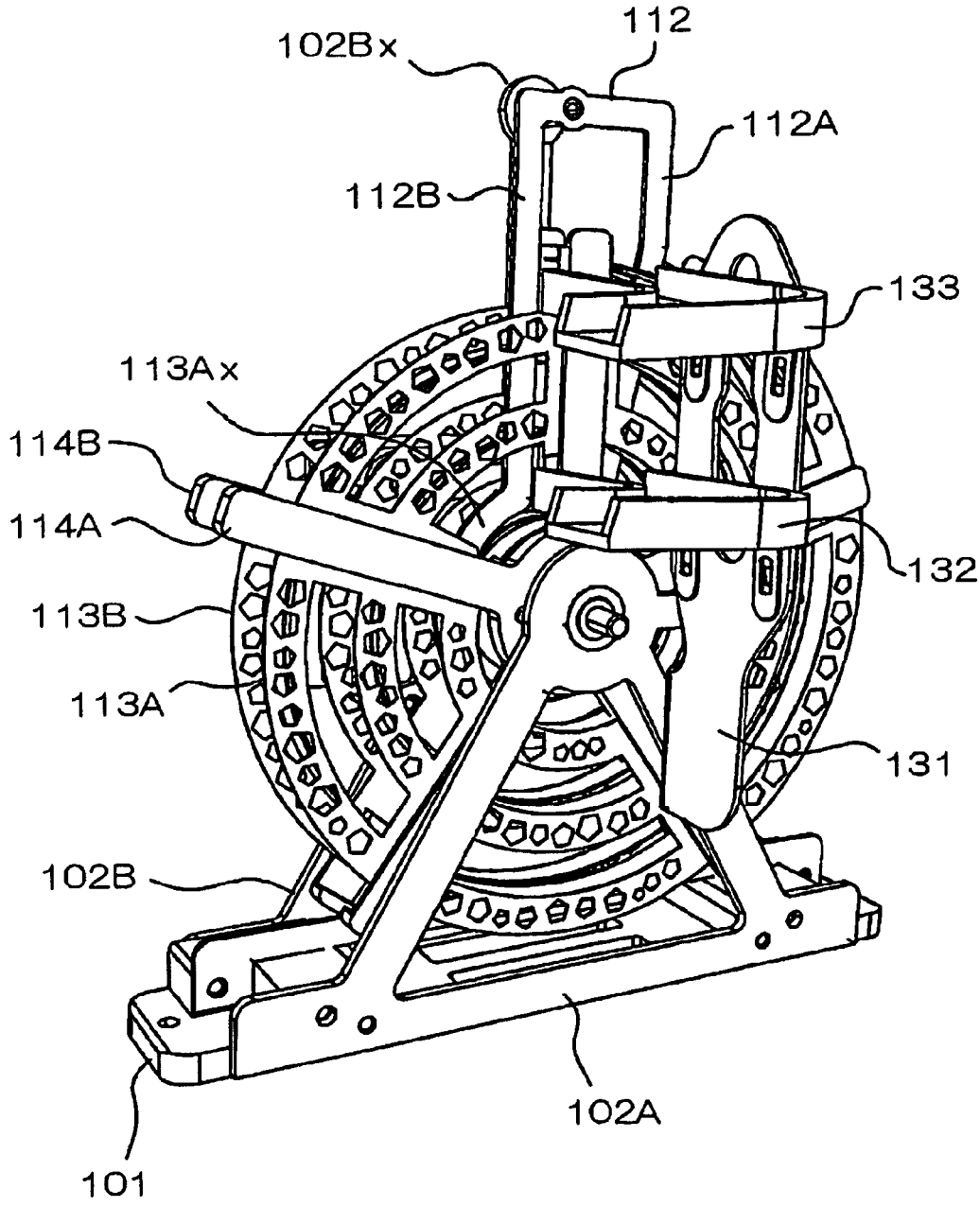
FIG. 6 is a perspective view of the dead-weight lifting mechanism.

Next, based on the above principle, a first embodiment of the dead-weight lifting mechanism 100 in the clock 1000 will be described. FIG. 4 is a perspective view showing a state of the dead-weight lifting mechanism 100 viewed from the oblique upside, FIGS. 5A, 5B, 5*c* are respectively a front view, a plan view, and a right side view of the dead-weight lifting mechanism 100, and FIG. 6 is a perspective view of the dead-weight lifting mechanism 100, in which an entrance part and an exit part of the dead-weight body are set. This dead-weight lifting mechanism 100 has a drive body 110 in which a spiral drive surface which spirals from the inside to the outside counterclockwise is formed. In the dead-weight lifting mechanism 100, when a spherical dead-weight body (not shown) is supplied on the drive surface of the drive surface 11 at a lower position which is slightly above an axial center of the drive body 110, the dead-weight body gradually rises with rotation (clockwise rotation in the shown example) of the drive body 110. When the dead-weight body reaches an upper position, it is taken out.

In this drive body 110, a pair of strip materials 111A and 11B, of which a side view from an axial direction is spiral-shaped, are arranged in a row before and behind in the drawing (namely, in the axial direction of the drive body 110). Extension parts of inner surfaces and outer surfaces of the spiral strip materials 111A and 111B are respectively spiral-shaped, and the inner surface and the outer surface constitute the above drive surfaces. Plate-shaped holding frames 113A and 113B are arranged on front and rear both sides of the spiral strip material pair 111A, 111B. The holding frames 113A and 113B are provided in order to hold the dead-weight body arranged on the spiral drive surface of the spiral strip material pair 111A, 111B so that the dead-weight body does not fall from the drive surface. In the holding frame 113A arranged on the front side, an entrance 113Ax which opens forward in the vicinity of the axial center (on the center side) of the drive body 110 is formed. Further, at the peripheral portion of the drive body 110, an exit 113Ay opening forward is formed. The spiral strip material pair 111A, 111B, and the holding frames 113A and 113B are constituted integrally by supporting members 113A and 114B, and fixed to a hub described later.

Behind the drive body 110, as shown in FIGS. 5B and 5C, a drive source 120 is arranged, and a drive shaft 121 of this drive source 120 is connected to a hub 122. Though appropriate rotation driving means such as a drive motor can be used as the drive source 120, the drive source 120 is composed of a clock driving mechanism (a movement) in this embodiment. The hub 122 is fixed to a center portion of the drive body 110, and rotates by drive force of the drive source 120 together with the drive body 110.

On the other, in front and rear positions of a base 101, support frames 102A and 102B are respectively fixed. These support frames 102A and 102B support the drive body 100 rotatably through the hub 122. For the rear support frame 102B, a support extension part 102Bx extended upward is provided, and this support extension part 102Bx supports and fixes the upper portion of a guide member 112. This guide member 112 is interposed between a pair of the spiral strip materials 111A and 111B, and arranged so as to extend up and down. The lower portion of the guide member 112 is fixed onto the base 101.

In FIG. 4 or 6, the guide member 112 is fixed, and always arranged in a fixed position (in the shown example, a position throughout upper and lower sides of the axial center of the drive body 110) even when the drive body 110 rotates. The guide member 112 has a pair of guide parts 112A and 112B extending up and down. A pair of the guide parts 112A and 112B are respectively arranged so as to extend up and down above the axial center of the drive body 110. The guide parts 112A and 112B have respectively guide edges 122Aa and 112Ba, which are arranged opposed to each other and formed so as to extend up and down above the axial center. More particularly, one guide part 112A formed on the side of the rotational direction of the drive body 110 (on the clockwise side) extends upward in a slightly inclined posture to the rotational direction side above the axial center. Further, the other guide part 112B formed on the side reverse to the rotational direction side of the drive body 110 extends upward nearly vertically on the side little reverse to the rotational direction side above the axial center.

As shown in FIG. 6, for this dead-weight lifting mechanism 100, an entrance guide 132 and an exit guide 133 are provided. The entrance guide 132, when the entrance 113Ax provided for the holding frame 113A comes right over the axial center of the drive body 110, introduces a not-shown dead-weight body through the entrance 113Ax onto the outer surfaces of the spiral strip materials 111A and 111B. The exit guide 133, when the exit 113Ay provided for the holding frame 113A and shown in FIG. 4 comes right over the axial center of the drive body 110, exhausts the not-shown dead-weight body which has risen while being guided by the guide member 112 with the rotation of the drive body 110 through the exit 113Ay. These entrance guide 132 and exit guide 133 are supported and fixed by a supporter 131 in front of the drive body 110. The entrance guide 132 and the exit guide 133 are, as shown in the drawing, formed in the shape of a gutter through which the dead-weight body can be introduced or exhausted while being rolled.

In this embodiment, the dead-weight body supplied from the entrance guide 132, when the entrance 113Ax appears at an exit of the entrance guide 132 with the rotation of the drive body 110, is introduced into the inside of the holding frame 113A through this entrance 113Ax, and arranged on the surfaces of the spiral strip materials 111A and 111B. At this time, the introduced dead-weight body is arranged between the guide edges 112Aa and 112Ba of the guide member 112 opposed to each other, and the position in the rotational direction of the dead-weight body is regulated by these guide edges 112Aa and 112Ba. Thereafter, with the rotation of the drive body 110, the dead-weight body is gradually lifted upward. When the exit 113Ay appears shortly in the position where the dead-weight body is arranged, the dead-weight body is exhausted through this exit 113Ay to the exit guide 133. Actually, the plural dead-weight bodies supplied from the entrance guide 132 are sequentially lifted respectively by the above procedure, and exhausted sequentially from the exit guide 133.

In the thus constructed embodiment, the dead-weight body is introduced from only the entrance 113Ax provided in the predetermined position of the drive body 110, and exhausted from only the exit 113Ay provided in another predetermined position of the drive body 110. A single entrance 113Ax and a single exit 113Ay may be provided, or plural entrances 113Ax and plural exits 113Ay may be provided. In any case, since the dead-weight body is always introduced from the fixed position and exhausted from another fixed position, a moving range (moving distance) of the dead-weight body is always constant.

Figure 12:
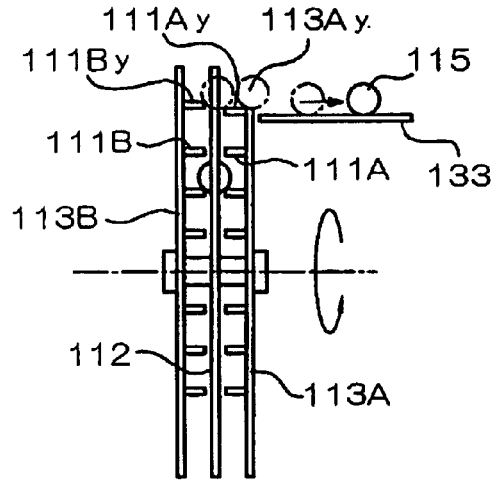
FIG. 12 is an explanatory view of a dead-weight exit portion of the dead-weight lifting mechanism.

Next, referring to FIG. 12, structure of the exit in the embodiment will be described in detail. Since the spiral strip materials 111A and 111B are basically arranged in a row with the guide member 112 there between, the surface of the spiral strip material 111A and the surface of the spiral strip material 111B are, in the same angular position, basically at the same level. However, in the exit 113Ay, an exhausting part 111Ay of the spiral strip material 111A existing on the side where the exit 113Ay is provided is low at the level, and an exhausting part 111By of the spiral strip material 111B existing on the opposite side to the side where the exit 113Ay is provided is high at the level. Hereby, when the exit 113Ay reaches in the forward position of the dead-weight body 115 of which the angular position is held by the guide member, the dead-weight body 115 moves from the exhausting part 111By of the spiral strip material 111B to the exhausting part 111Ay of the spiral strip material 111A, and can be naturally exhausted from the exit 113Ay onto the exit guide 133 according to gravity. In such the construction, it is preferable that a different in height is gradually provided for the spiral strip materials 111A and 111B as their angular positions approach the exit 113Ay. Hereby, the dead-weight body 115, as the exit 113Ay approaches the dead-weight body 115, moves gradually to the exit 113Ay side, and is immediately exhausted when the exit 113Ay appears.

Figure 13:
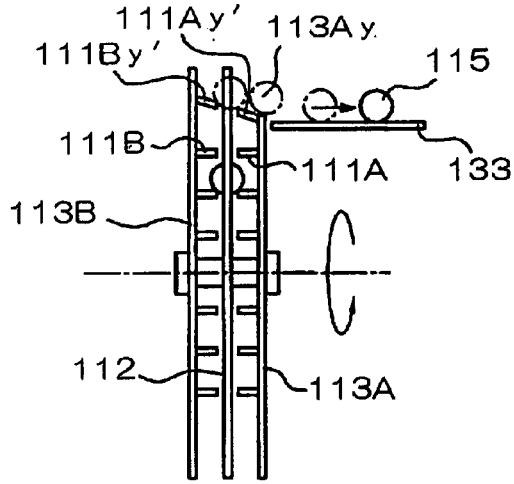
FIG. 13 is an explanatory view of a different dead-weight exit portion of the dead-weight lifting mechanism.

FIG. 13 shows another construction of the portion near the exit 113Ay. In this constructive example, in the position where the exit 113Ay is provided, inclined parts 111Ay' and 111By' which are inclined to the exit 113Ay side are formed at the spiral strip materials 111A and 111B. Further, an end of the inclined part 111Ay' on the opposite side to the exit 113Ay side is at the same level as an end of the inclined part 111By' on the exit 113Ay side, or lower. By such the construction, the dead-weight body 115 can be guided to the exit 113Ay by the inclined parts 111Ay' and 111By'. Therefore, the dead-weight body 115 can be exhausted smoothly and surely. In this case, it is preferable that the spiral strip materials 111A and 111B are constructed so that the inclined angle becomes larger as their angular positions approach the exit 113Ay. Hereby, the dead-weight body 115 can be exhausted from the exit 113Ay more smoothly.

Figure 14:
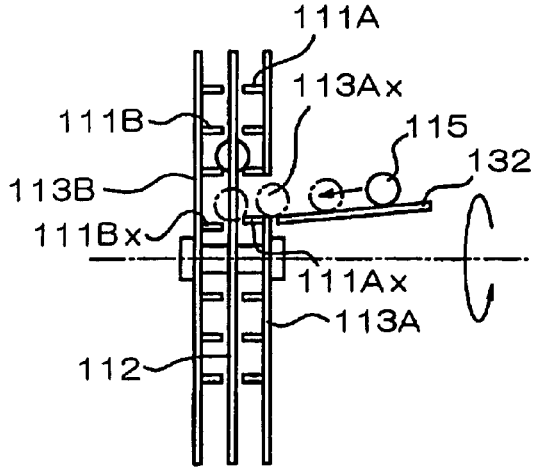
FIG. 14 is an explanatory view of a dead-weight entrance portion of the dead-weight lifting mechanism.

FIG. 14 shows structure near the entrance 113Ax of the drive body 100. In the spiral strip materials 111A and 111B, regarding their angular positions of the entrance 113Ax, an introducing part 111Ax existing on the entrance 113Ax side is formed higher than an introducing part 111Bx on the opposite side. Hereby, the drive body 110 can be constructed so that: when the dead-weight body 115 introduced from the entrance guide 132 is arranged on the introducing part 111Ax, 111Bx, it is prevented that the dead-weight body 115 bounds out of the entrance 113Ax due to excessive force. In this case, it is preferable that the spiral strip materials 111A and 111B are constructed so that their difference in height is gradually reduced as their angular positions go away from the entrance 113Ax. Hereby, the dead-weight body 115 can be driven smoothly. Further, contrarily to the example in FIG. 13, the introducing parts 111Ax and 111Bx may be downward inclined to the opposite side to the entrance 113Ax side. In this case, it is desirable that an end of the introducing part 111Ax on the opposite side to the entrance 113Ax side is at the same level as an end of the introducing part 111Bx on the entrance 113Ax side, or higher. Hereby, the dead-weight body 115 can be introduced more smoothly.

Second Embodiment

Figure 35:
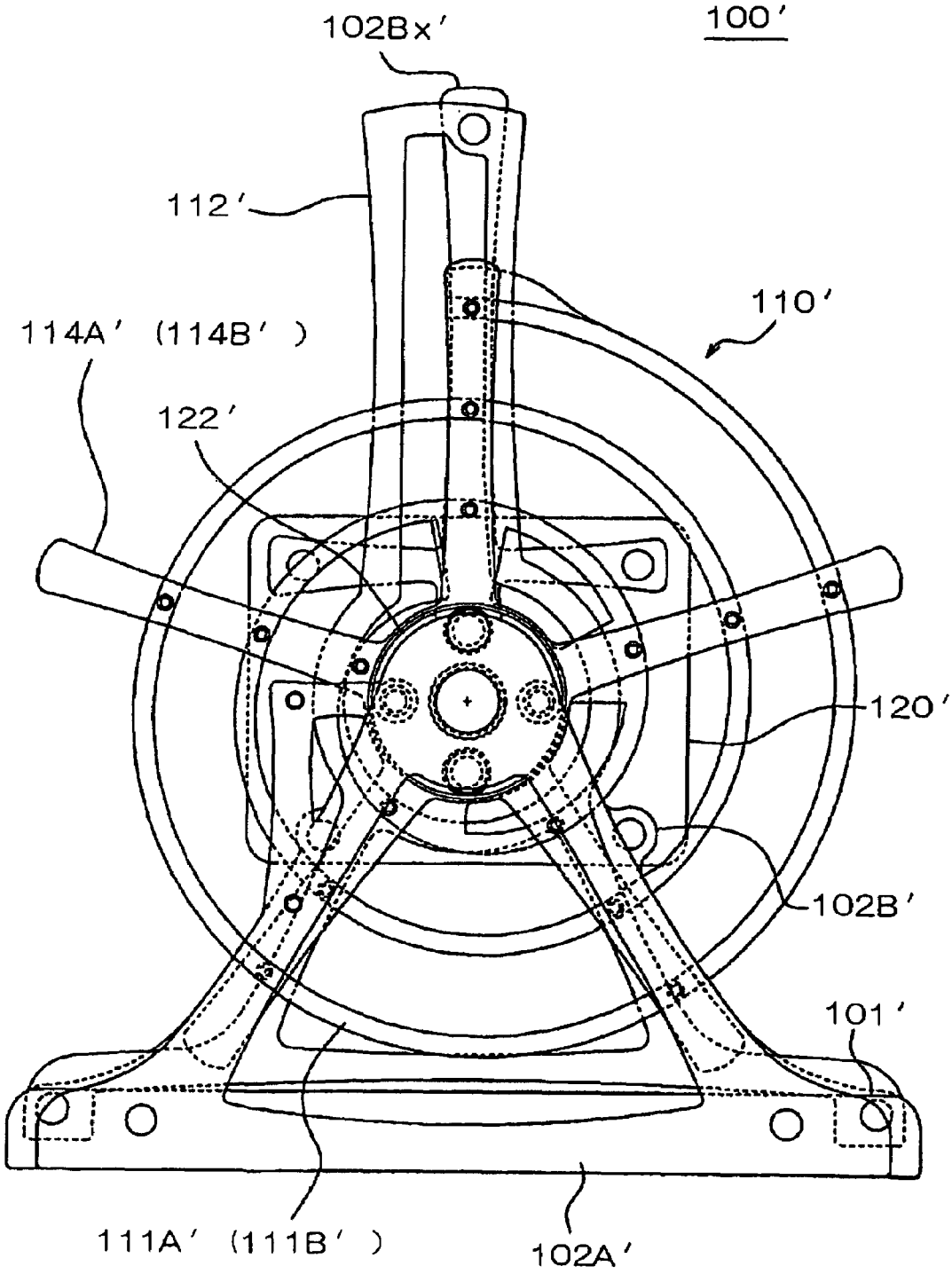
FIG. 35 is a schematically front view showing a drive mechanism in a second embodiment, in which a holding frame is omitted.
Figure 36:
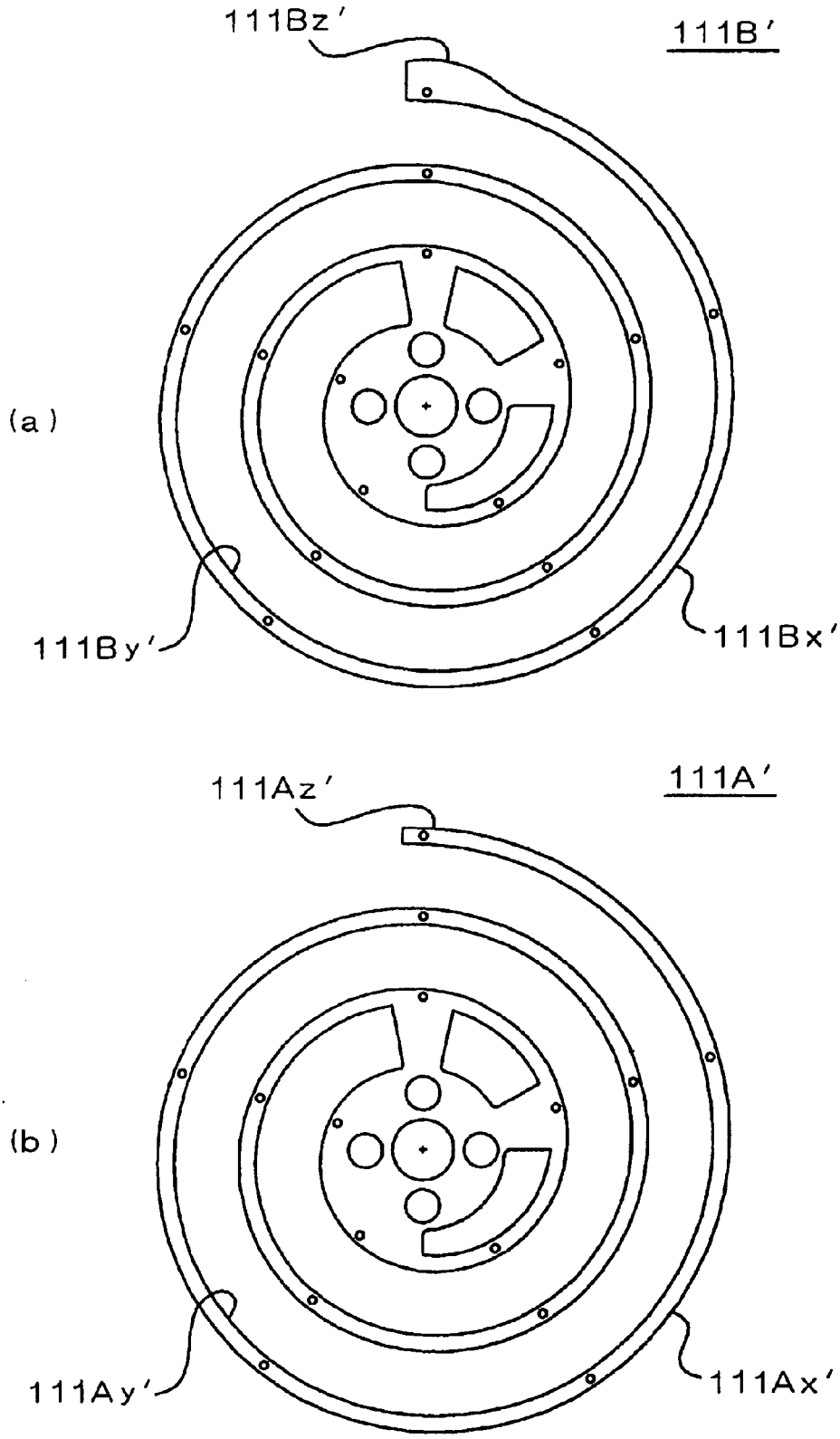
FIGS. 36A and 36B are diagram showing plane shapes of a pair of plate-shaped materials which constitute a drive body of the drive mechanism in the second embodiment.
Figure 37:
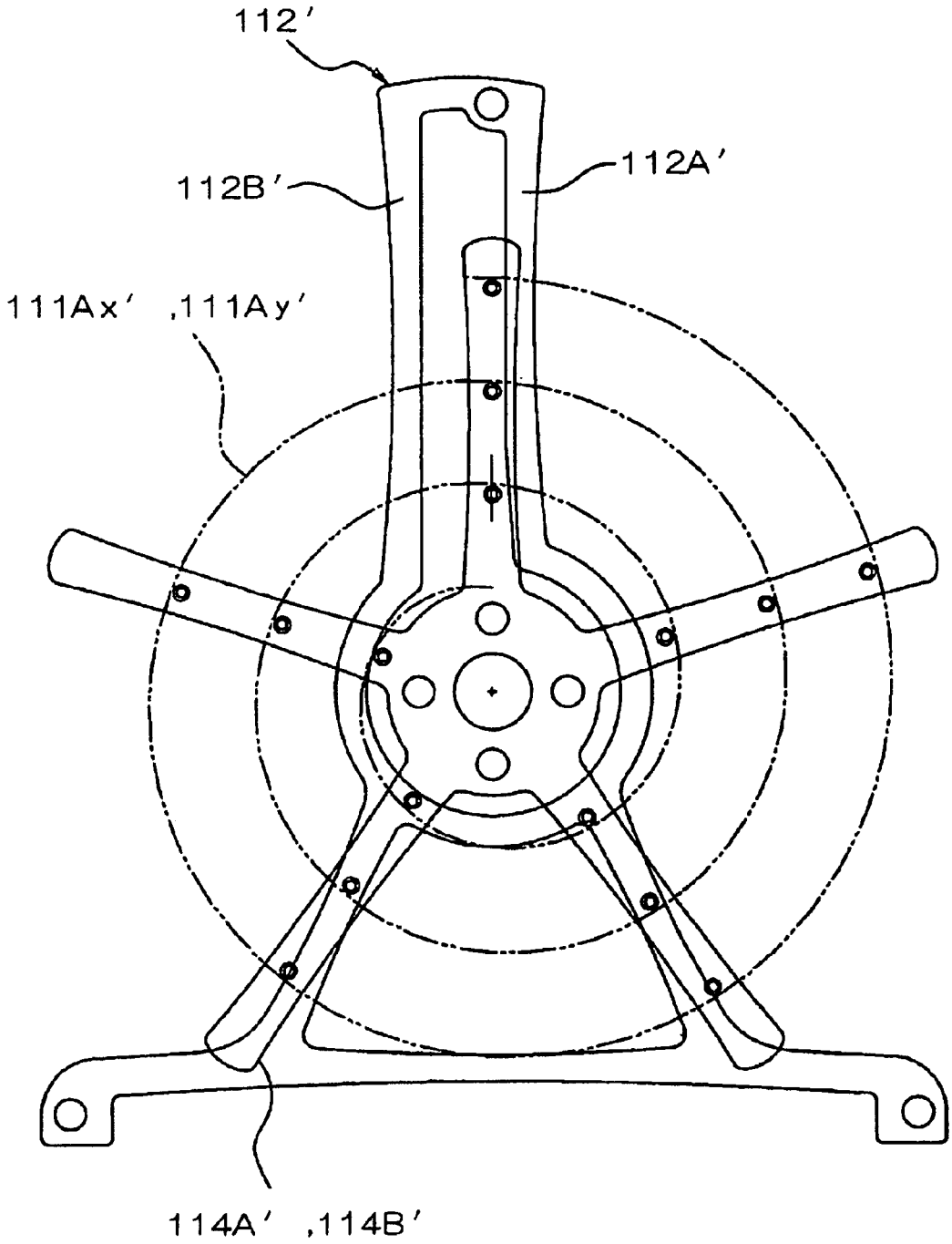
FIG. 37 is a diagram showing a guide member and a support member of the drive mechanism in the second embodiment together with the drive surface shape thereof in an overlapped state.
Figure 38:
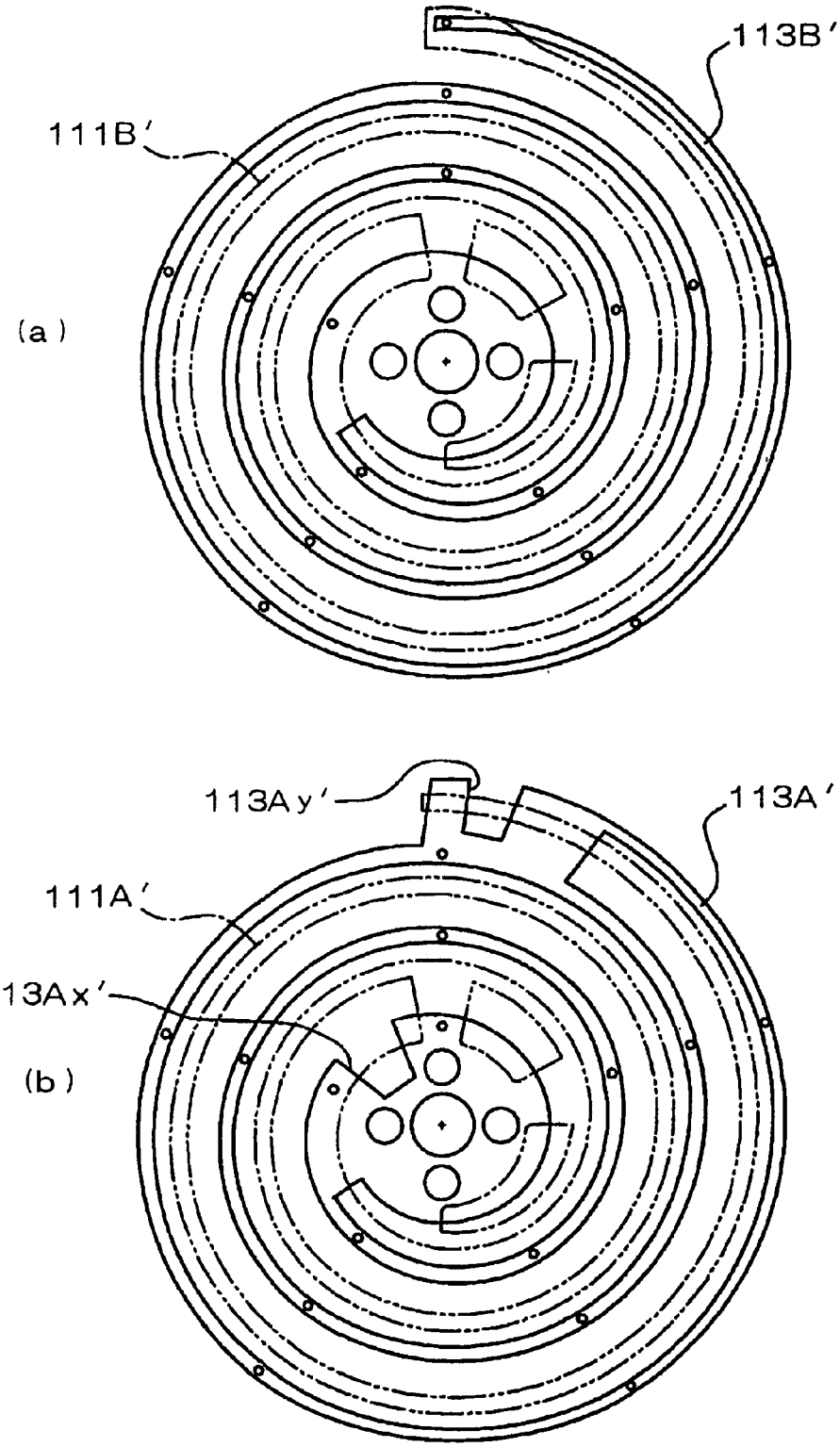
FIGS. 38A and 38B are diagrams showing holding frames of the drive mechanism in the second embodiment together with the outline of the plate-shaped material.
Figure 39:
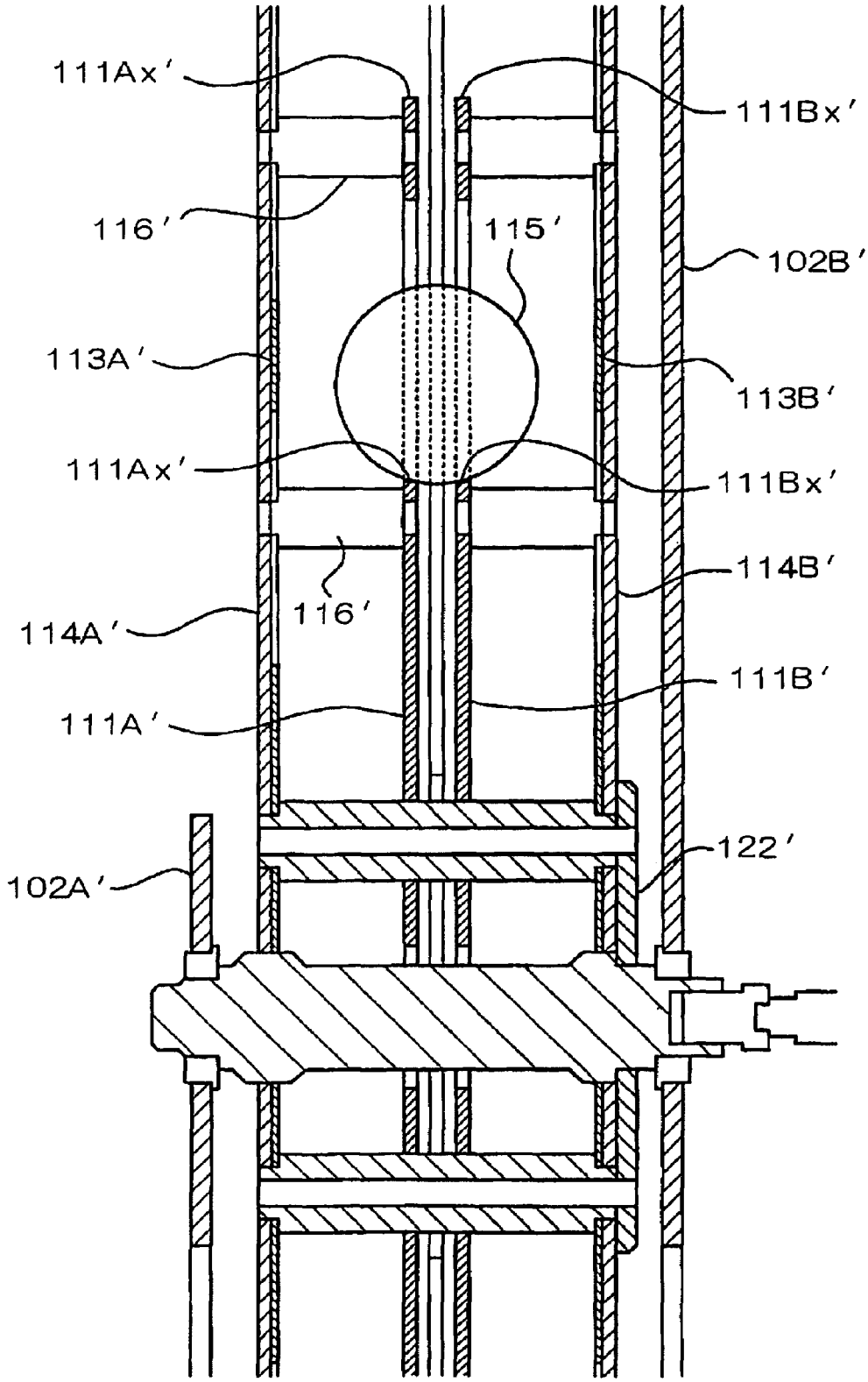
FIG. 39 is a longitudinal sectional view in the vicinity of a center portion of the drive mechanism in the second embodiment.

Next, with reference to FIGS. 35 to 39, a second embodiment will be described. FIG. 35 is a schematically front view showing a dead-weight lifting mechanism 100' in a second embodiment, in which a holding frame is omitted. FIGS. 36A and 36B are diagrams showing the plan shapes of a pair of plate-shaped materials which constitute a drive body of the dead-weight lifting mechanism 100'. FIG. 37 is a diagram showing a guide member and a support member of the dead-weight lifting mechanism 100' together with the drive surface shape in an overlapped state. FIGS. 38A and 38B are diagrams showing holding frames of the dead-weight lifting mechanism 100' together with the outline of the plate-shaped material. FIG. 39 is a longitudinal sectional view in the vicinity of a center portion of the dead-weight lifting mechanism 100'.

The dead-weight lifting mechanism 100' in this embodiment, as shown in FIG. 35, comprises a base 101', a support frame 102A', a support frame 102B having a support extension part 102Bx', a guide member 112' having guide parts 112A' and 112B', support members 114A' and 114B', a hub 122', and a drive source 120'. Since these parts are constructed similarly to those in the first embodiment, their description is omitted.

In this embodiment, as a drive member constituting a drive body 110', in place of the above spiral strip material, a plate-shaped material 111A', 111B' is used, in which a plane view in an axial direction is spiral-shaped. Here, the plate-shaped material 111A', 111B' is a member in which the width on a plane orthogonal to the axial direction of the drive body 110' is larger than the thickness in the axial direction. This plate-shaped material 111A', 111B', as shown in FIGS. 36A and 36B, has a spiral plane shape. End edges of its plane shape become drive surfaces 111Ax', 111Ay', 111Bx', and 111By'. In this embodiment, an example in which the end edge (outer end edge) 111Ax', 111Bx' on a peripheral side of the plate-shaped material is used as the drive surface will be described below. However, as the drive surface, the end edge (inner end edge) 111Ay', 111By' on an inner circumferential side of the plate-shaped material may be used.

In the embodiment, on both sides in an axial direction of the guide member 112', a pair of plate-shaped materials 111A' and 111B'are arranged. These plate-shaped materials 111A' and 111B' are supported and fixed through a coupling pin 116' to the support members 114A' and 114B'. Further, holding frames 113A' and 113B' shown in FIG. 38 are arranged on both side in axial direction of the plate-shaped material 111A', 111B' and supported and fixed by the support members 114A' and 114B'. The plate-shaped materials 111A' and 111B', the holding frames 113A' and 113B', and the support members 114A' and 114B' constitute the drive body 110' connected and fixed to the hub 122', and rotate integrally by the drive source 120'. Here, a rotational axis of the drive body 110' is set horizontal.

As shown in FIG. 39, a moved body 115' is supported so as to get over the drive surface 111Ax' of the plate-shaped material 111A' and the drive surface 111Bx' of the plate-shaped material 111B', and moves in a radius direction of the drive body 110' in a state where the moved body 115' is guided by a guide edge of the guide member 112'. At this time, the holding frames 113A' and 113B' are constructed so as to hold the moved body 115' from the both sides in the axial direction. Actually, in case that the base 101' is arranged statically, since the moved body 115' is supported by a pair of the drive surfaces 111Ax' and 111Bx', the moved body 115' does not come into contact with the holding frames 113A' and 113B' while moving in the radius direction of the drive body 110'. However, when the moved body 115' is introduced into the drive body 110' or receives external vibration as described later, there is a case where the moved body 115' shakes. In this case, the holding frames 113A' and 113B' prevent the moved 115' body from going out of the drive surfaces.

An outer end part 111Bz' of the drive surface 111Bx' of the plate-shaped material 111B' shown in FIG. 36A is arranged in the radius direction at outer side than an outer end part 111Az' of the drive surface 111Ax' of the plate-shaped material 111A' shown in FIG. 36B. Therefore, when the outer end parts 111Az' and 111Bz' of the drive surfaces come right over the hub 122', a difference in height is produced between the outer end parts 111Az' and 111Bz'. Further, in the holding frame 113A' shown in FIG. 38B, an entrance 113Ax' is provided at the inner circumferential part of the drive body 110', and an exit 113Ay' is provided at the outer circumferential part of the drive body 110'. The exit 113Ay' of the holding frame 113A' is formed so as to open spaces on the outer end parts 111Az' and 111Bz' to the front in the axial direction.

Hereby, when the moved body 115' is introduced into the drive body 110' from the entrance 113Ax', the moved body 115' is, while remaining arranged on the drive surface, gradually lifted in the vertical direction by the rotation of the drive body 110'. Shortly, when the moved body 115' is arranged on the drive surface of the outermost circumferential part, and the outer end parts 111Az' and 111Bz' of the drive surfaces come right over the hub 122', the moved body 115' is arranged on the outer end parts 111Az' and 111Bz'. Then, the moved body 115' tumbles down forward in the axial direction due to the above difference in height, and is exhausted through the exit 113Ay'.

In the embodiment, the drive body 110' is provided with the plate-shaped material 111A', 111B' which has the drive surface at its end edge and is spiral-shaped, viewed from a plane. Therefore, the spiral drive surface can be formed easily, freely, and with high accuracy. Namely, the plane shape of the plate-shaped material is simply formed so that its end edge is spiral-shaped. Hereby, the spiral plate-shaped material can be readily manufactured by various manufacturing methods such as press-blanking, etching, and injection-molding. Further, since the spiral shape of the drive surface is constituted by the end edge shape, the spiral shape can be freely designed by only setting the plane shape appropriately. Particularly, like the outer end parts 111Az' and 111Bz' of the plate-shaped material pair 111A', 111B', the shape which is partially different from the shape of other portions can be readily formed. Further, since the end edge shape of the plate-shaped material can be formed with high accuracy by the above manufacturing method, the drive surface of high accuracy can be formed. Further, since the plate-shaped material is formed in the shape of the plane-viewed spiral so that its end edge becomes the drive surface, it is easy to make the thickness in the radius direction of the drive surface larger than the width in the axial direction thereof. Hereby, since rigidity against deformation of the drive surface can be increased, the drive surface can endure the even large drive load, and it is also possible to prevent the drive surface from deforming with the passage of time, so that durability of the drive surface can be improved.

Figure 40:
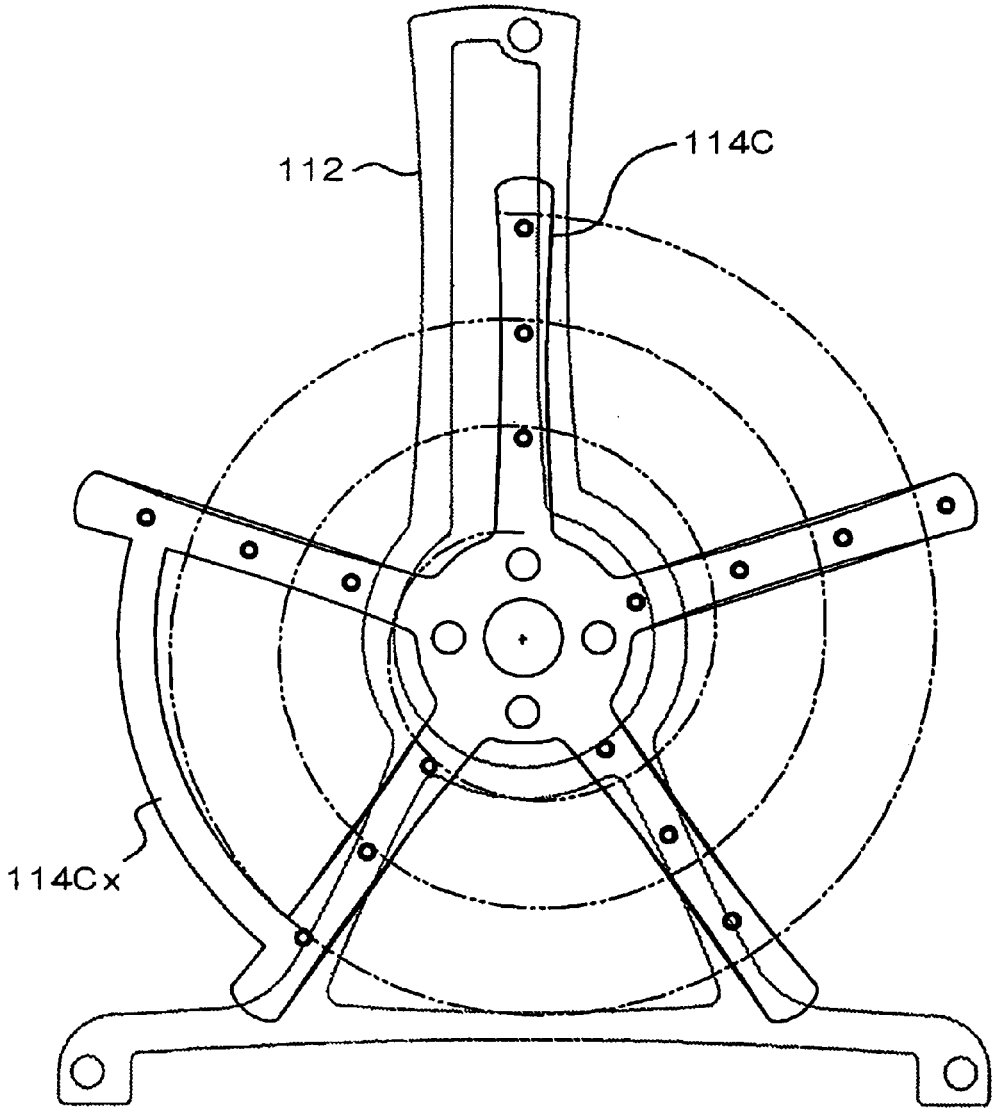
FIG. 40 is a diagram showing a modified example of the support member in the second embodiment, in which the support member and the guide member are overlapped to each other.

In the embodiment, since the plate-shaped material pair 111A', 111B' has the spiral plane shape, weight balance around the rotation axis of the drive body 110' is easy to be one-sided. In case that the weight balance around the rotation axis of the drive body 110' is one-sided, drive load on the drive source 120' becomes large. Further, in case that the drive torque is small, uneven rotation of the drive body 110' is easy to be produced. Therefore, it is preferable that the weight balance around the rotation axis of the drive body 110' is uniformized. FIG. 40 shows the shape of a support member 114C provided with a weight compensation part 114Cx, which can be used in place of the support member in the first embodiment or the second embodiment in order to uniformize the weight balance around the rotation axis of the drive body 110'. This support member 114C, similarly to that in the first embodiment or the second embodiment, has plural support arms extending radially from the hub, and is constructed so that the weight compensation part 114Cx couples the peripheral portion between a pair of support arms adjacent to each other, of the plural support arms. In the shown example, the weight compensation part 114C is formed in the shape of a circular arc with the rotation axis of the drive body 110' as a center. It is preferable in reduction of the one-sided weight balance that the weight compensation part 114C is arranged in an angular position distant from the outer end part of the member (strip material or plate-shaped material) constituting the spiral drive surface. Further, the weight compensation part 114C may be provided not only to the support member, but also to the holding frame, the strip material or the plate-shaped material directly.

[Clocking mechanism]

First Embodiment

Figure 15:
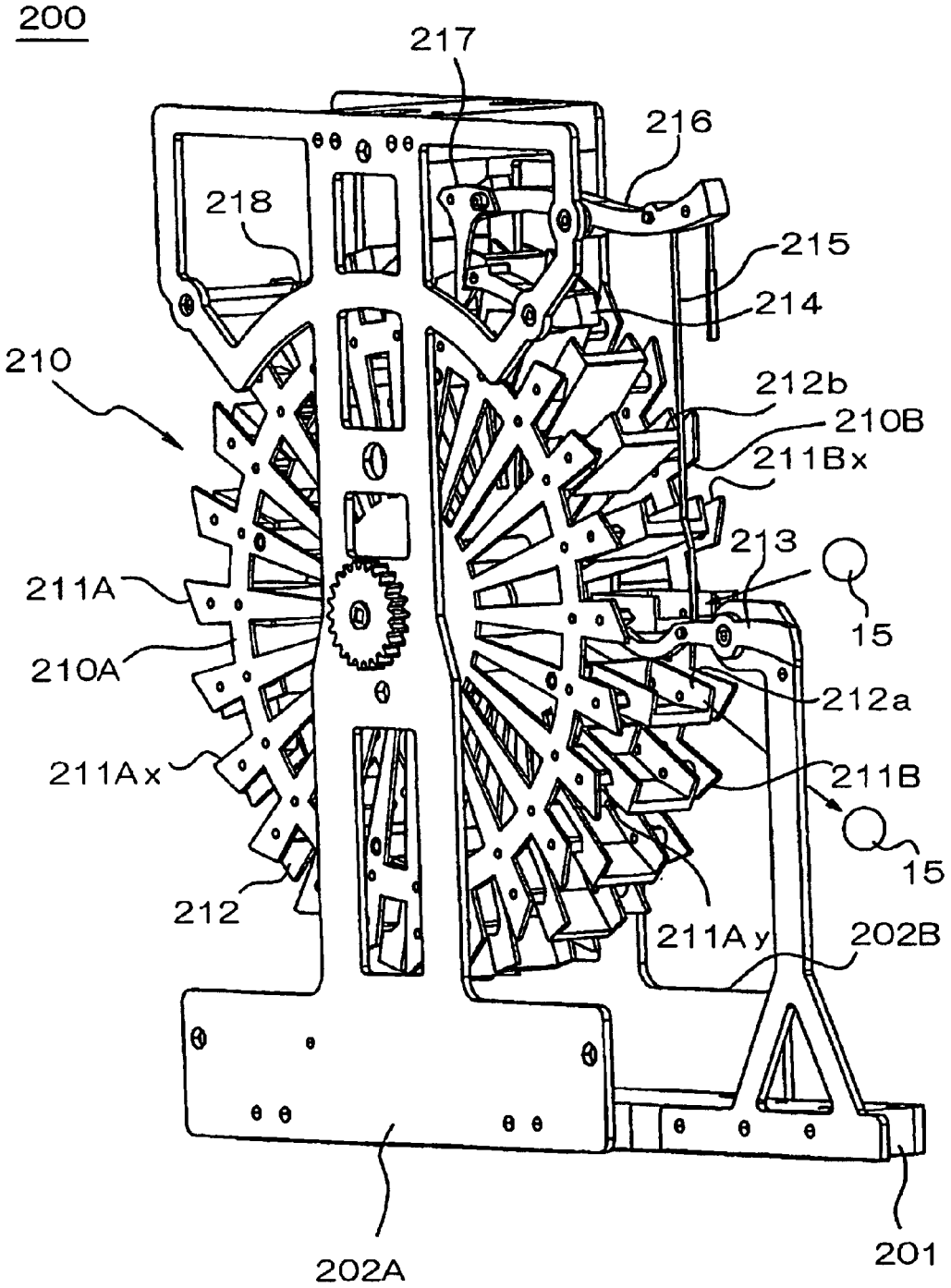
FIG. 15 is a perspective view of a clocking mechanism.
Figure 16:
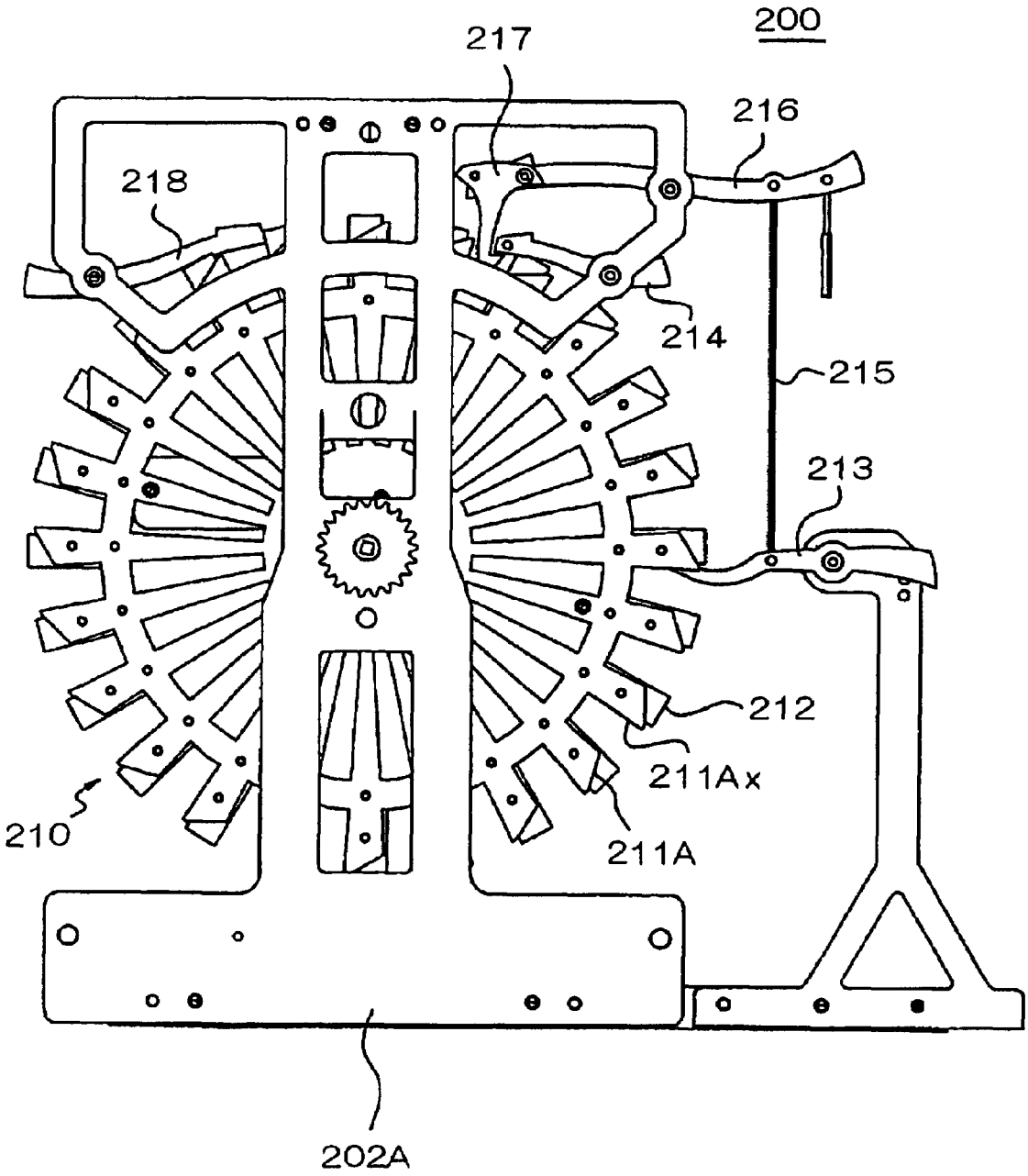
FIG. 16 is a front view of the clocking mechanism in a basic stop state.
Figure 17:
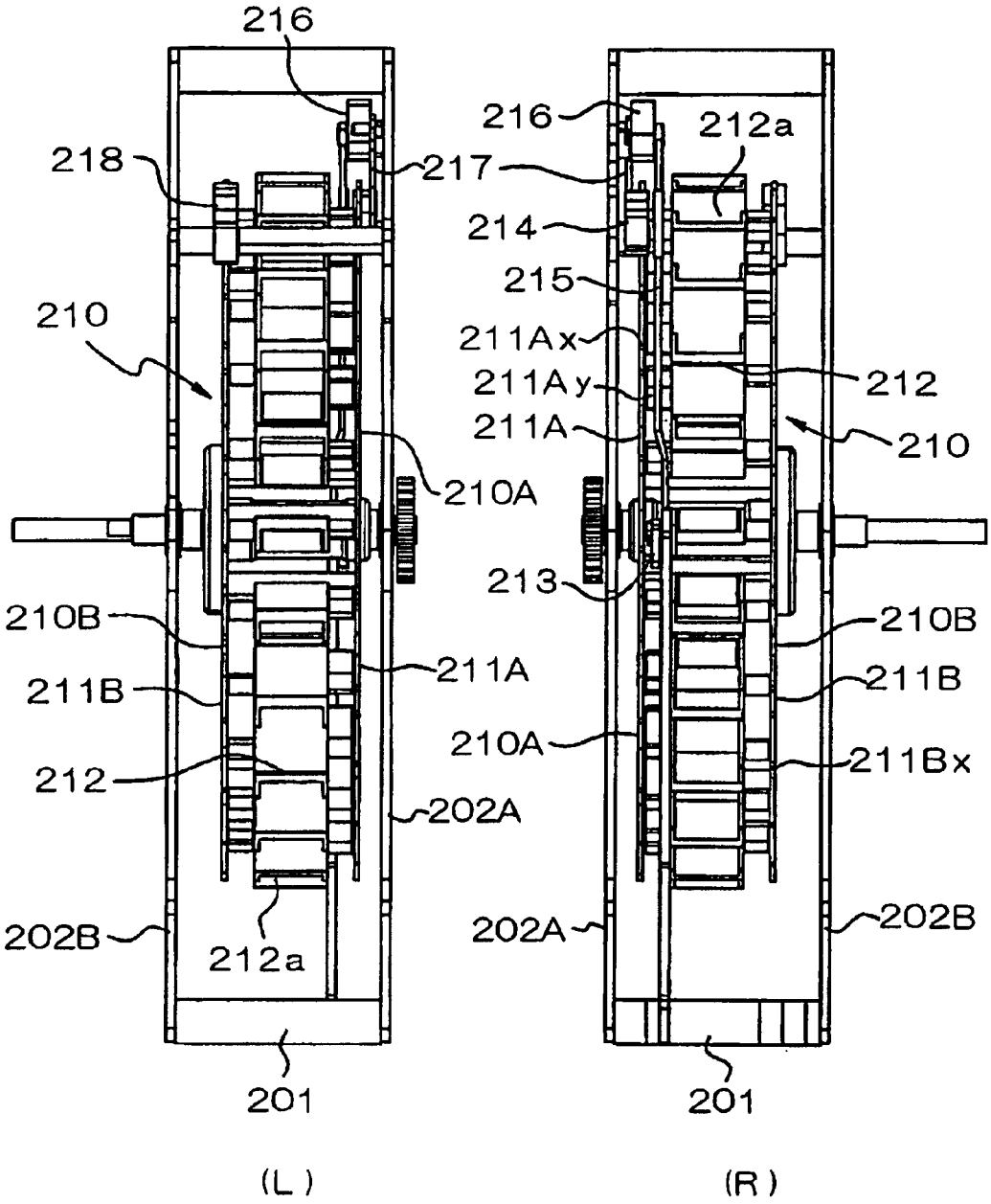
FIGS. 17R and 17L are respectively a right side view and a left side view of the clocking mechanism in the basic stop state.
Figure 18:
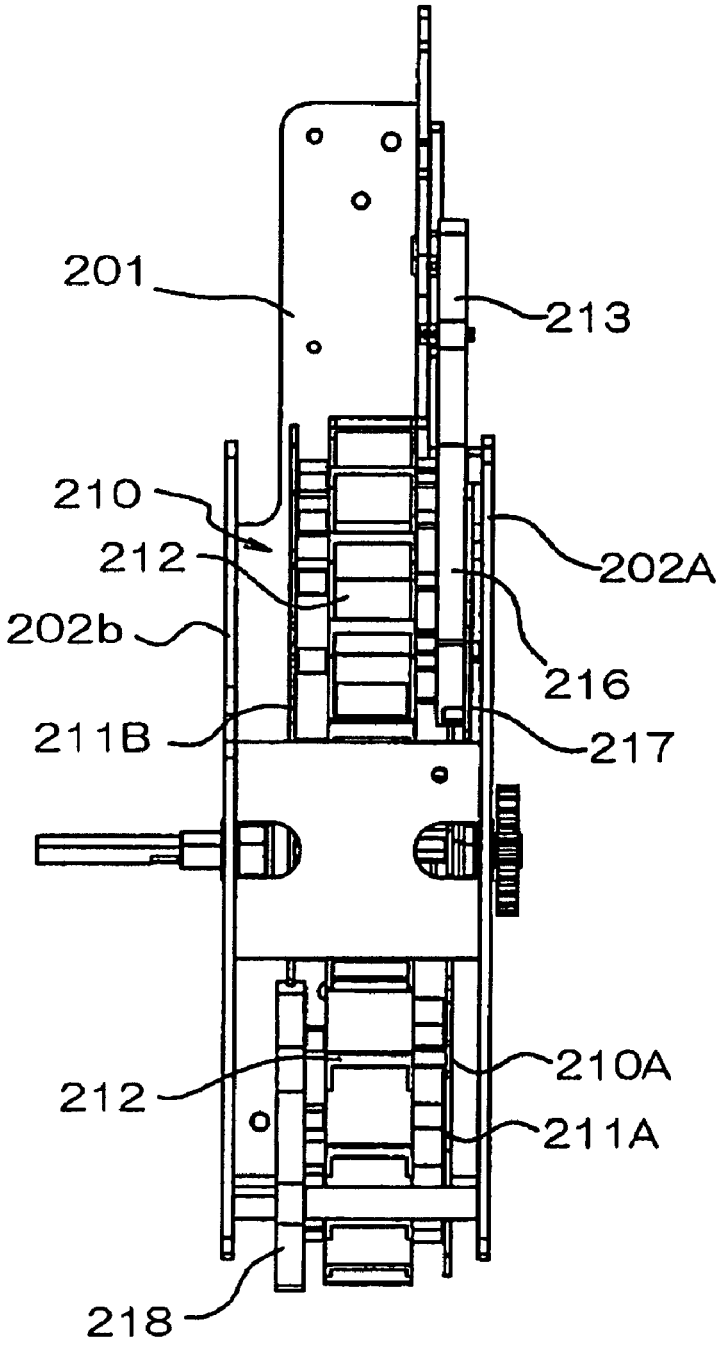
FIG. 18 is a plan view of the clocking mechanism in the basic stop state.

Next, with reference to attached drawings, structure of the clocking mechanism 200 constituting a second motion converting mechanism and a time display part in this embodiment will be described in detail. FIG. 15 is a perspective view of a main portion of the clocking mechanism 200 in the embodiment, FIG. 16 is a front view of the main portion in FIG. 15, FIGS. 17R and 17L are respectively a right side view and a left side view of the main portion in FIG. 15, and FIG. 18 is a plan view of the main portion in FIG. 15.

In this clocking mechanism 200, a rotation wheel 210 constituting the second motion converting mechanism is rotatably supported. This rotation wheel 210 is formed in the shape of a disk as a whole, and supported by support members 202A and 202B rotatably. Both the support members 202A and 202B are attached and fixed to a base 201. A rotation shaft of the rotation wheel 210 is set in a horizontal direction.

In the rotation wheel 210, plural buckets 212 are attached to a pair of support plates 210A and 210B arranged on both sides in an axial direction of the rotation wheel 210, and these buckets 212 are arranged along the periphery of the rotation wheel 210. At the peripheral portions of the support plates 210A and 210B, fitting parts 211A and 211B are respectively formed in equal division positions in a rotation direction (that is, periodically in the rotational direction). Here, the fitting part 211A is arranged in front in the drawing, and the fitting part 211B is arranged in back in the drawing. The fitting part 211A has a first fitting part 211Ax arranged at the forefront, and a second fitting part 211Ay located at the immediate back of this first fitting part 211Ax adjacently. This second fitting part 211Ay is provided for a fixed portion between a plate-shaped part constituting the first fitting part 211Ax and the bucket 212 described later. The position in a diameter direction of the second fitting part 211Ay is set closer a little to a center of the rotation wheel 210 than the position in the diameter direction of the first fitting part 211Ax. Further, at the fitting part 211B, a back fitting part 211Bx is formed. This back fitting part 211Bx is provided in the nearly same position in the diameter direction as the first fitting part 211Ax. Further, the back fitting part 211Bx faces, the rotational direction reverse to the direction which first fitting part 211Ax faces. The first fitting part 211Ax and the second fitting part 211Ay, and the back fitting part 211Bx have such structure that they can be fitted to each lever described later on the side reverse to each other.

At the peripheral part of the rotation wheel 210, in angular positions corresponding to the fitting parts 211A and 211B, the buckets 212 (corresponding to the above reception parts) are respectively fixed. In the shown example, the bucket 212 is arranged between the fitting parts 211A and 211B. This bucket 212 has an opening part 212*a* which opens continuously from the side reverse to the rotation direction to the peripheral side. Namely, the opening part 212*a* has the shape of a container constructed so that a portion which opens upward when the bucket 212 is arranged in a middle height position on the right side in the drawing of the rotation wheel 210 (that is, a portion which opens in the direction of the reverse rotation), and a portion which opens to the peripheral side (to the outside in the radius direction) of the rotation wheel 210 continue mutually.

Around the rotation wheel 210, there are provided a first lever 213 constructed so that it can fits to the second fitting part 211Ay, a second lever 214 which can adopt a posture which can fit to the first fitting part 211Ax, and a third lever 216 coupled to the first lever 213 through a link 215. Here, to a leading end portion of the third lever 216, a movable hook 217 which fits the second lever 214 and can lift a leading end part of the second lever 214 is rotatably attached. Further, a reverse-preventing lever 218 constructed so that it can fit the back fitting part 211Bx is also provided.

All of the first lever 213, the second lever 214, the third lever 216, and the reverse-preventing lever 218 are supported rotatably by the predetermined support members around each fixed fulcrum. Further, the movable hook 217 is supported rotatably by a portion near the leading end of the third lever 216. In each of these levers or the hook, by weight balance on the both sides of the fulcrum and a position of a stopper, a range of its operation and a basic posture can be appropriately set. Therefore, in each lever and the hook, according to necessity, a dead weight and a stopper are arranged in an appropriate position, whereby the operation described below is realized. Regarding each of these levers, in the following description, an end part working on the rotation wheel 210 rather than the fulcrum is referred to as a leading end part, and an end part located on the opposite side to this leading end part side with respect to the fulcrum is referred to as a base end part.

The rotation wheel 210 is rotation-driven by supplying the dead-weight body 15 lifted by the dead-weight lifting mechanism 100 to the bucket 212. As schematically shown in FIG. 15, when the dead-weight 15 is introduced through the opening part 212*a* into the inside of the bucket 212 arranged in the middle portion in the height direction of the rotation wheel 210, the weight balance is lost correspondingly to the weight of this dead-weight body 15, so that the rotation wheel 210 rotates clockwise. Then, when the bucket 212 faces to the downside obliquely, the dead-weight body 15 is exhausted through the opening part 212*a*. By thus repeating the supply and the exhaust of the dead-weight body 15, rotation drive force can be applied repeatedly to the rotation wheel 210.

Figure 19:
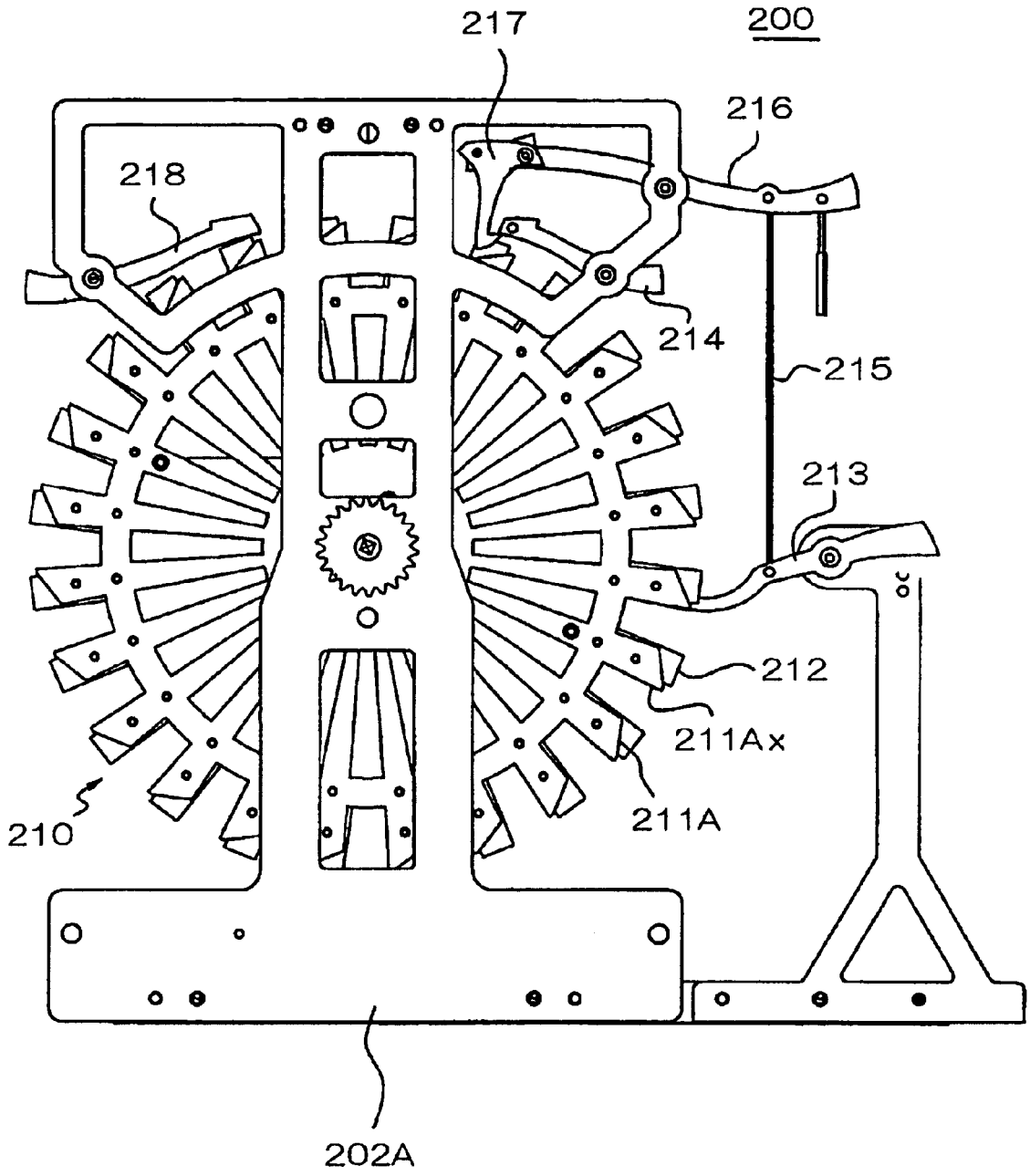
FIG. 19 is a front view of the clocking mechanism in a state where a rotation wheel rotates slightly.
Figure 20:
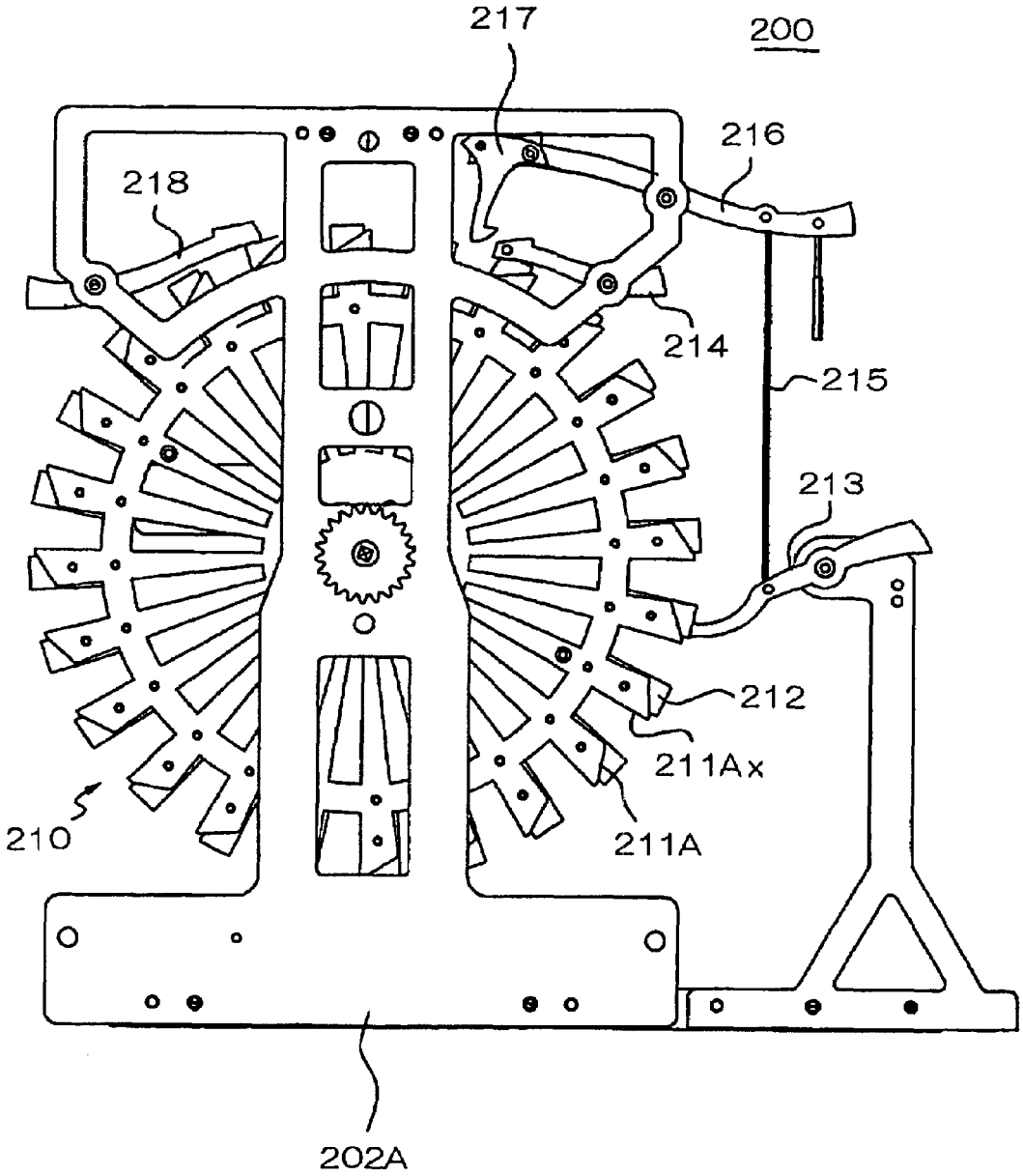
FIG. 20 is a front view of the clocking mechanism in a state where the rotation wheel further rotates from the state shown in FIG. 5.
Figure 21:
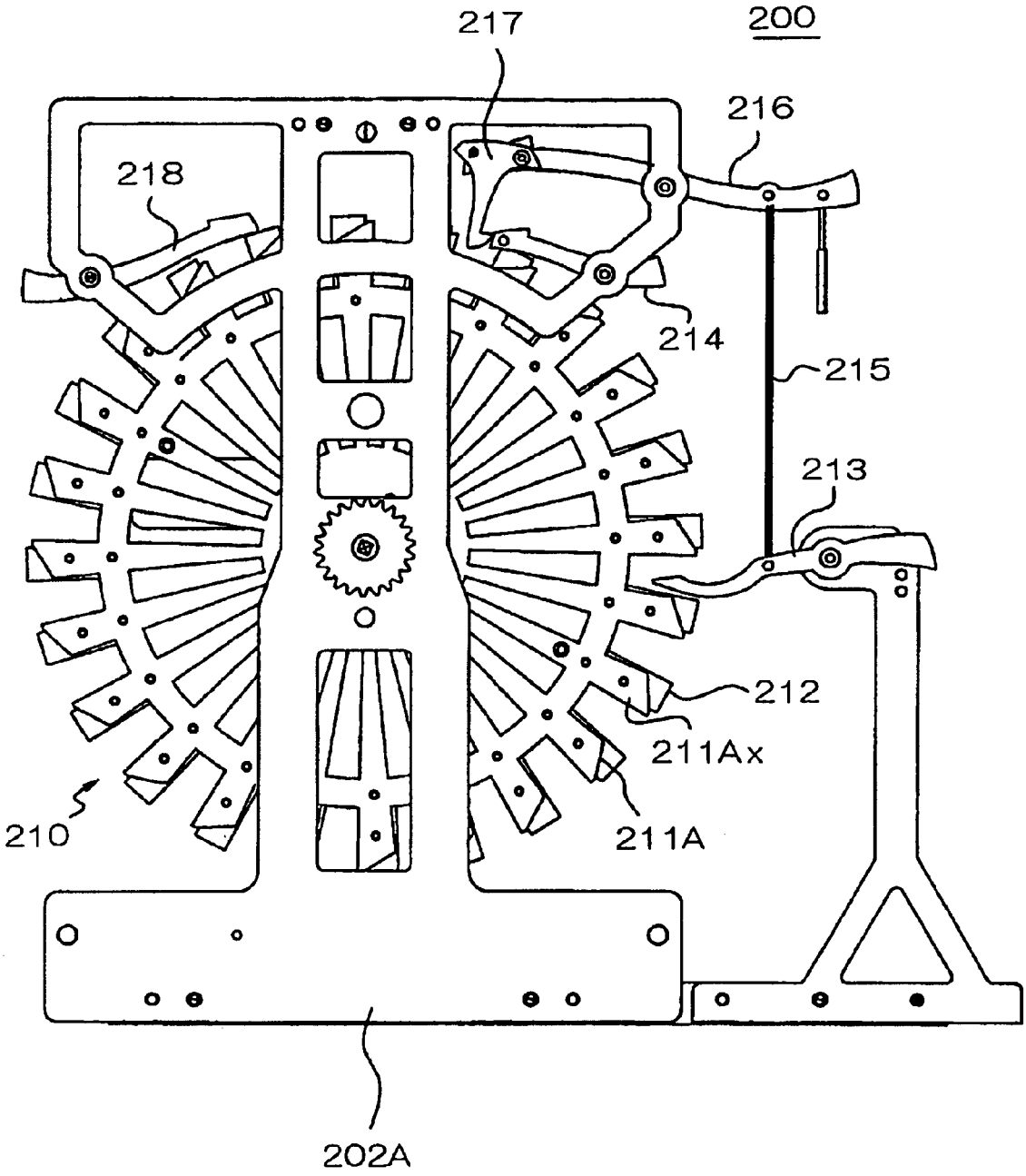
FIG. 21 is a front view of the clocking mechanism in a state where the rotation wheel further rotates from the state shown in FIG. 6.

Next, referring to FIGS. 19 to 21 with FIG. 16, the operation of the clocking mechanism 200 will be described. The rotation wheel 210 is so constructed as to be supported rotatably in the clockwise direction and prevent its counterclockwise rotation by the reverse-preventing lever 218. Accordingly, in the following description, rotation in a regular direction that is the clockwise direction in the shown example is taken as a forward direction, and rotation in a direction opposite to its direction is taken as a reverse rotation. FIGS. 19 to 21 are front diagrams of the clocking mechanism 200, and each diagram shows a state where the clocking mechanism 200 changes with passage of time.

Firstly, as shown in FIG. 16, in a state where the rotation wheel 210 stops, the rotation wheel 210 is located in a basic stop position. In this basic stop position, the rotation wheel 210 is positioned by restoring force in the direction of the reverse rotation by the leading end portion of the first lever 213, and by regulating work for preventing the reverse rotation by the reverse-preventing lever 218. Namely, the first lever 213 comes into contact with the rotation wheel 210 (second fitting part 211Ay) in the direction of the reverse rotation (from the downside in the drawing), and the reverse-preventing lever 218 comes into contact with the back fitting part 211Bx in the direction of the forward rotation (from the oblique downside in the drawing), whereby the rotation wheel 210 is positioned in the rotational direction by the both levers 213 and 218. The restoring force by the first lever 213 is produced by the weight balance on the both sides of the fulcrum of the first lever or the weight balance including also reaction force by the third lever 216 through the link 215. In order to adjust this restoring force, a dead weight may be provided for the base end portion of the first lever 213.

In the basic stop position, the second lever 214 is in a fitting posture in which it can fit the first fitting part 211Ax. This fitting posture is a posture where the leading end portion of the second lever 214 is close to the periphery of the rotation wheel 210. More particularly, the fitting posture means that the leading end portion of the second lever 214 is arranged on a passing track of the first fitting part 211Ax. When the second lever 214 is thus in the fitting posture, even if the rotation wheel 210 rotates in the forward direction, in case that the first fitting part 211Ax comes into contact with the leading end portion of the second lever 214, the rotation wheel 210 cannot rotate in the forward direction more.

Though the second lever 214 is in the fitting posture in the basic stop position, the first fitting part 211Ax does not come into contact with the leading end portion of the second lever 214 at the basic stop position. Actually, the rotation wheel 210 is in a rotatable state in the direction of the forward rotation at the predetermined angle from the basic stop position. Namely, the predetermined angle is a rotational angle of the rotation wheel 210 between the basic stop position and a position in which the first fitting part 211Ax comes into contact with and fits the leading end portion of the second lever 214.

Therefore, in the basic stop position shown in FIG. 16, the rotation wheel 210, by any rotation drive force, for example, by the rotation drive force due to the weight of the dead-weight introduced into the bucket 212, can be rotated in the direction of the forward rotation. When the rotation wheel 210 thus rotates forwardly, as shown in FIG. 19, the leading end portion of the first lever 213 is pressed down by the rotation wheel 210 (second fitting part 211Ay). Hereby, the third lever 216 turns through the cooperation link 215. Namely, the base end portion of the third lever 216 descends, and its leading end portion ascends to the contrary. At this time, since the leading end hook portion of the movable hook 217 is fitting the leading end portion of the second lever 214, the second lever 214 is lifted so as to separate from the rotation wheel 210 by the turn of the third lever 216. Hereby, the second lever 214 is put in a non-fitting posture. This non-fitting posture means a state in which the leading end portion of the second lever 214 is out of the passing track of the first fitting part 211Ax. Namely, this posture is a posture in which the second lever 214 cannot stop the rotation of the rotation wheel 210.

Since the second lever 214 is thus set in the non-fitting posture, the first fitting part 211Ax passes the inside of the second lever 214, and the rotation wheel 210 keeps rotating in the direction of the forward rotation. When the rotation wheel 210 thus rotates more in the direction of the forward rotation, the first lever 213 is further pressed down, whereby the third lever 216 further turns through the link 215. When the third lever 216 thus turns more, the movable hook 217 also separates more from the rotation wheel 210. Shortly, the leading end portion of the second lever 214 comes off the movable hook 217, and the leading end portion of the second lever 214 drops toward the rotation wheel 210 as shown in FIG. 20 and restores the fitting posture.

Further, before the second lever 214 restores the fitting posture from the non-fitting posture, one of the first fitting parts 211Ax, by the forward rotation of the rotation wheel 210, gets beyond the regulation position by the leading end portion of the second lever 214. After the first fitting part 211Ax has gotten beyond the regulation position, the second lever 214 restores the fitting posture as described above. Therefore, since the second lever 214 returns to the fitting posture after getting beyond one fitting part, the rotation of the rotation wheel 210 corresponding to one fitting part (corresponding to one tooth) is permitted.

Next, when the rotation wheel 210 rotates more, since the first lever 213 gets beyond angular range at which the first lever 213 fits the rotation wheel 210 (the second fitting part 211Ay), the first lever 213 comes off the rotation wheel 210, and thereafter, as shown in FIG. 21, starts restoring the original position (the position when the rotation wheel 210 is located in the basic stop position). In this process, the third lever 216 starts the restoring operation through the link 215, and the leading end portion of the third lever 216 starts moving toward the rotation wheel 210. Midway of this, the movable hook 217 comes into contact with the leading end portion of the second lever 214 that is in the fitting posture. However, since the movable hook 217 is coupled to the third lever 216 turnably, as shown in FIG. 21, the movable hook 217 turns in accordance with the shape of the leading portion of the second lever 214 and does not give any influence to the fitting posture of the second lever 214.

In the above process, in a period after the first lever 213 has come off the rotation wheel 210 and before the first lever 213 restores the original position, basically, the rotation wheel 210 does not fit the first lever 213 and the second lever 214, but keeps rotating in a state where the turn load by the first lever 213 does not exist. Therefore, in this period, as long as the rotation drive force given to the rotation wheel 210 does not decrease, it is thought that the rotation speed increases because rotation resistance lowers. Therefore, in this embodiment, at least in this period, in a state where the leading end portion of the reverse-preventing lever 218 is slightly brought into contact with the fitting part 211B from the upside, the reverse-preventing lever 218 brakes the rotation wheel 210. The rotation load by the braking action of this reverse-preventing lever 218 is produced alternatingly with the rotation load by the first lever 213. Namely, at a point of time when the rotation load by the first lever 213 is lost, the rotation load by the reverse-preventing lever 218 is produced. Hereby, since the rotation wheel 210 rotates in a state where it always receives the predetermined rotation load, the rotation speed of the rotation wheel 210 can be stabilized. Here, it is desirable that the two rotation loads are nearly equal. However, even if both the rotation loads are different, they can contribute to stability of the rotation speed of the rotation wheel. Further, even if both the rotation loads are not given to the rotation wheel 210 alternatingly, for example, even if a period in which both the rotation loads are given in an overlapping state exists, or even if a period in which neither of the rotation loads are given exists, the stabilization itself of the rotation speed of the rotation wheel 210 due to the rotation load by the reverse-preventing lever 218 can be obtained.

Lastly, the first lever 213 restores the original position, and the movable hook 217 is also put in the state where it fits the leading end portion of the second lever 214 and restores the original state shown in FIG. 16. In case that the rotation drive force is being lost at this time, the rotation wheel 210, by the restoring force of the first lever 213 and the fitting force of the reverse-preventing lever 218, is held in the basic stop position.

In the embodiment, in the state where the second lever 214 is in the non-fitting posture as shown in FIG. 19, when the rotation wheel 210 rotates at such the rotation speed that the escapement mechanism cannot follow the rotation of the rotation wheel 210, it is thought that two-teeth feeding of the rotation wheel 210 occurs. However, actually, midway of the forward operation of the first lever 213 by the drive of the rotation wheel 210, the second lever 214 restores the fitting posture as shown in FIG. 20. Therefore, however high the rotational speed of the rotation wheel 210 is, the two-teeth feeding of the rotation wheel 210 is obstructed by the second lever 214 which has restored the fitting posture. Namely, the higher the rotational speed of the rotation wheel 210 is, the higher the operation speed of the first lever 213 operating by the rotation wheel 210 becomes. Midway of the operation of the first fitting lever 213, the second lever 214 restores the fitting posture, so that the two-teeth feeding does not occur in timing. On the contrary, in case that the second lever 214 is set so as to restores the fitting posture in completion of the forward operation of the first lever 213 or during the restoring operation after that, possibility of occurrence of the two-teeth feeding depending on the rotation speed of the rotation wheel 210 is produced.

To the clocking mechanism 200, as shown in FIGS. 1 to 3, a wheel train 220 for driving a hand connected to the rotation shaft of the rotation wheel 210 is connected, and this wheel train 220 drives hands 231 and 232 arranged in front of a dial plate 230.

The rotation wheel 210 is driven by the dead-weight body 15 supplied from the dead-weight lifting mechanism 100. Namely, by the rotation of the drive body 110 of the dead-weight lifting mechanism 100, the dead-weight body 15 is gradually lifted upward, shortly exhausted from the exit 113Ay (the upper position) of the holding frame 113A, and supplied through the exit guide 133 to the bucket 211 that is in nearly horizontal posture. This bucket 212 is arranged in the nearly same height as the rotational shaft of the rotation wheel 210. When the dead-weight body 15 is supplied and housed into the bucket 212 through the opening part 212*a*, the weight balance of the rotation wheel is lost and the rotation wheel 210 starts rotating as described above. When the rotation wheel 210 turns by one tooth, the bucket 212 inclines, whereby the dead-weight body 15 is exhausted through the opening part 212*a*. The exhausted dead-weight body 15 is returned through the entrance guide 132 to the entrance 113Ax (lower position) of the dead-weight lifting mechanism 100.

Figure 22:
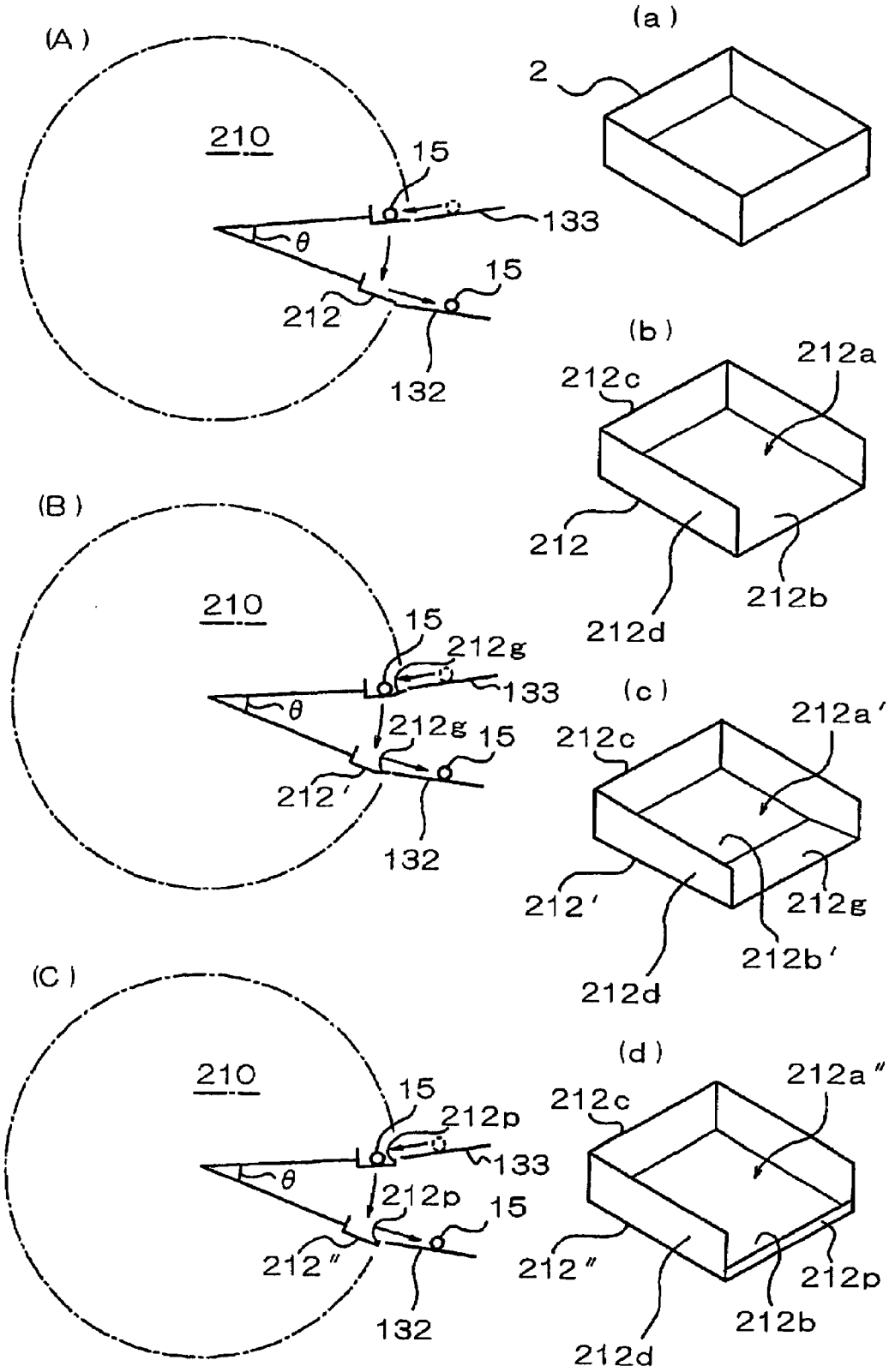
FIGS. 22*a* to 22*d* are perspective views showing the shapes of a bucket attached to the rotation wheel.

FIG. 22 shows a diagram showing the shape of the bucket (reception part having the shape of a container) of the rotation wheel 210, supply of the dead-weight body to the bucket, and exhaust of the dead-weight body from the bucket. Here, FIG. 22*a* is a perspective view showing a bucket 2 similar to that attached to a wheel of the conventional Water-powered Armillary and Celestial Tower, and FIGS. 22*b* to FIG. 22*d* are perspective views showing buckets improved in the embodiment. Further, FIGS. 22A to 22C are explanatory views showing the supply and exhaust of the dead-weight body when the buckets in FIGS. 22*b* to 22*d* are used.

As shown in FIG. 22A, the dead-weight body 15, after being exhausted from the dead-weight lifting means 100, is supplied through the exit guide 133 to the bucket 212, whereby the rotation wheel 210 rotates by the weight of the dead-weight body 15. Then, when the rotation wheel 210 rotates by an angle θ, the dead-weight body 15 is exhausted from the bucket 212, and returned through the entrance guide 132 to the dead-weight lifting means 100. Here, in case that the clocking mechanism is constructed so that the rotation wheel 210 rotates by one tooth by the supply of one dead-weight body 15 to the bucket 212, the angle θ must be set to an angle nearly equal to one period of the intermittent operation of the rotation wheel 210. Further, in order to heighten the drive force for the rotation wheel 210 which is produced by the weight of the dead-weight body 15, an angle range of the bucket rotating in a state where the dead-weight body 15 is housed must be set so as to include an angle position which is in height almost equal to an axis of the rotation wheel 210.

At this time, as shown in FIG. 22*a*, in a box-shaped bucket 2 in which only an upper opening part is provided, an introducing angle at which the dead-weight body can be introduced to the bucket 2 and the angular position of the bucket 2 into which the dead-weight body can be introduced are limited, and the dead-weight body cannot be exhausted naturally before the bucket 2 is in a greatly inclined posture. Therefore, the angle range of the rotation wheel 210 from the supply to the exhaust of the dead-weight body comes greatly off the angle position which is in height almost equal to the axis of the rotation wheel 210. Therefore, the drive efficiency lowers, loss of potential energy of the dead-weight body becomes large due to a fall of the dead-weight body in the introducing time because the dead-weight lifting means requires introducing the dead-weight body into the bucket 2 at a sharp angle, or the angle range θ of the rotation wheel 210 from the supply to the exhaust of the dead-weight body becomes large thereby to make increase of the number of teeth of the rotation wheel 210 impossible.

Here, in order to make the angle range θ small, it is necessary to construct each bucket 2 turnably for the rotation wheel like the bucket in the Water-powered Armillary and Celestial Tower. However, such the construction complicates the structure of the rotation wheel, and, complicates also the escapement mechanism like the Water-powered Armillary and Celestial Tower, when occasion demands. Further, since the bucket 2 has an outer wall on the peripheral side of the rotation wheel 210, this outer wall forms difference in level, which obstructs smooth taking in-out of the dead-weight body for the bucket 2.

Further, as a method of making the angle range θ small in a state where the bucket 2 is fixed, it is thought the side wall of the bucket 2 is made low. However, in case that the side wall of the bucket 2 is made low, in angle positions other than the regular angle position, or in portions other than the side wall on the peripheral side (for example, side wall on the inner circumferential side), dangerous possibility that the dead-weight body falls down from the bucket 2 becomes high. In case of trying to reduce this dangerous possibility, the dead-weight body must be introduced into the bucket 2 slowly and gently. In result, a limit is produced in the introducing structure of the dead-weight body. Further, since a large-sized dead-weight body cannot be used in order to prevent the fall of the dead-weight body from the bucket 2, there is also a drawback that the sufficient drive force for the rotation wheel cannot be obtained.

On the other hand, the bucket in the embodiment is provided with an opening part 212*a* which continues from the side reverse to the rotational direction of the rotation wheel 210 (the upside in FIG. 22) to the peripheral side. For example, in a bucket 212 shown in FIG. 22*b*, the opening 212*a* has the shape in which the peripheral side is completely opened (shape in which an outer wall on the peripheral side of the bucket is completely removed) by the opening part 212*a*. More particularly, the bucket 212 is cubic-shaped as a whole, and includes a bottom wall (bottom part) 212*b*, an inner wall (back part) 212*c*, and a side wall (side part) 212*d*, though the outer wall is not formed. Accordingly, as shown in FIG. 22A, taking in-out of the dead-weight body 15 can be smoothly performed, and the angle range θ of the rotation wheel 210 in the state where the dead-weight body 15 is housed in the bucket 212 includes the angle position which is in height equal to the axis of the rotation wheel 210. Therefore, the weight of the dead-weight body 15 can be efficiently utilized, and the high drive force can be obtained. Further, since the angle range θ of the rotation wheel 210 from the supply to the exhaust of the dead-weight body 15 can be set small, the number of teeth of the rotation wheel 210 can be set many without hindrance.

Further, in a bucket 212' shown in FIG. 22*c*, on the peripheral side of a bottom surface constituted by a bottom wall 212*b*', an inclined surface 212*g* which inclines upward toward the peripheral side of the opening part 212*a*' is provided. An inner wall 212*c* and a side wall 212*d* are the same as those of the bucket 212. In this bucket 212', since the inclined surface 212*g* is formed at the bottom surface portion on the peripheral side, as shown in FIG. 22B, the introduction and the exhaust of the dead-weight body 15 can be performed more smoothly. Further, by existence of this inclined surface 212*g*, it is possible to prevent the dead-weight body 15 which has been once introduced into the bucket 212 from jumping out to the peripheral side before a regular exhausting point of time by reaction due to the impact on the inner wall 212*c*. Further, by existence of the inclined surface 212*g*, the dead-weight body can be exhausted slowly.

The inclined angle of the inclined surface 212*g* to the inner bottom surface of the bottom wall 212*b*' has a great influence on the angle range θ. Therefore, by changing the inclined angle of the inclined surface 212*g*, the angle range θ can be regulated. For example, in case that other conditions (for example, an attachment angle of the bucket to the rotation wheel, an introducing angle position of the bucket, size of the bucket, and size of the dead-weight body) are the same, the bucket 212' becomes larger than the bucket 212 by the above inclined angle part.

A bucket 212" shown in FIG. 22*d* is basically formed in the shape of a container having an opening part 212*a*" similarly to the bucket 212. However, the bucket 212" is different from the bucket 212 in that a projection part 212*p* protruding from a bottom wall 212*b* upward is provided for an opening edge (that is, a peripheral edge of a bottom surface) on the peripheral side of the opening part 212*a*". By existence of this projection part 212*p*, as shown in FIG. 22C, it is possible to prevent the dead-weight body 15 which has been once introduced into the bucket 212" from jumping out to the peripheral side before a regular exhausting point of time by reaction due to the impact on the inner wall 212*c*. Further, by existence of the projection part 212*g*, the dead-weight body can be exhausted slowly.

The height of the projection part 212*p* or ratio of the height of the projection part 212*p* to the height of the side wall has a great influence on the angle range θ. Therefore, by changing the height of the projection part 212*p* or the above ratio, the angle range θ can be regulated. For example, by the height of the projection part 212*p*, and a size relation in distance between the bottom wall 212*b* and the central position of the dead-weight body, the angle range θ is determined.

Further, both the inclined surface 212*g* shown in FIG. 22*c* and the projection part 212*p* shown in FIG. 22*d* may be provided. Namely, an inclined surface is formed on the peripheral side of the inner bottom surface of the bucket, and further, a projection part protruding upward from an outer edge of this inclined surface is formed. Hereby, without obstructing taking in-out of the dead-weight body, the dead-weight body can be exhausted in a slow and stable mode.

In the above embodiment, as the spiral drive body 110 of the dead-weight lifting mechanism 100 rotates, the dead-weight body 15 gradually rises upward, on the inside of the guide plate 112, from the upper position, is supplied through the exit guide 133 to the bucket 212 provided at the periphery of the rotation wheel 210 of the clocking mechanism 200, and returns again, as the rotation wheel 210 rotates, from the bucket 212 through the entrance guide 132 to the drive body 110 in the lower position. The dead-weight body 15 circulates in this passage. The rotation wheel 210, every time the dead-weight body 15 is supplied, is fed one tooth by one tooth, and performs clocking. Therefore, the clock 1000 has not only the clock function but also high appreciation as a moving mechanism clock, so that the clock 1000 can sufficiently represent the charm of a mechanical operation.

Second Embodiment

Next, referring to FIG. 23 to FIG. 26, the construction of a clocking mechanism in another embodiment according to the invention will be described. This embodiment is different from the before-described embodiment in a bucket (reception part) provided for a rotation wheel 210 and only a part of fitting parts. Only the different points will be described below, and description of other construction is omitted.

Figure 23:
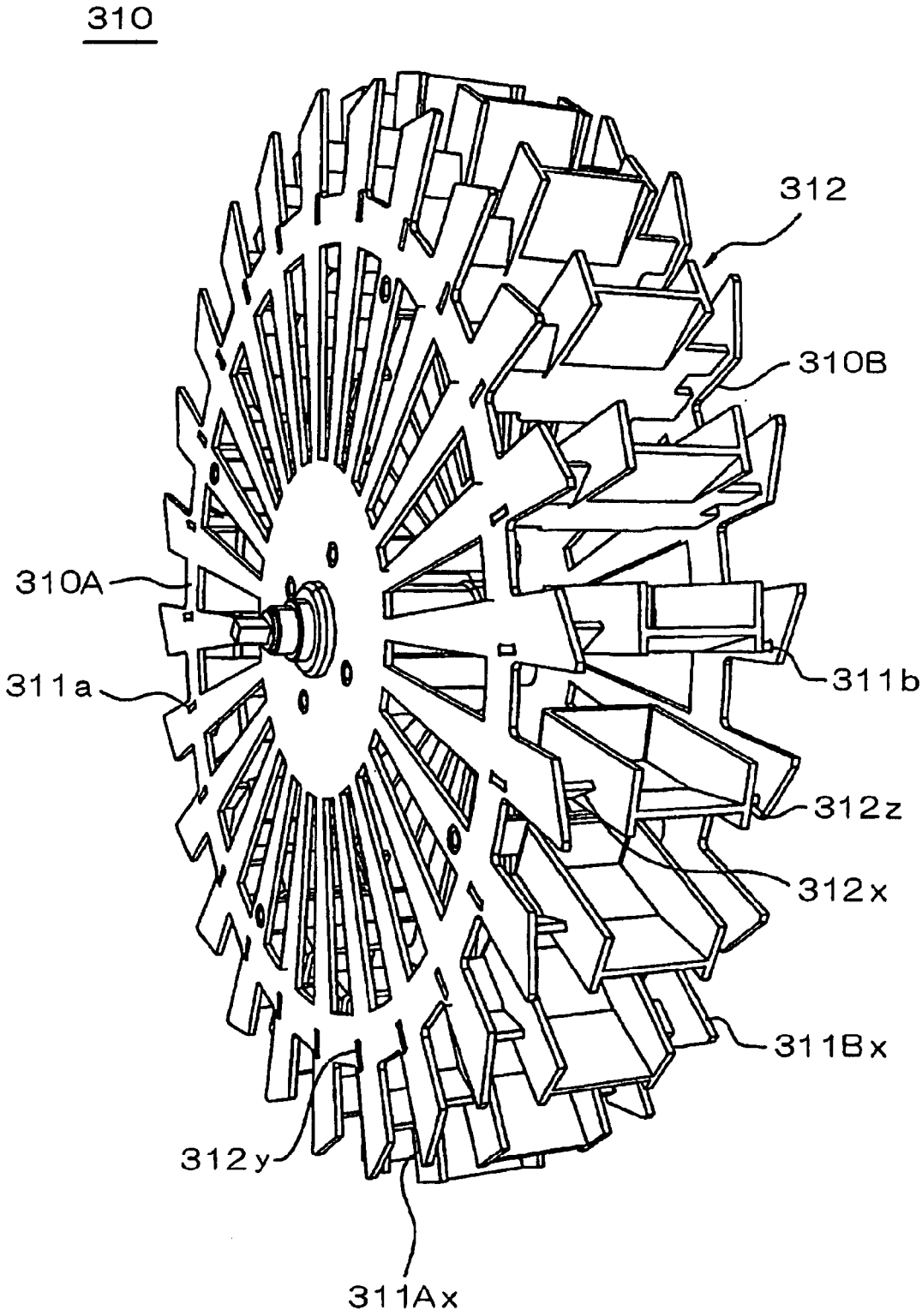
FIG. 23 is a schematically perspective view showing the structure of a different rotation wheel.

FIG. 23 is a schematically perspective view showing the structure of a rotation wheel 310 in this embodiment. In this rotation wheel 310, similarly to in the rotation wheel 210, to supporting plates 310A and 310B arranged on both sides in an axial direction, plural buckets (reception parts) 312 arranged along the periphery of the rotation wheel 310 are fixed. More particularly, on left and right side portions of the bucket 312, attachment parts 312*y* and 312*z* are provided. These attachment parts 312*y* and 312*z* are fixed respectively to an attached part (hole in the shown example) 311*a* provided for the support plate 310A, and an attached part (hole in the shown example) 311*b* provided for the support plate 310B fixed in a fitting state. At the peripheral part of the support plate 310A, a first fitting part 311Ax similar to the aforementioned is formed. At the peripheral part of the support plate 310B, a back fitting part 311Bx similar to the aforementioned is formed.

Figure 24:
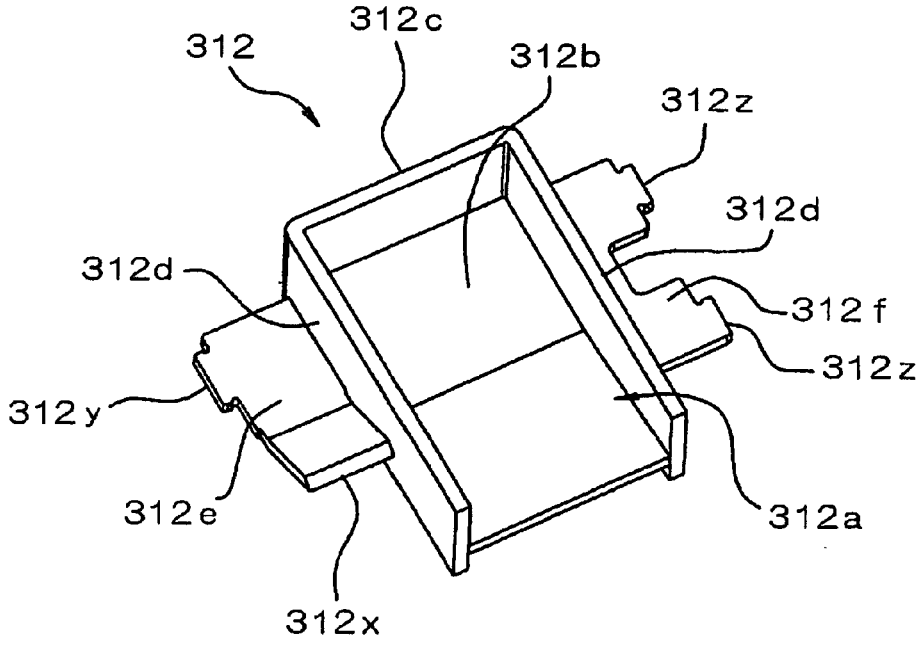
FIG. 24 is a schematically perspective view showing the structure of a bucket of the different rotation wheel.

FIG. 24 is a schematically perspective view of the bucket 312. This bucket 312 has a container-shaped part and attachment pieces provided on right and left sides of this container-shaped part. The container-shaped part is formed almost in the shape of a rectangular parallelepiped as a whole, has a bottom part 312*b*, a back part 312*c*, left and right side parts 312*d*, and an upper surface part and a front surface part which are continuously opened and form an opening part 312*a*. This bucket 312, in a state where its front side faces to the peripheral side of the rotation wheel 310, is fixed. Of an inner bottom surface of the bottom part 312*b*, a part on its front side is an inclined surface similar to that in the aforementioned embodiment. Further, at an outer edge on the front side of the bottom part 312*b*, a projection part similar to that in the aforementioned embodiment may be provided.

Outside the side parts 312*d*, attachment pieces 312*e* and 312*f* are provided. A portion on the front side of the attachment piece 312*e* becomes a second fitting part 312*x* constituting a part of the fitting parts in the aforementioned embodiment. Further, at a side edge of the attachment piece 312*e*, the attachment part 312*y* fixed to the attached part 311*a* of the support plate 310A is provided. On the other, at a side edge of the attachment piece 312*f*, the attachment parts 312*z*, 312*z* fixed to the attached part 311*b* of the support plate 310

B are provided.

The bucket 312 is constituted as an integral molding product using an integral plate-shaped material. Namely, the bucket 312 is a member molded integrally by various molding methods, for example, plastic working such as pressing or forging, casing mold working such as cast or injection mold, and cut working. More particularly, the bucket 312 in the embodiment is formed by bending a plate-shaped material such as an integral metal plate.

Figure 25:
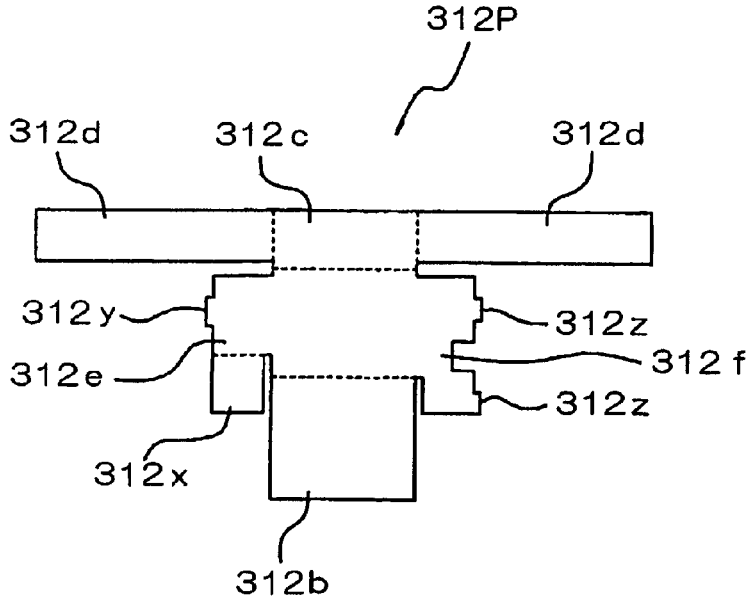
FIG. 25 is a development of the bucket shown in FIG. 24.

FIG. 25 shows an exploded shape of the bucket 312 in the embodiment. An integral plate-shaped material 312*p* shown in FIG. 25 can be very easily formed by press-blanking. In this plate-shaped material 312*p*, a bottom part 312*b* and a back part 312*c* are provided continuously, the back surface part 312*c* and left-right side parts 312*d*, 312*d* are provided continuously, and a bottom part 312*b* and left-right attachment pieces 312*e*, 312*f* are respectively provided continuously. Regarding this plate-shaped material 312*p*, by bending the back part 312*c* at nearly right angles to the bottom part 312*b*, and bending the left-right side parts 312*d*, 312*d* respectively at nearly right angles to the back part 312*c*, the shape of a container having an opening part 312*a* is formed. Here, a part constituting an inclined surface to be provided on the front side of the bottom part 312*b* is formed by bending slightly the bottom part 312*b*, and its part is arranged between the left-right side parts 312*d*, 312*d*.

In the bucket 312 in this embodiment, the container-shaped part and the attachment pieces 312*e*, 312*f* are integrally constituted. Hereby, since the number of parts of the rotation wheel 310 can be reduced, assembly working can be facilitated and a manufacturing cost can be reduced. Further, by integrally providing the second fitting part 312*x* for the bucket 312, a positional relation or an angular relation between the container-shaped part of the bucket 312 and the fitting part working on the escapement mechanism is determined uniquely. Therefore, without performing any positioning work for the both parts, the operation of the rotation wheel 310 can be surely performed.

[Rotational Operation of Rotation Wheel]

Next, in order to definite working effects in the embodiments, a rotation wheel provided with a bucket having the different constitution from the constitution of the buckets in the embodiments will be described. In the embodiments, the rotation wheel is intermittently actuated by fitting of the escapement mechanism. However, when the dead-weight body is always arranged in one or plural buckets of the rotation wheel, the rotation wheel is always in a state receiving the drive torque. Accordingly, the escapement mechanism must brake the rotation wheel, so that drive efficiency lowers. Therefore, in each of the embodiments, the weight of the dead-weight body is intermittently applied on the rotation wheel. Namely, the rotation wheel is constructed so as to repeat the following cycle: after the dead-weight has been put into the bucket of the rotation wheel and the bucket has been arranged throughout the predetermined angle range, the dead-weight body falls out of the bucket and ceases to exist in the rotation wheel. In this case, it is sufficient that there is a period for which the dead-weight body is not arranged into the bucket of the rotation wheel, and the number of the dead-weight bodies arranged simultaneously in the rotation wheel may be one, or two and more. Hereby, in timing when the rotation wheel stops by the escapement mechanism, the weight of the dead-weight body is not applied onto the rotation wheel. Therefore, since brake force applied onto the rotation wheel every cycle of the intermittent rotation can be reduced, the drive efficiency can be heightened.

Under the above construction, assuming that the buckets are arranged at regular angle intervals, in case that the number of the buckets in the rotation wheel is too small, the angle range in which the dead-weight body is being arranged in the bucket becomes large. Therefore, variation of the drive torque in the large angle range θ become large, and the weight of the dead-weight body cannot be efficiently converted into the drive torque for the rotation wheel. Therefore, it is preferable that the number n of the buckets is four and more (namely, an arrangement angle interval of the bucket is 360°/4=90° or less), and it is more desirable that the number of the buckets is six and more (namely, the arrangement angle interval of the bucket is 360°/6=60° or less). In this case, in one period of the intermittent operation, the angle range in which the dead-weight body is being arranged in the bucket must be the same as the arrangement angle interval of the bucket or smaller. However, usually, the angle range becomes smaller than the arrangement angle interval. An angle obtained by subtracting the angle range in which the dead-weight body is being arranged from the arrangement angle interval of the bucket becomes a racing angle, that is, an angle at which the rotation wheel rotates in a state where the drive torque is not being added to the drive wheel (by inertial).

Figure 33:
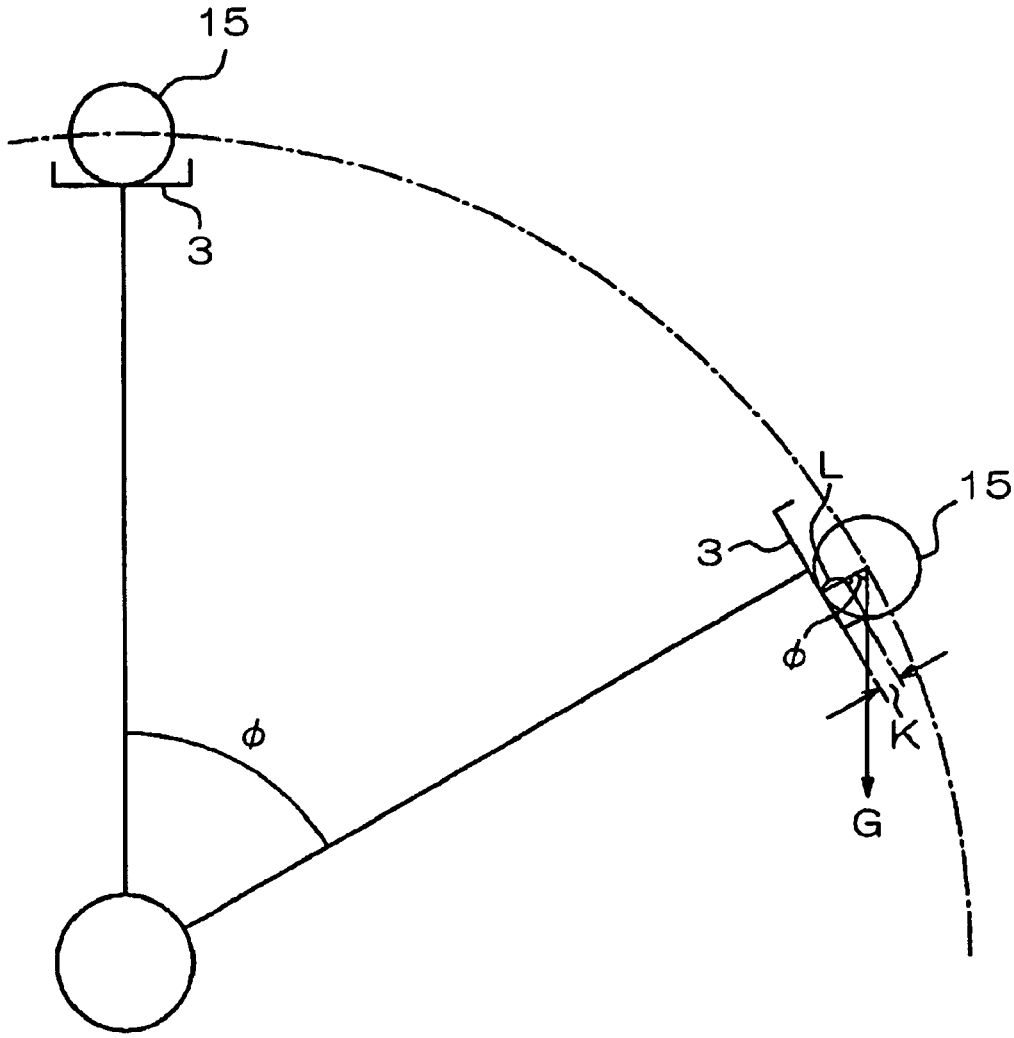
FIG. 33 is an explanatory view for explaining a constitutional example of the bucket and a working thereof.

FIG. 33 shows schematically the structure of a rotation wheel provided with a bucket (reception part) 3 having the constitution similar to the constitution of the recess part provided at the periphery of the rotation wheel of the moving mechanism clock which is exhibited at the Geneva Clock and Watch Museum. In this case, since the bucket 3 has the shape of a container which opens to the outside in the radius direction of the rotation wheel, an angle position in which the dead-weight body 15 is easy to be put into the bucket is, for example, an angle position when the bucket is located at the uppermost portion. However, since the rotation wheel is constructed so as to generate the drive torque by left and right unbalance of the rotational center due to the weight of the dead-weight body 15, actually, the drive torque is little produced when the bucket 3 is located in the vicinity of the uppermost portion. Further, in this bucket 3, whether the dead-weight body 15 is exhausted from the bucket 3 or not when the rotation wheel rotates by an angle ϕ from the above angle position is determined by a positional relation between an intersecting point of a perpendicular line passing a centroidal position of the dead-weight body 15 with the outer surface position of the dead-weight body 15, and an intersecting point of the side wall edge of the bucket 3 with the outer surface of the dead-weight body 15. Namely, by a size relation between a height K of the side wall of the shown bucket 3 which is measured on the basis of the bottom surface of the bucket 3, and a height L of the intersecting point of the outer surface position of the dead-weight body 15 with the perpendicular line passing the centroidal position of the dead-weight body 15 at the exhaust position of the dead-weight body 15 from the bucket 3 is determined.

Therefore, in this bucket 3, as its side wall is made higher, the angle ϕ at which the dead-weight body 15 is exhausted approaches 90 degrees gradually. Therefore, in order to increase the drive torque for the rotation wheel which is generated by the weight of the dead-weight body 15, the height K of the side wall must be increased. However, since the height cannot be set so that the angle ϕ exceeds 90 degrees, it is difficult to heighten the drive efficiency.

Figure 34:
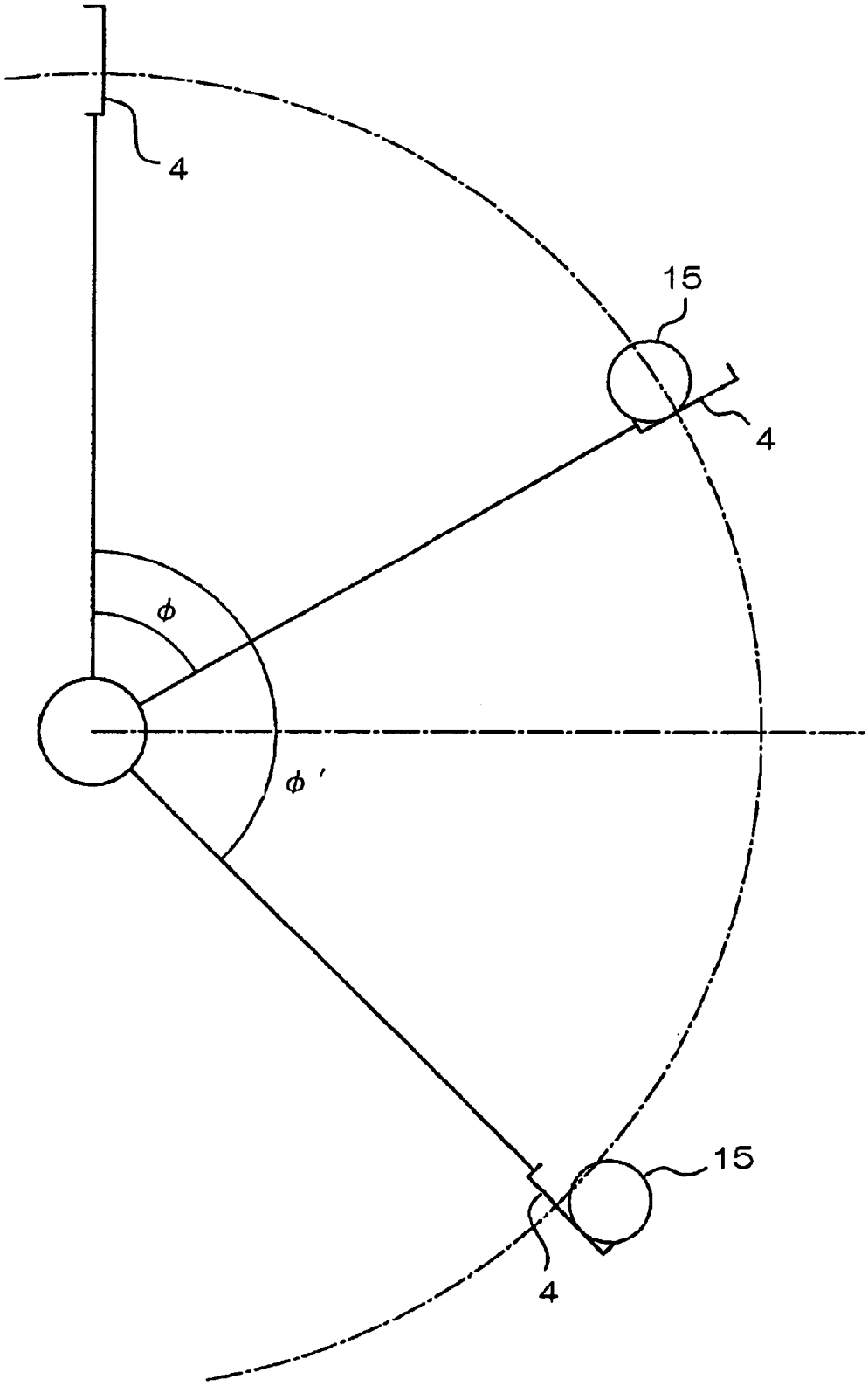
FIG. 34 is an explanatory view for explaining a constitutional example of a different bucket and a working thereof.

On the other hand, since a bucket 4 shown in FIG. 34 has the shape of a container which opens to the side reverse to the rotational direction of the rotation wheel, the bucket 4 can keep holding the dead-weight body 15 in a range where the above angle ϕ is about 90 degrees. Therefore, the drive torque produced by the weight of the dead-weight body 15 can be made large, and the drive efficiency can be increased. However, in this bucket 4, in case that the side wall is made low, possibility that the dead-weight body 15 falls out of the bucket 4 in supply of the dead-weight body 15 to the rotation wheel increases. On the contrary, in case that the side wall is made high, a position in which the dead-weight body 15 is exhausted is distant from the angle ϕ=90°, and becomes close to an angle ϕ of 180°, so that the drive efficiency lowers. Therefore, in order to solve such the problem, like the above bucket in the embodiment, the shape of a container which opens continuously from the side reverse to the rotational direction of the rotation wheel to the peripheral side should be adopted. Hereby, both stable holding of the dead-weight body 15 and improvement of the drive efficiency can be achieved.

[Drive Source]

Next, structure of the drive source 120 in the embodiment will be described. The drive source 120 constitutes the above clock drive part, and is composed of the clock drive mechanism as described above. This clock drive mechanism functions as a drive part for various clocks such as a mechanical clock, a quartz clock using a crystal resonator, and a radio clock having a function of receiving time information with a radio wave and correcting time display, and is generally called a movement. A time display part including a dial plate and hands and an outer case are combined with this movement to construct the usual clock.

Figure 26:
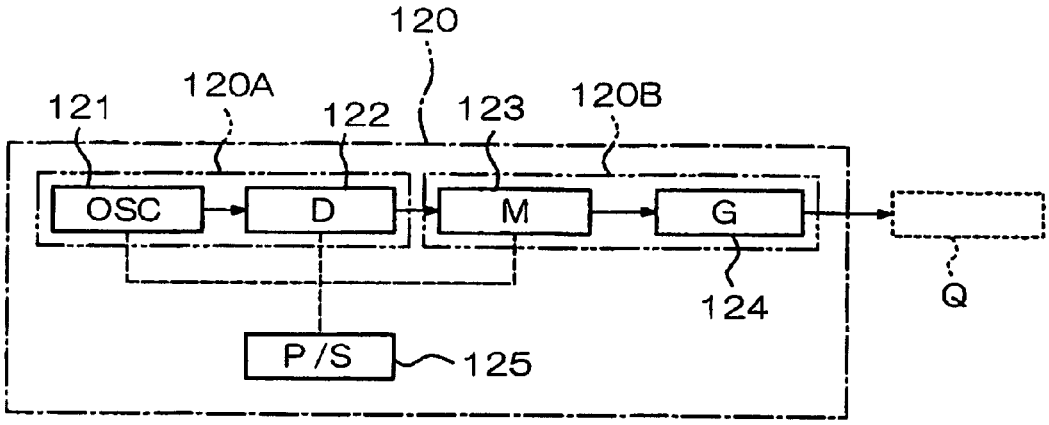
FIG. 26 is a block schematic diagram showing the inner structure of a drive source.

As shown in FIG. 26, the drive source 120 has a clock circuit 120A and a rotation output mechanism 120B. The clock circuit 120A includes an oscillation circuit 121 including a crystal resonator, and a frequency demultiplying circuit 122 which frequency-demultiplies a basic signal outputted from this oscillation circuit 121. The frequency demultiplying circuit 122 outputs the predetermined clock signal from the basic signal. Further, the rotation output mechanism 120B includes an electromotor 123 composed of a stepping motor which operates upon reception of the clock signal, and a rotation transmission part 124 composed of a wheel train which transmits rotation output of this electromotor 123 and changes the rotation output to the predetermined rotational speed. This rotation transmission part 124 outputs rotational motion of high accuracy which adjusts to time information. By driving the hand Q shown by dotted lines in the drawing with the rotational motion outputted from the rotation transmission part 124, the usual clock is constructed.

Figure 27:
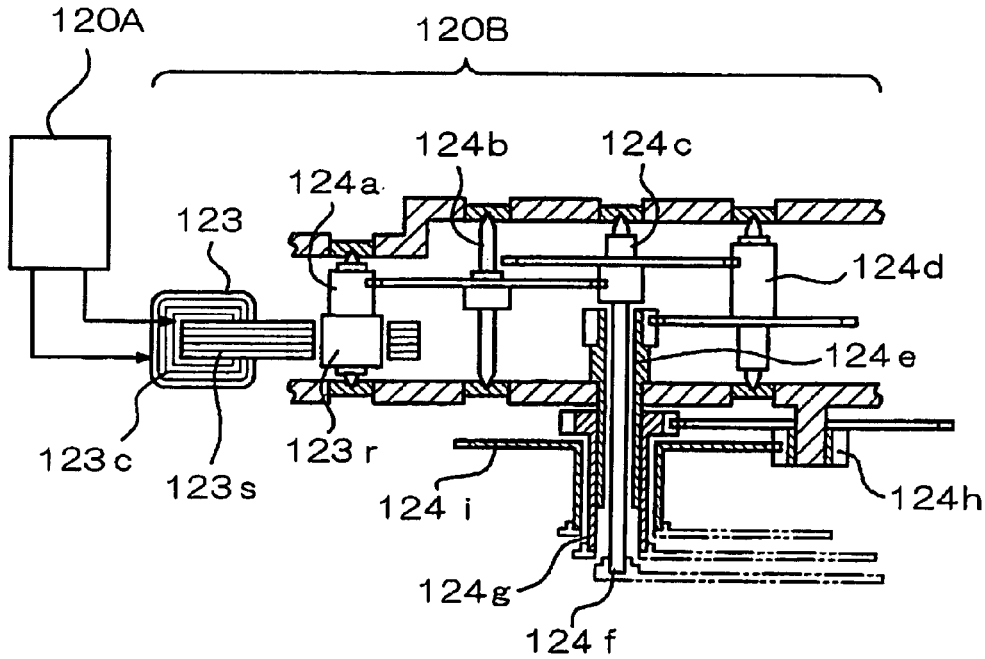
FIG. 27 is a schematically sectional view showing the structure of a rotation output mechanism of the drive source schematically.

FIG. 27 is a diagram showing the rotation output mechanism 120B of the drive source 120 more particularly. The electromotor 123 operating on the basis of the clock signal outputted from the clock circuit 120A comprises a stator 123*s*, a coil 123*c* coiled around this stator 123*s*, and a rotor 123*r* composed of a permanent magnet which is arranged opposed to the stator 123*c* and supported rotatably. The clock signal is supplied to the coil 123*c*, and the rotor 123*r*, by a variation magnetic field generated through the stator 123*s* by the supplied clock signal, rotates at a period synchronized with a period of the clock signal. The rotational motion of the rotor 123*r* is transmitted from a wheel 124*a* integrated with the rotor 123*r* sequentially to wheels 124*b*, 124*c*, 124*d*, and 124*e*. The rotation of the wheel 124*c* is output by a center output shaft 124*f*, and the rotation of the wheel 124*e* is output by a cylindrical member 124*g*. Further, the rotation of the wheel 124*e* is transmitted through a wheel 124*h* to an hour wheel 124*i* and output. Here, usually, to the center output shaft 124*f*, the second hand is connected and fixed; to the cylindrical member 124*g*, the minute hand is connected and fixed; and to the hour wheel 124*i*, the hour hand is connected and fixed.

In the embodiment, the hand is not connected to the rotation output mechanism 120B, and takes out the rotational motion from at least any one of the output parts of the center output shaft 124*f*, the cylindrical member 124*g*, and the hour wheel 124*i*. However, as described above, in the usual movement, since the center output shaft 124*f* has rotation speed of the second hand, the cylindrical member 124*g* has rotation speed of the minute hand, and the hour wheel 124*i* has rotation speed of the hour hand, these rotation speeds are not always preferable as drive rotation output of the moving mechanism clock. Further, generally, the movement of the clock is small in allowable levels of drive torque and load torque. Therefore, it is necessary to secure such drive torque that the motion converting mechanism (the above dead-weight lifting mechanism and rotation wheel) of the moving mechanism clock can be driven accurately. In this case, without changing the drive torque and rotation speed of the drive source 120, the drive torque can be increased by using a speed reducer, though the rotation speed lowers. On the other hand, when the rotation speed is increased, the drive torque lowers.

Figure 28:
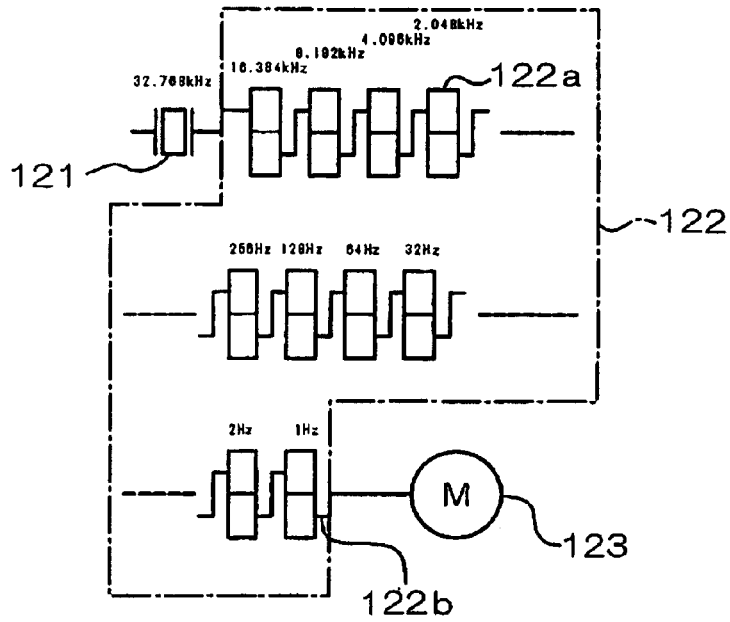
FIG. 28 is a block schematic diagram showing a schematic constitution of a frequency demultiplying circuit.
Figure 29:
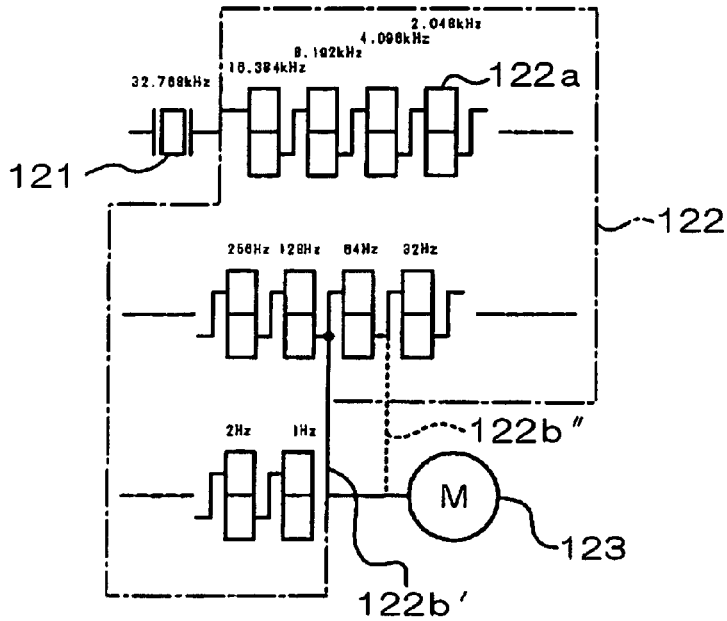
FIG. 29 is a block schematic diagram showing the constitution in which an output take-out part of the frequency demultiplying circuit is changed.

In the embodiment, in order to adjust the drive rotation speed and secure the drive torque, a part of the clock circuit 120 of the drive source 120 is modified to be used. FIG. 28 is a block schematic diagram showing the inner constitution of the frequency demultiplying circuit 122 in the usual clock circuit schematically. As shown in FIG. 28, in the frequency demultiplying circuit 122, plural frequency demultipliers 122*a* are connected in series, a reference signal outputted from the oscillation circuit part 121, of which frequency is, for example, 32.765 kHz is divided, and lastly a clock signal of, for example, 1 Hz is taken out in an output signal line 122*b*. In the embodiment, a part of the above frequency demultipliers 122 is modified, whereby an output signal line 122*b*' or 122" is taken out from a frequency demultiplier 122*a* different from the frequency demultiplier 122*a* which takes out the output signal line 122*b*. Hereby, by this output signal, for example, by the signal of the frequency 128 Hz or 64 Hz, the electromotor 123 is driven. By thus changing the frequency of the clock signal for driving the electromotor 123, the output rotation speed of the rotation output mechanism can be increased without lowering the drive torque greatly.

[Whole Construction]

Figure 30:
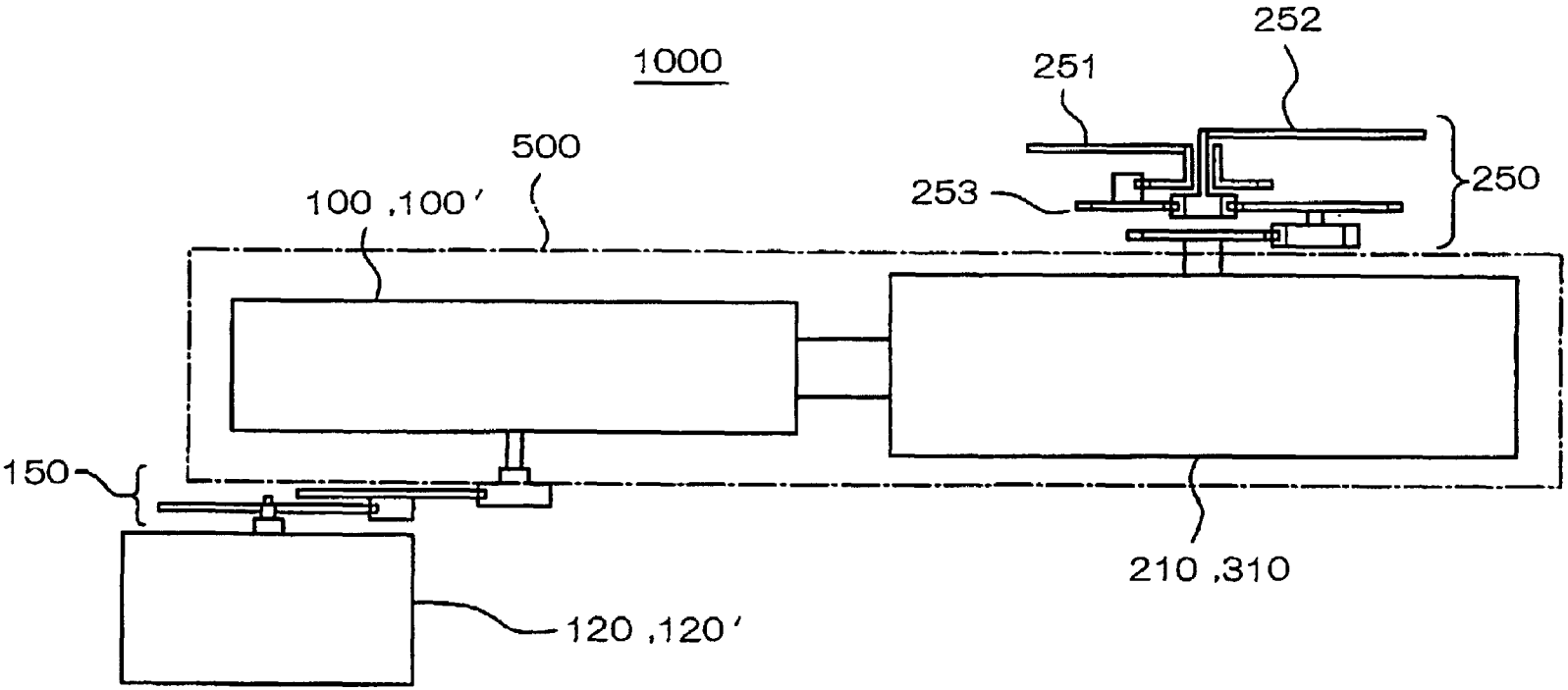
FIG. 30 is a block schematic diagram showing schematically the whole constitution of the clock.

Lastly, the whole construction of the clock 1000 in the embodiment will be described. The clock 1000 in the embodiment, as shown in FIG. 30, comprises a drive source 120 or 120' as a drive mechanism part, a dead-weight lifting mechanism 100 or 100' as a first motion converting mechanism, a rotation wheel 210 or 310 as a second motion converting mechanism, and a time display part 250. Here, the above dead-weight lifting means includes the dead-weight lifting mechanism 100, 100', and the drive source 120, 120'. The above clocking mechanism 200 includes the rotation wheel 210, 310, and the time display part 250.

The drive source 120, 120' is composed of the clock drive mechanism as described above, and outputs exactly rotational motion. Here, this rotational motion may be continuous rotation or intermittent rotation. Further, the rotation motion may be what can be directly taken out from the output part of the usual clock drive mechanism (for example, rotational motion corresponding to an hour hand of the clock, a second hand thereof, or a minute hand thereof) or what can be directly taken out from motion parts (a wheel in a wheel train and the like) other than the output part of the clock drive mechanism.

Figure 31:
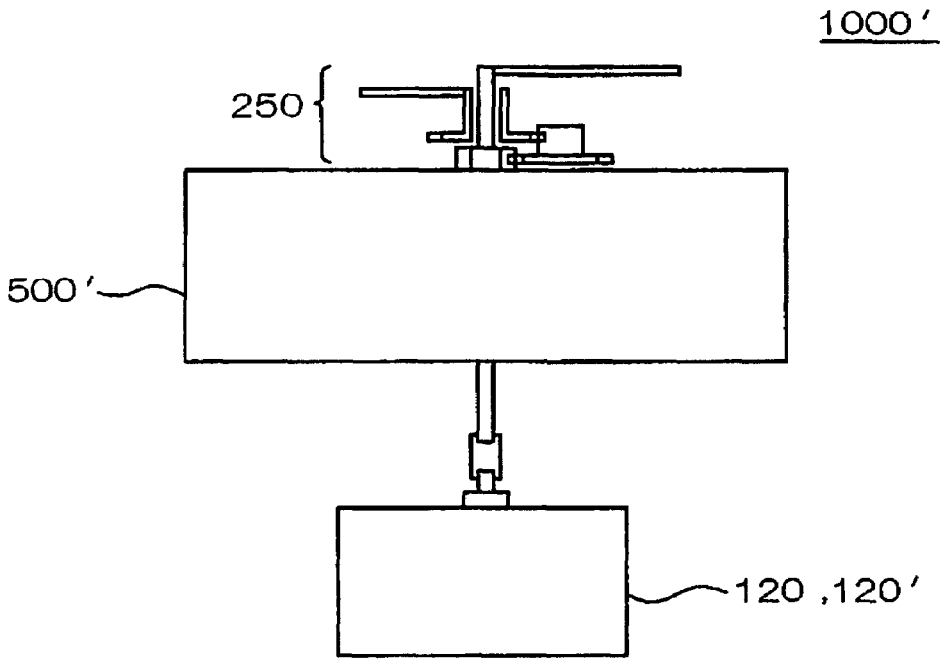
FIG. 31 is a block schematic diagram showing schematically the whole constitution of another clock.

The first motion converting mechanism (dead-weight lifting mechanism) converts the predetermined rotational motion outputted from the drive source (clock drive mechanism) into a motion mode other than the rotational motion. Here, motion mode other than the rotational motion means motion other than the motion rotating around the predetermined axis, for example, translation or reciprocation. In case of this embodiment, by the rotation of the drive body, the dead-weight body performs translation, and more particularly rising motion. Further, in case of the embodiment, as shown in the drawing, between the drive source 120, 120' and the first motion converting mechanism 100, 100', a motion transmission mechanism 150 composed of an appropriate deceleration wheel train or an appropriate acceleration wheel train may be provided. Further, the drive source 120, 120' and the first motion converting mechanism 100, 100' may be directly connected as shown in FIG. 31.

Next, the second motion converting mechanism (rotation wheel) converts the motion mode of the first motion converting mechanism into rotational motion again. At this time, the rotational motion converted by the second motion converting mechanism may be the predetermined rotational motion which the drive source (clock drive mechanism) outputs. However, it is preferable that the converted rotational motion is usually rotational motion other than the predetermined rotational motion. In case of the embodiment, since the rotation wheel rotates intermittently by the weight of the supplied dead-weight body, the converted rotational motion is the intermittently rotational motion.

The time display part 250, on the basis of the rotational motion outputted by the second motion converting mechanism (rotation wheel), operates. In case of the shown example, the hands (hour hand, second hand and the like) 251, 252 turns thereby to display time. This time display part 250, in case that the rotational motion outputted by the second motion converting mechanism 210, 310 is not suitable to display time as it is, includes the appropriate rotation converting mechanism or the rotational transmission mechanism 253 like the shown example, and performs the time display according to outputs of these mechanisms 253.

In the embodiment, in the first motion converting mechanism and the second motion converting mechanism, an operation in a mode different from that in the usual clock (namely, an operation which is not necessary for the usual clock) is produced. Therefore, the construction in the embodiment is suitable for a moving mechanism clock. Further, since the clock drive mechanism is used as the drive source 120, 120', accuracy of time displayed in the time display part can be secured. Further, by using the general-purpose clock drive mechanism, a manufacturing cost can be reduced.

Figure 32:
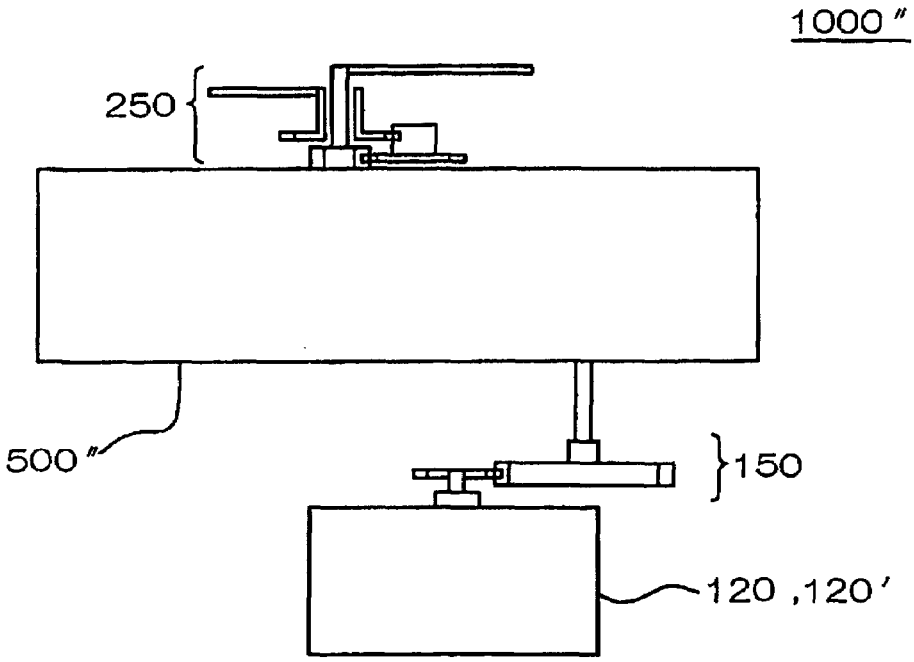
FIG. 32 is a block schematic diagram showing schematically the whole constitution of another clock.

In this case, it is preferable that the drive source 120, 120', viewed from the front side of the time display part 250, is arranged behind at least any of the first motion converting mechanism 100, 100', the second motion converting mechanism 210, 310, and the time display part 250. Hereby, since it becomes difficult to confirm the existence of the drive source 120, 120' visually, in case that this clock is constructed as the moving mechanism clock, the clock can improve appreciation more. In this case, it is preferable that the whole of the drive source 120, 120' is completely arranged behind a motion converting part 500 comprising the first motion converting mechanism 100, 100' and the second motion converting mechanism 210, 310. Namely, even if a person on the front side opposite to the time display part 250 is in a location sufficiently distant from the time display part 250, in case the whole of the drive source 120, 120' is completely arranged behind the motion converting part 500, better appreciation can be obtained. As clocks in such the mode, there are clocks 1000' and 1000" having motion converting parts 500' and 500", as shown in FIGS. 31 and 32. In FIGS. 31 and 32, parts constructed similarly to those in FIG. 30 are denoted by the same reference numerals.

The clock of the invention is not limited to only the above shown example, and various changes can be added without departing from the spirit of the invention. For example, thought the dead-weight body 15 is the spherical body, it may be a columnar body or a cylindrical body as long as the rolling direction of the dead-weight body can be controlled in the supplying time and the exhausting time of the dead-weight body for the dead-weight lifting mechanism 100 and the clocking mechanism 200. Further, as long as the dead-weight body is slid to be moved, the dead-weight body may have arbitrary shape other than the above shapes.

Further, in the dead-weight lifting mechanism, the set direction of the axis of the spiral drive surface is not limited to the horizontal direction, but may be an inclined direction. In this case, the dead-weight body can be lifted in the inclined direction.

Further, in the clocking mechanism, the rotation wheel having the rotation shaft basically set in the horizontal direction is provided with each lever which operates by the gravity working. However, the clocking mechanism is not limited to such the mode, but it may be provided with a rotation wheel having a rotational shaft set in the different direction from the horizontal direction. Further, each lever may operate by stress other than the gravity, for example, by elastic force of an elastic member such as a spring. Further, the first fitting part 211Ax, the second fitting part 211Ay and the back fitting part 211Bs are provided for the rotation wheel, and the first lever 213, the second lever 214, and the reverse-preventing lever 218 fit respectively to these different fitting parts. However, as each of these fitting parts, a common part can be used appropriately. Alternatively, the different lever may fit the different portion of the same fitting part. In any case, as long as each lever fits the appropriate fitting part of the rotation wheel 110 such that it can separate from the fitting part in the rotational direction, any fitting structure may be adopted.

INDUSTRIAL APPLICABILITY

The present invention has distinguished advantages that very novel appreciation can be obtained particularly in a moving mechanism clock, a design clock or various clocks constructed as a part of an ornament or an art object, and reduction of a manufacturing cost and exactness of the time display can be realized.

The invention claimed is:

1. A timepiece comprising:

a timepiece drive section having a timepiece circuit for forming a timepiece signal corresponding to the time of day, and a rotation output mechanism for outputting a rotation synchronous with the timepiece signal;

a first motion conversion mechanism for converting a rotation outputted by the timepiece drive section into a form of movement other than rotation; and a time display section for displaying the time of day in accordance with the form of movement of the first motion conversion mechanism;

the first motion conversion mechanism configured to be a weight lifting mechanism having a drive body comprising a spiral drive surface whose axis is horizontal or inclining so that the drive body can be rotated about the axis by the timepiece drive section whereby a weight on the drive surface is driven to undergo translational movement from a lower position to an upper position.

2. A timepiece comprising:

a timepiece drive section having a timepiece circuit for forming a timepiece signal corresponding to the time of day, and a rotation output mechanism for outputting a rotation synchronous with the timepiece signal;

a weight lifting mechanism for periodically lifting and successively discharging the weight from a lower position to an upper position, based on a rotation outputted by the timepiece drive section;

a rotating wheel intermittently rotated by the gravity of the weight intermittently brought to bear thereon through repetition of a cycle in which the weights discharged from the weight lifting mechanism are received sequentially according to the discharge timing, and after a weight moves over a predetermined angular range, it is discharged and ceases to exist; and a time display section for displaying the time of day in accordance with intermittent rotation of the rotating wheel.

3. A timepiece according to claim 2, wherein the rotating wheel has at its outer periphery a plurality of receiving portions for receiving the weight, the weight lifting mechanism supplies the rotating wheel with a weight at a receiving portion at the upper portion of the weight lifting mechanism, whereby after the rotating wheel rotates a predetermined angle, the weight discharges from the receiving portion and is returned to a lower position by the lower portion of the weight lifting mechanism.

4. A timepiece according to claim 3, wherein the timepiece drive section is arranged to the rear of one of the group consisting of the weight lifting mechanism, the rotating wheel and the time display section, as viewed from in front of the time display.

5. A timepiece according to any one of claims 1 to 4, wherein the weight lifting mechanism has a drive body having a spiral drive surface having a horizontal or inclining axis so that the drive body can be rotated about the axis by the timepiece drive section whereby the weight on the drive surface is driven by rotation of the drive body to undergo translational movement from the lower position to the upper position.

6. A timepiece having a weight, weight lifting means for lifting the weight supplied in a lower position toward an upper position, a rotating wheel having, along its outer periphery, a plurality of receiving portions capable of supporting the weight, and an escapement mechanism for intermittently operating the rotating wheel, the timepiece characterized in that:

the weight lifted to the upper position by the weight lifting means is supplied to the receiving portion located close by, and after the rotating wheel rotates a predetermined angle, the weight discharges from the receiving portion and is returned to the lower position located by the lower portion of the weight lifting means, the weight lifting means configured to be a weight lifting mechanism having a drive body comprising a spiral drive surface whose axis is horizontal or inclining, and a rotation drive source for rotating the drive body about the axis, the weight driven on the drive surface is driven by rotation of the drive body to undergo translational movement from the lower position to the upper position.

7. A timepiece according to claim 6, wherein the weight lifting means has guide means for guiding the weight upward.

8. A timepiece according to claim 7, wherein the weight is to move upward while rotating on the drive surface.

9. A timepiece according to any one of claims 6 to 8, wherein the weight is a columnar body, a cylindrical body or a spherical body.

10. A timepiece according to any one of claims 6 to 8, wherein the axis of the drive body is set horizontal.

11. A timepiece according to claim 6, wherein the drive body has one pair of spiral strips arranged juxtaposed along the direction of the axis, the surfaces thereof constituting the drive surface, further including support frames arranged on both sides of the pair of spiral members along the axis and supporting the weight, and a guide member arranged between the pair of spiral strips and having a guide edge extending radially.

12. A timepiece according to claim 6, wherein the drive body has one pair of plate members which are spiral shaped in plan view juxtaposed along the axis and whose end edges constitute the drive surfaces, further including support frames arranged on both sides of the pair of plate members along the axis and supporting the weight, and a guide member arranged between the two plate members, extending radially.

13. A timepiece according to any one of claims 6 to 8, 11 and 12, wherein the receiving portion is in the form of a container having an opening opened continuously from the side opposite the direction of rotation to the outer peripheral side.

14. A timepiece according to claim 13, wherein from the outer periphery of the bottom of the receiving portion an inclining surface is formed upwardly inclining toward the opening edge at the periphery of the opening.

15. A timepiece according to claim 13, wherein a protrusion is provided at the outer peripheral edge of the bottom of the receiving portion.

16. A timepiece according to any one of claims 6 to 8, 11 and 12, wherein the escapement mechanism has plural engaging points provided on the rotating wheel in the direction of rotation, a first lever structured so that it can engage with the engaging points over a predetermined angle range of the rotating wheel and pivotally supported so that when engaged with an engaging point a forward rotation of the rotating wheel causes the first lever to rotate, a second lever pivotally supported so that it can rotate between an engaging position where it can engage with the engaging point and a non-engaging position where it cannot engage with the engaging point so that, in the engaging position, the rotating wheel can be stopped from rotating forward by engagement of the second lever with the engaging point, and a third lever moving together with the first lever and capable of switching the second lever between the engaging position and the non-engaging position, wherein, in a reference standard stop position of the rotating wheel, the second lever is in the engaging position and the rotating wheel is in a state allowing forward stepwise rotation up until it engages with the engaging point with the second lever, when the rotating wheel begins to rotate forward from the reference standard stop position, and prior to the engagement of the engaging point with the second lever, the first lever is rotated by the engaging point and together with this action the third lever rotates so that the second lever is temporarily placed in non-engaging state by the third lever, the first lever rotates further when the rotating wheel rotates further, whereby after the engaging point goes beyond the second lever, the third lever causes the second lever to return to the engaging position, the first lever thereafter being caused to leave the engaging point and return to a former position.

* * * * *